US010634422B2

(12) United States Patent
Yang et al.

(10) Patent No.: US 10,634,422 B2
(45) Date of Patent: Apr. 28, 2020

(54) REFRIGERATOR

(71) Applicant: LG Electronics Inc., Seoul (KR)

(72) Inventors: Changwoan Yang, Seoul (KR); Seungjin Choi, Seoul (KR); Hanhyo Kim, Seoul (KR); Yoomin Park, Seoul (KR); Minwoo Park, Seoul (KR); Tackwon Han, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/550,691

(22) PCT Filed: Feb. 12, 2016

(86) PCT No.: PCT/KR2016/001446
§ 371 (c)(1),
(2) Date: Aug. 11, 2017

(87) PCT Pub. No.: WO2016/129956
PCT Pub. Date: Aug. 18, 2016

(65) Prior Publication Data

US 2018/0038632 A1 Feb. 8, 2018

(30) Foreign Application Priority Data

Feb. 13, 2015 (KR) ..... 10-2015-0022197
Feb. 13, 2015 (KR) ..... 10-2015-0022648
Jan. 5, 2016 (KR) ..... 10-2016-0001267

(51) Int. Cl.
*F25D 25/02* (2006.01)
*F25D 23/02* (2006.01)
*F25D 23/06* (2006.01)

(52) U.S. Cl.
CPC ..... *F25D 25/025* (2013.01); *F25D 23/028* (2013.01); *A47B 2210/175* (2013.01); *F25D 23/067* (2013.01)

(58) Field of Classification Search
CPC .... F25D 25/025; F25D 23/028; F25D 23/067; A47B 2210/175
See application file for complete search history.

(56) References Cited

U.S. PATENT DOCUMENTS 1,227,813 A * 5/1917 Mahoney ..... A47B 96/16 109/47
1,835,847 A * 12/1931 Chandler ..... F25D 25/02 126/340

(Continued)

FOREIGN PATENT DOCUMENTS

CN 202066294 12/2011
JP H0636432 5/1994

(Continued)

OTHER PUBLICATIONS

Extended European Search Report in European Appln. No. 16749496.2, dated Feb. 14, 2019, 8 pages.

(Continued)

*Primary Examiner* — Hanh V Tran
(74) *Attorney, Agent, or Firm* — Fish & Richardson P.C.

(57) ABSTRACT

A refrigerator includes a cabinet that includes a storage compartment. The refrigerator further includes a door. The refrigerator further includes a drawer. The refrigerator further includes a drawer guide that is configured to support the drawer and that is configured to guide the drawer based on the drawer moving forward and backward. The refrigerator further includes a withdrawal unit that is configured to push the drawer forward based on the door opening. The withdrawal unit includes a base part that is located under the drawer, that is configured to move forward based on the door opening, and that is configured to move backward based on the door closing. The withdrawal unit further includes a rear frame that extends from the base part to a rear side of the (Continued)

drawer and that is configured to push the drawer forward based on the base part moving forward.

59 Claims, 29 Drawing Sheets

(56) References Cited

U.S. PATENT DOCUMENTS

| | | | | | |
|---|---|---|---|---|---|
| 2,095,811 | A * | 10/1937 | Goulooze | F25D 25/024 | 126/337 R |
| 2,761,751 | A * | 9/1956 | Haines | F25D 25/024 | 312/274 |
| 5,005,729 | A * | 4/1991 | Hollman | B65F 1/1436 | 220/23.83 |
| 5,299,863 | A * | 4/1994 | Albright, Jr. | F25D 25/024 | 312/404 |
| 5,474,374 | A * | 12/1995 | Sandvig | A47B 77/18 | 312/271 |
| 8,267,493 | B2 * | 9/2012 | Kim | F25D 25/024 | 108/106 |
| 9,322,592 | B2 * | 4/2016 | Kim | F25D 23/04 | |
| 9,726,423 | B1 * | 8/2017 | Swarnkar | F25D 25/024 | |
| 2005/0275326 | A1 * | 12/2005 | Lim | F25D 25/024 | 312/408 |
| 2010/0253191 | A1 * | 10/2010 | Backhaus | A47B 96/16 | 312/309 |
| 2010/0307186 | A1 * | 12/2010 | Kwon | F25D 23/028 | 62/407 |
| 2011/0095670 | A1 * | 4/2011 | Cho | F25D 25/025 | 312/405.1 |
| 2012/0031136 | A1 * | 2/2012 | Park | F25D 11/02 | 62/340 |
| 2013/0257255 | A1 * | 10/2013 | Hwang | F25D 23/02 | 312/404 |

FOREIGN PATENT DOCUMENTS

| | | |
|---|---|---|
| JP | 3112237 | 8/2005 |
| JP | 2011-202854 | 10/2011 |
| KR | 10-2005-0060115 | 6/2005 |
| KR | 100727021 | 6/2007 |
| KR | 2020110006604 | 6/2011 |
| KR | 1020110121175 | 11/2011 |
| KR | 10-2014-0013718 | 2/2014 |

OTHER PUBLICATIONS

Chinese Office Action in Chinese Application No. 201680015676.5, dated Jun. 14, 2019, 14 pages (with English translation).

* cited by examiner

[Fig. 1]
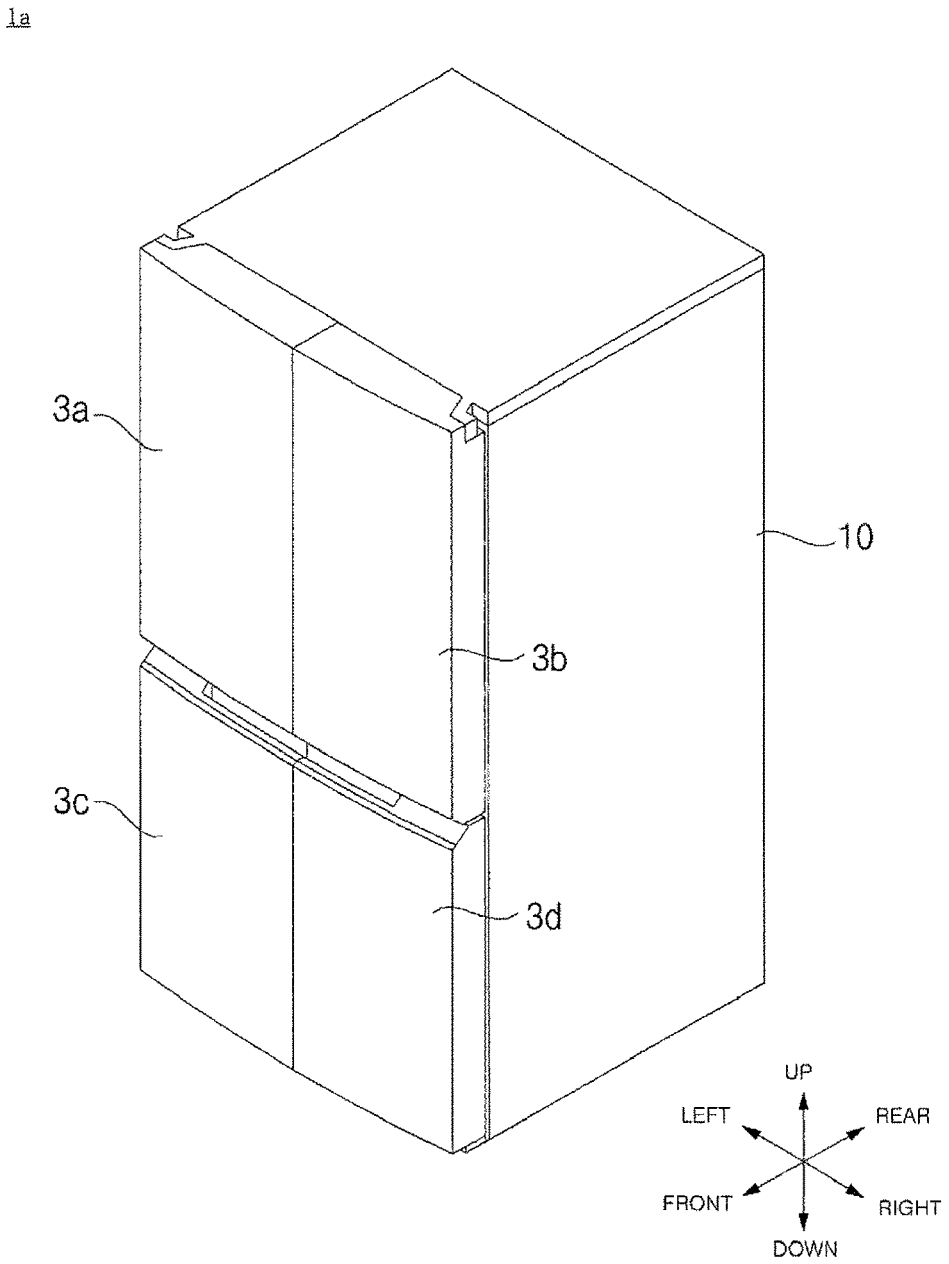

[Fig. 2]
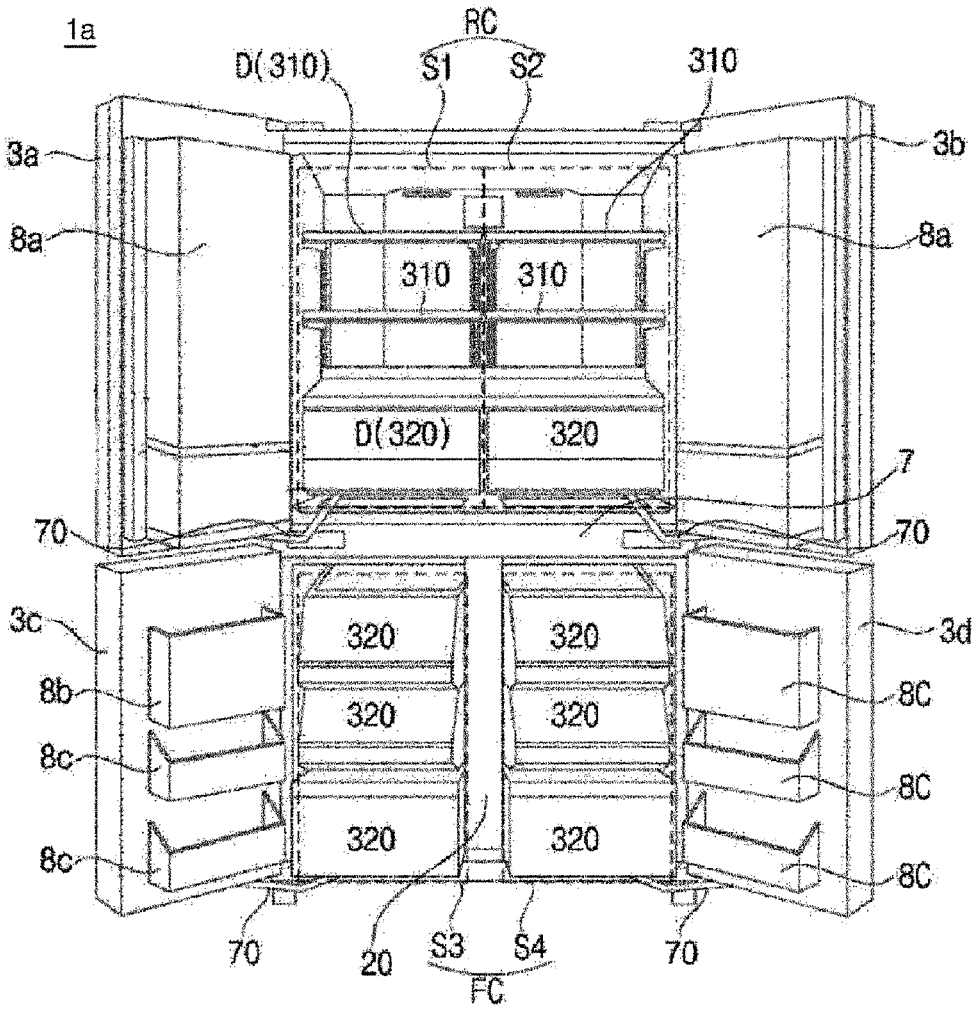

[Fig. 3]
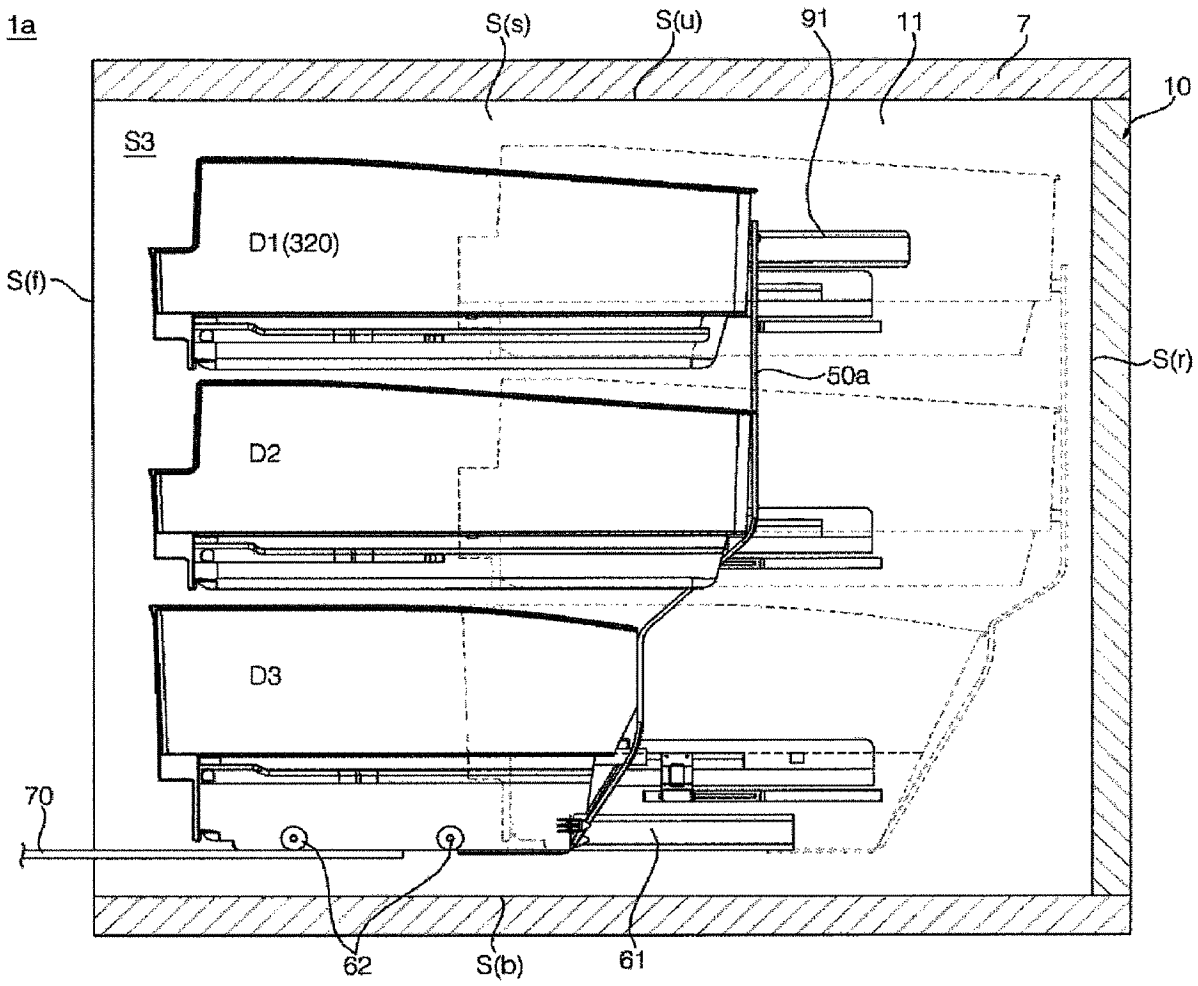

[Fig. 4]
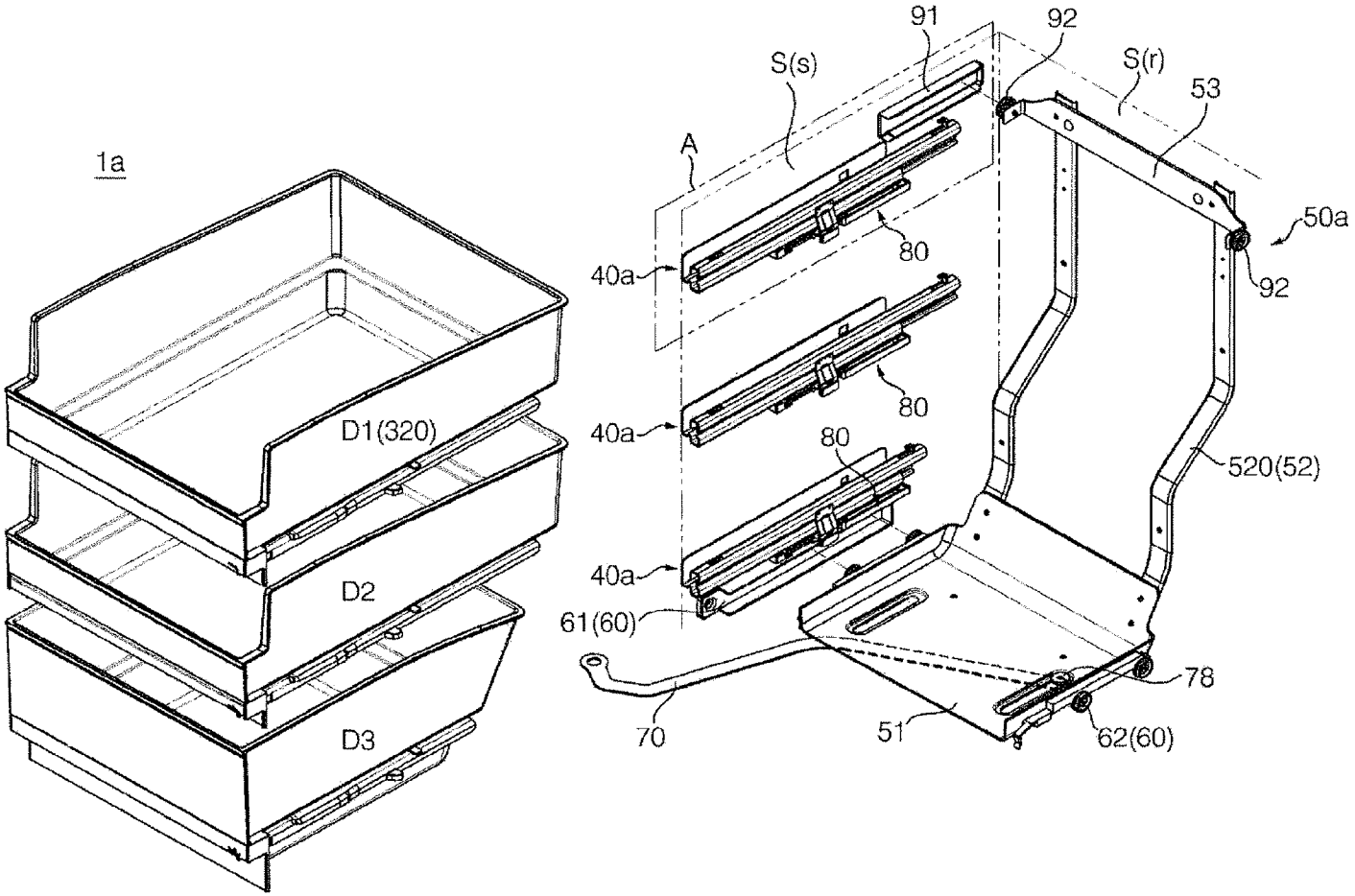

[Fig. 5]
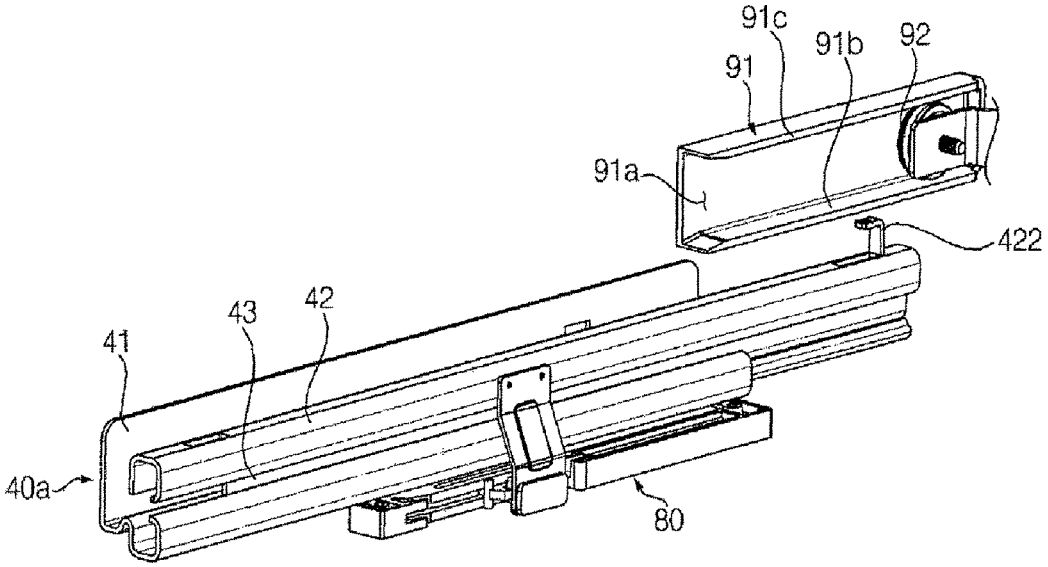
[Fig. 6]
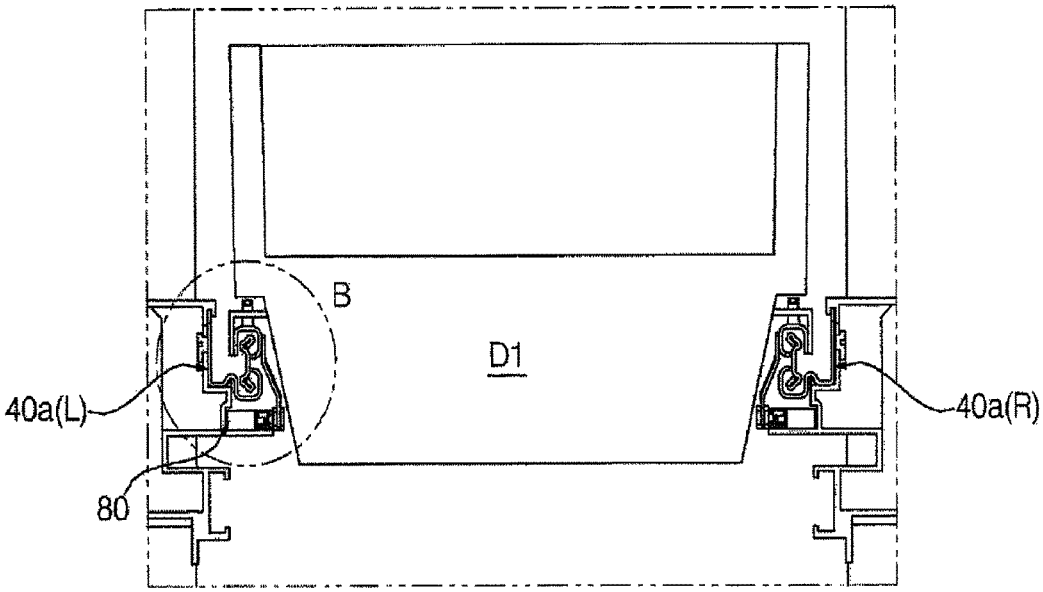

[Fig. 7]
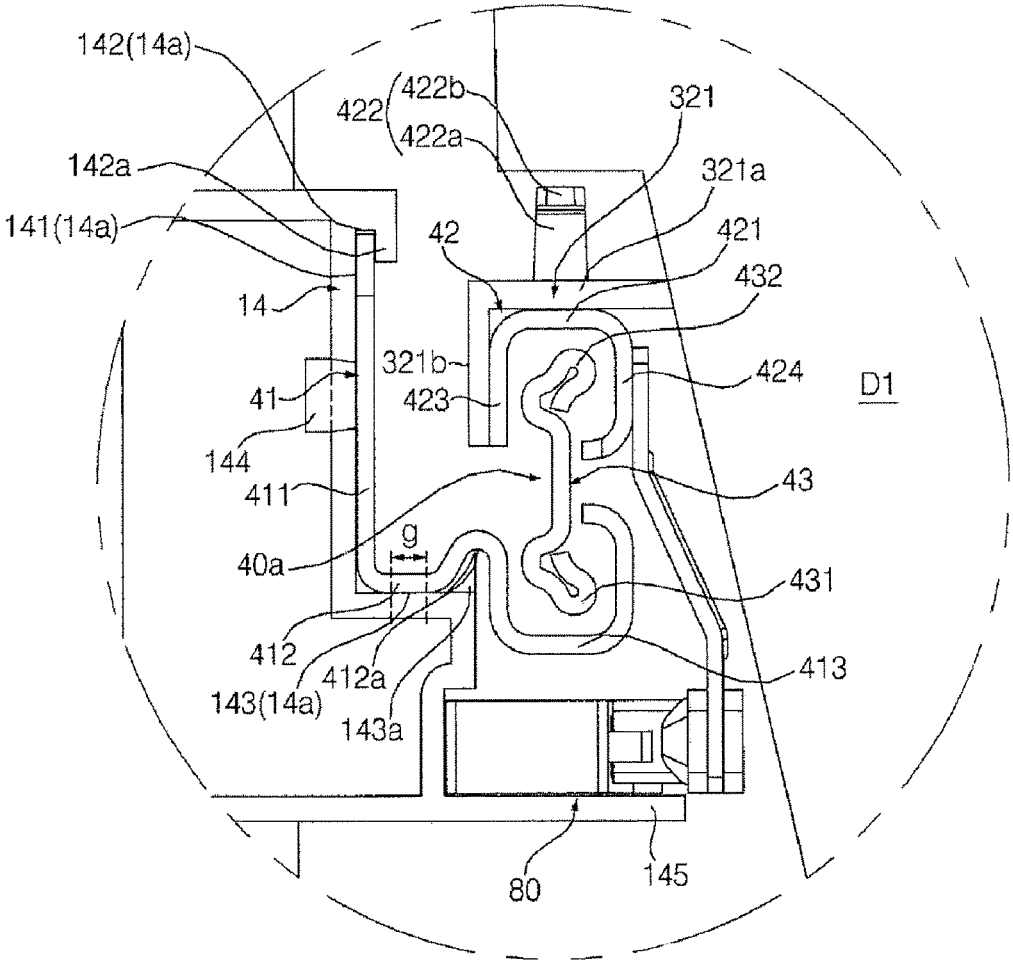

[Fig. 8]
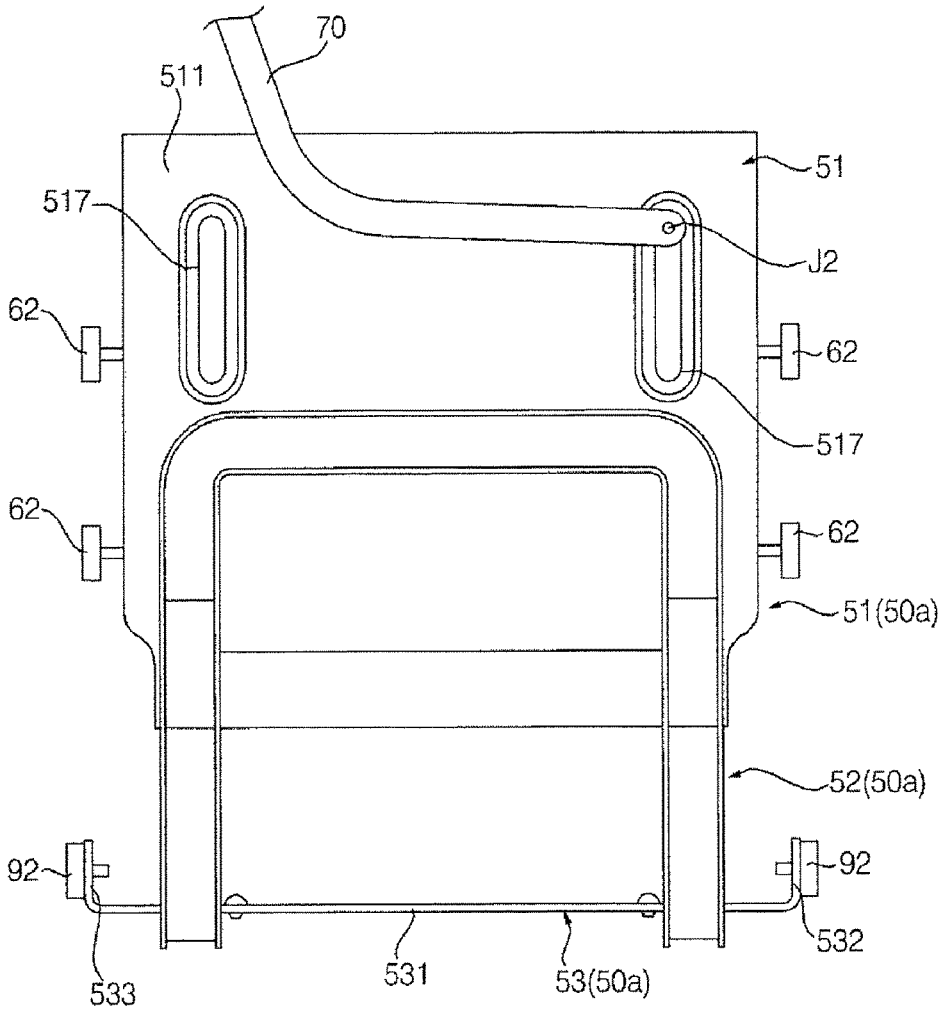

[Fig. 9a]
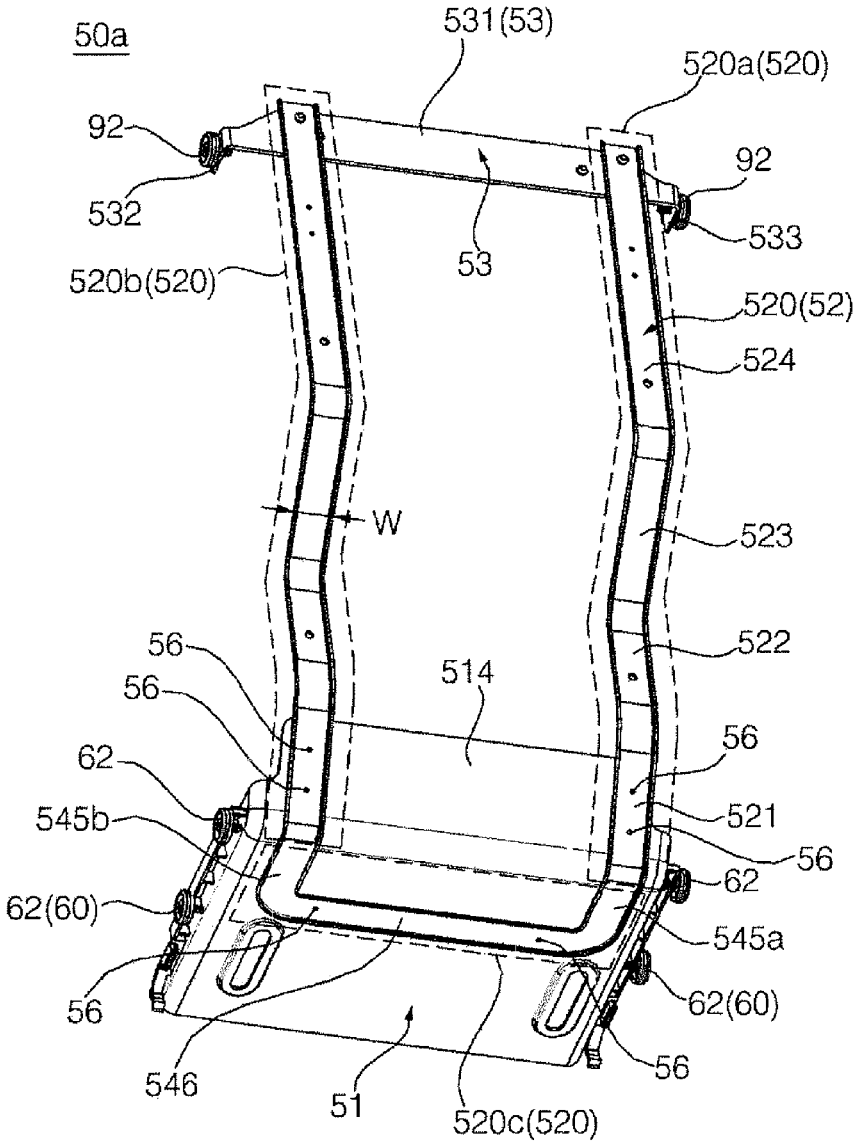

[Fig. 9b]
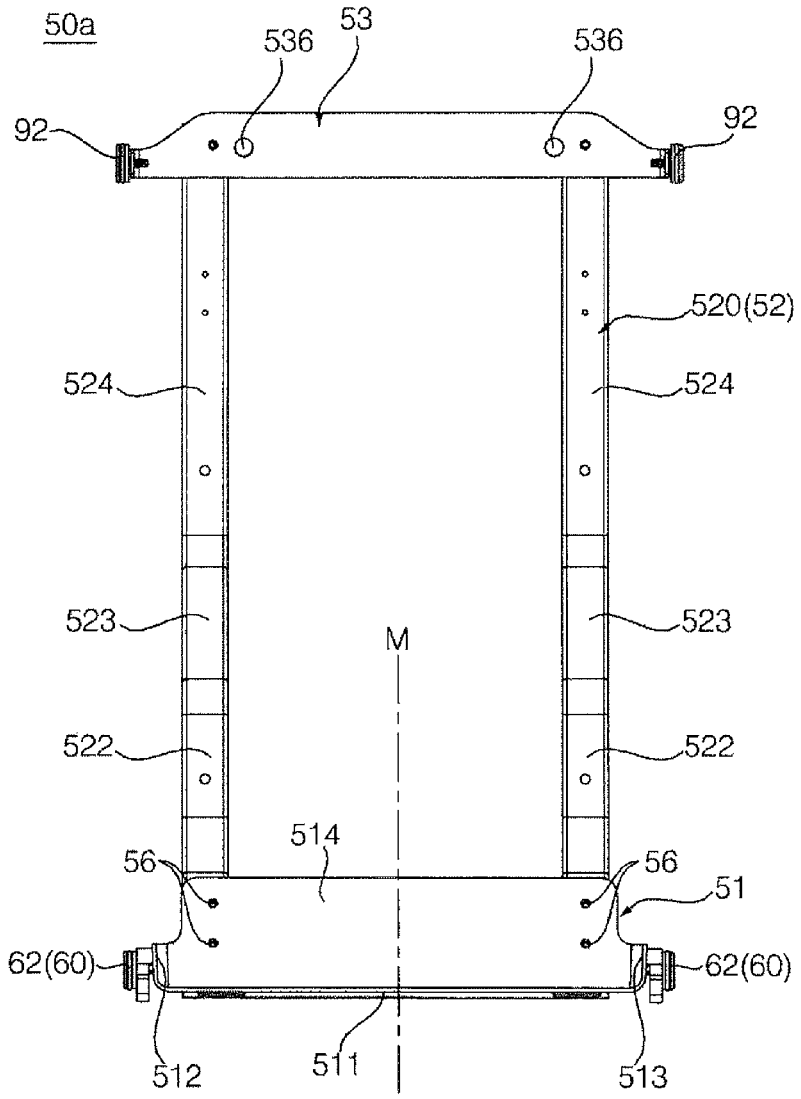

[Fig. 9c]
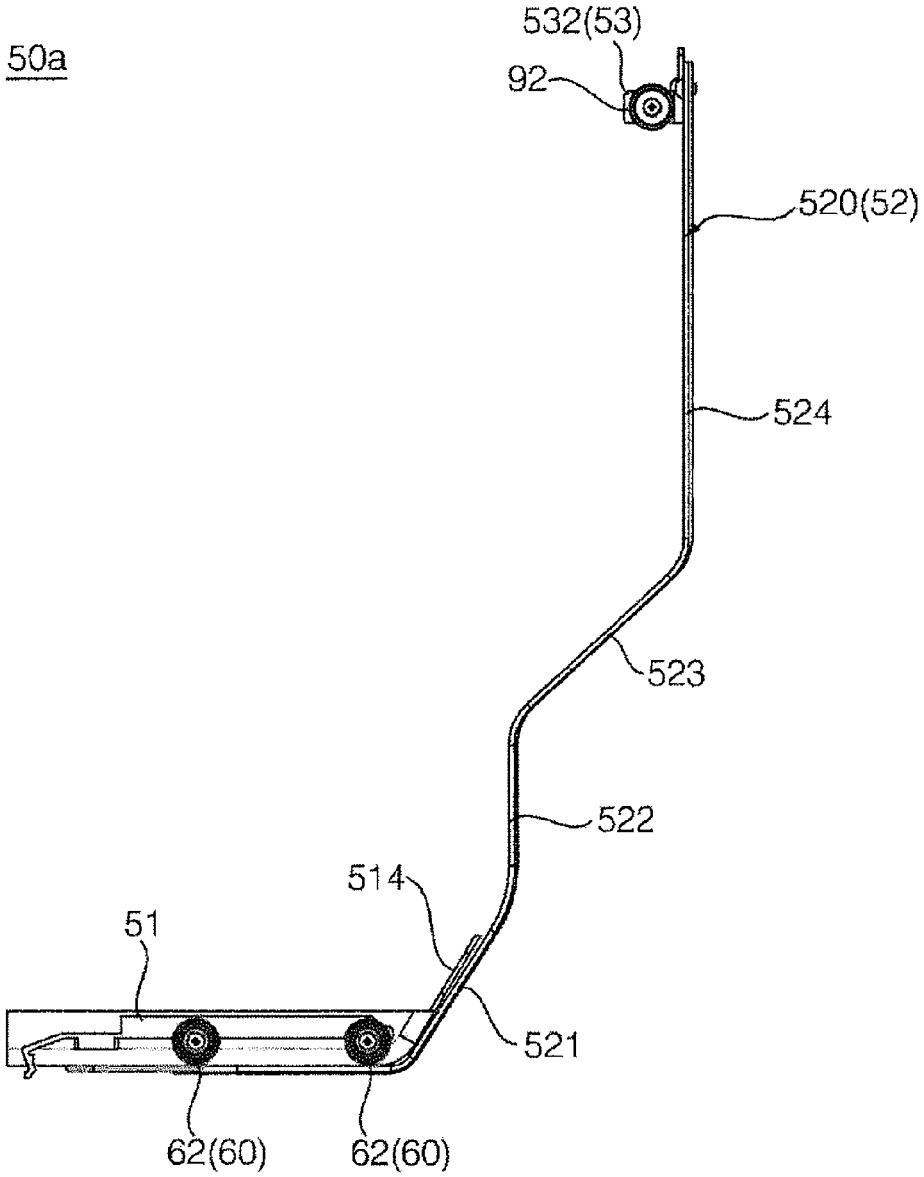

[Fig. 10a]
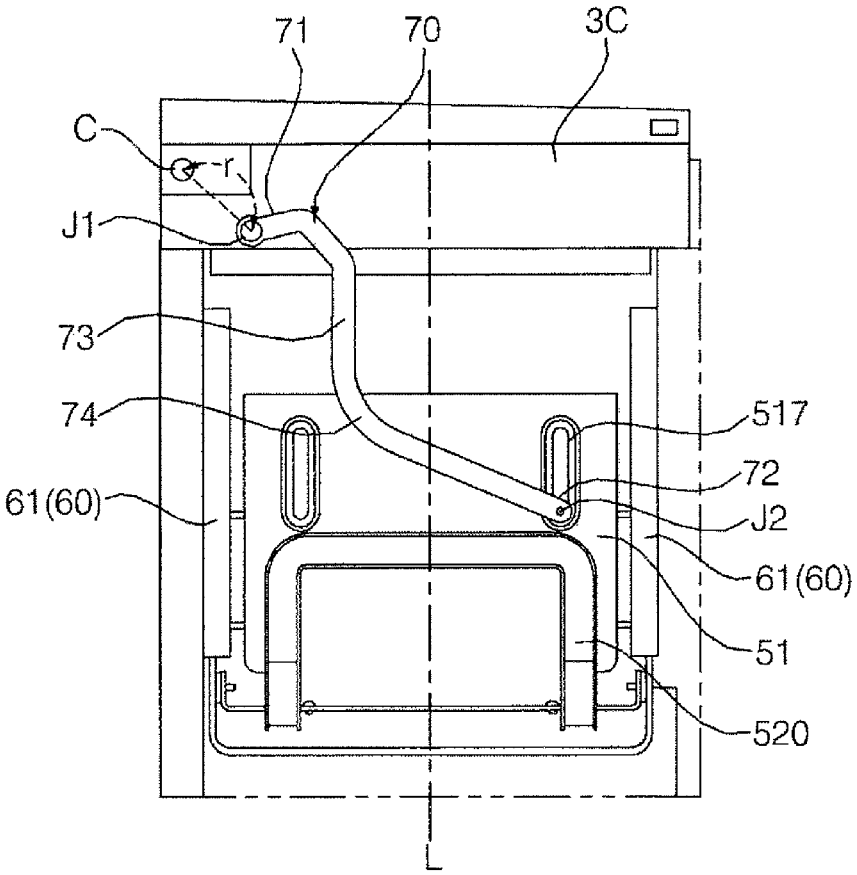

[Fig. 10b]
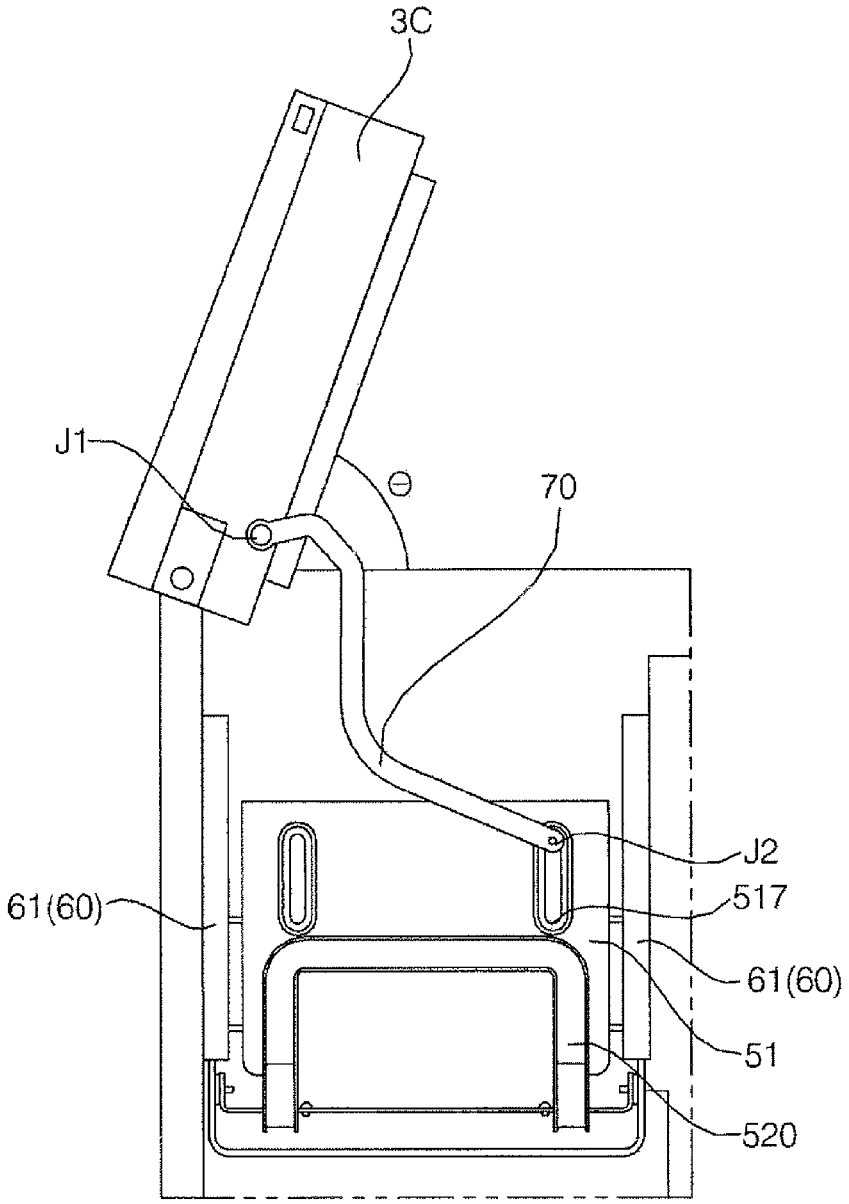

[Fig. 10c]
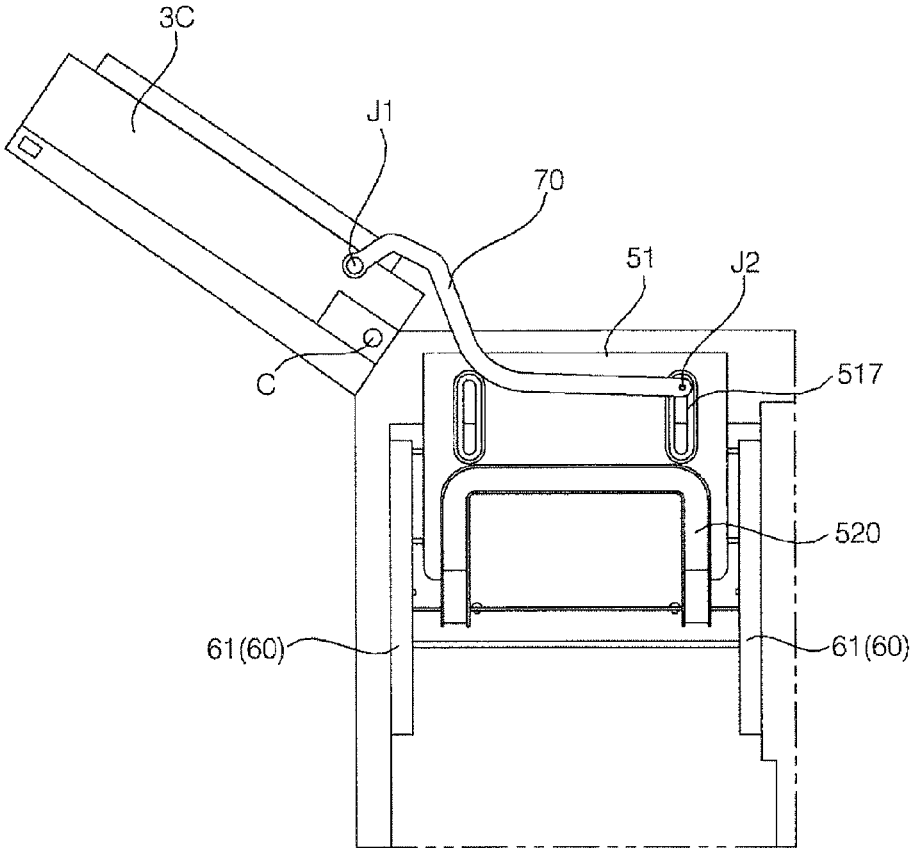

[Fig. 11]
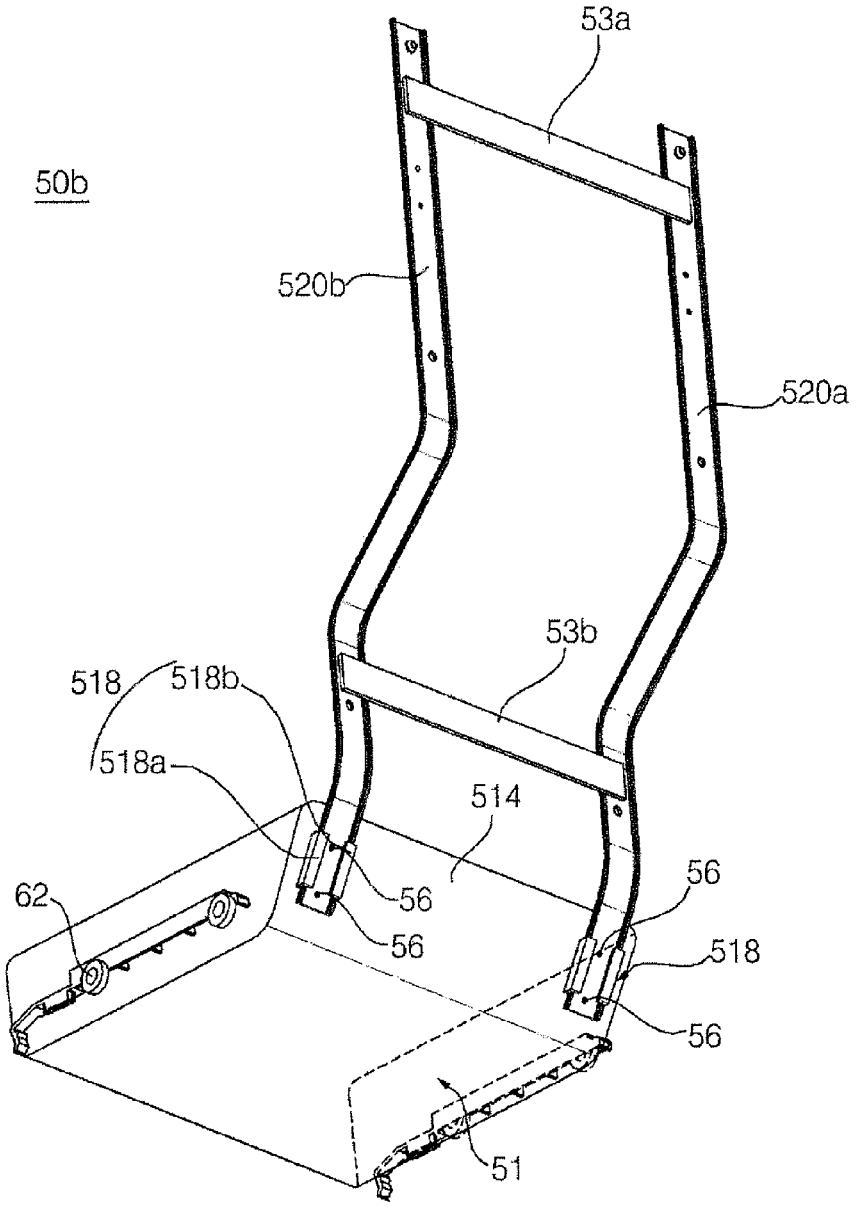

[Fig. 12]
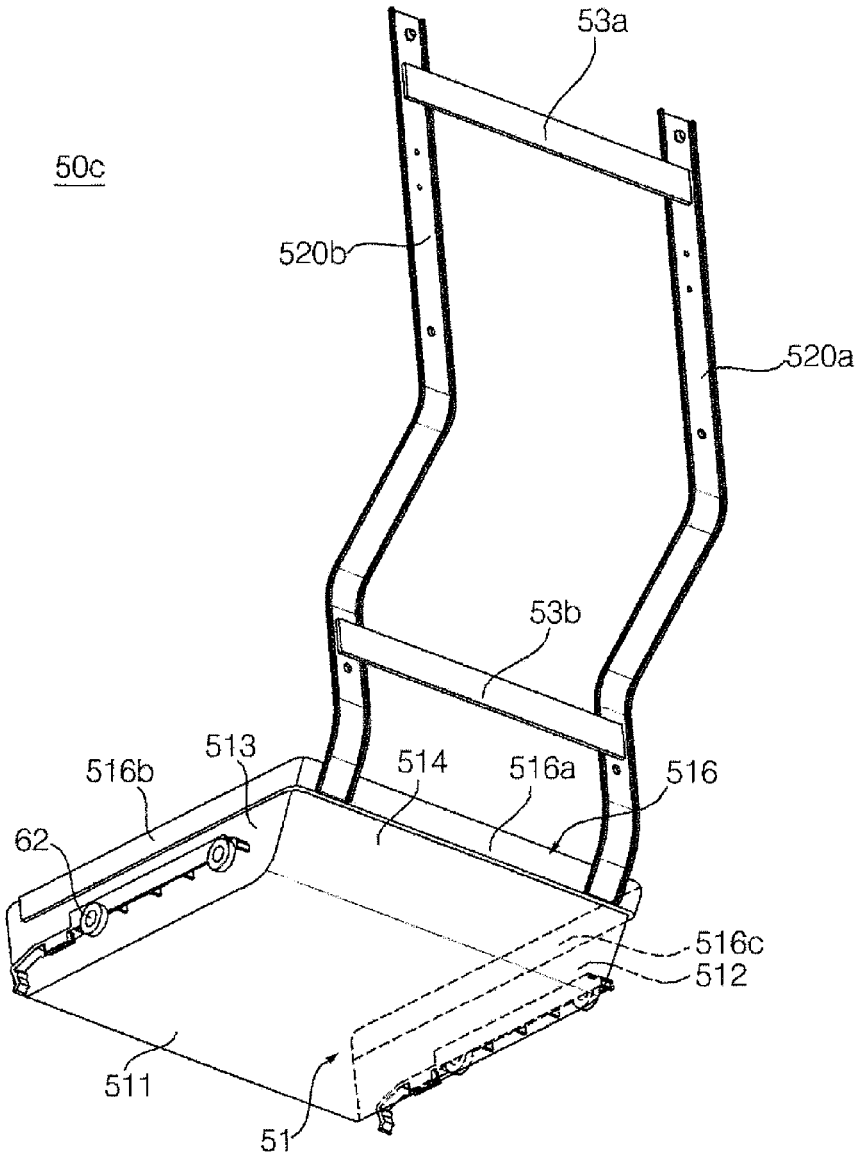

[Fig. 13]
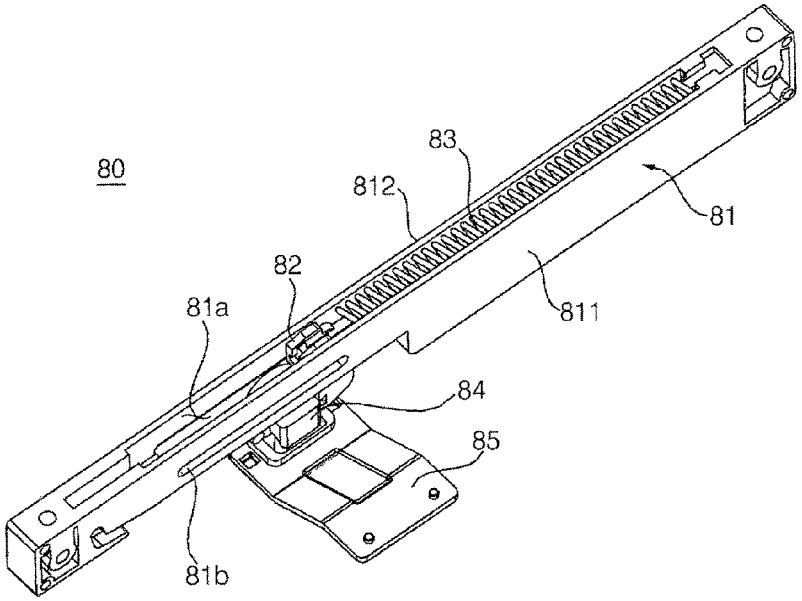
[Fig. 14a]
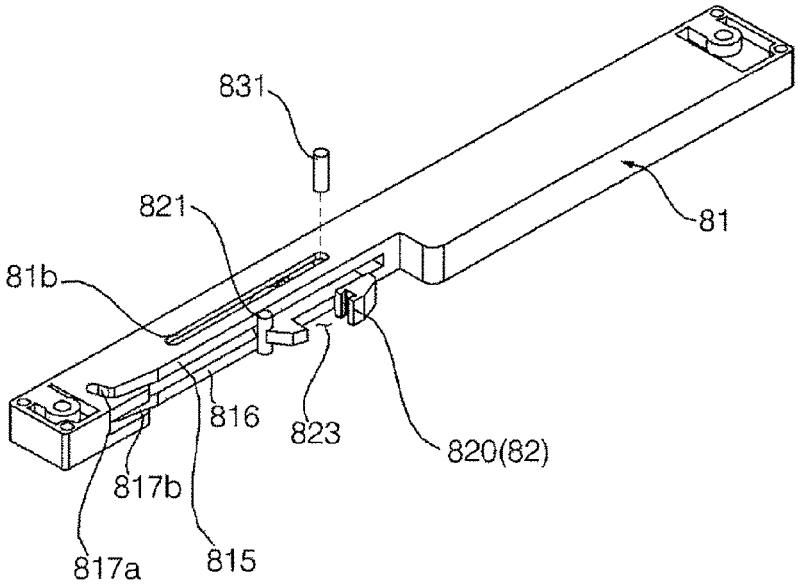

[Fig. 14b]
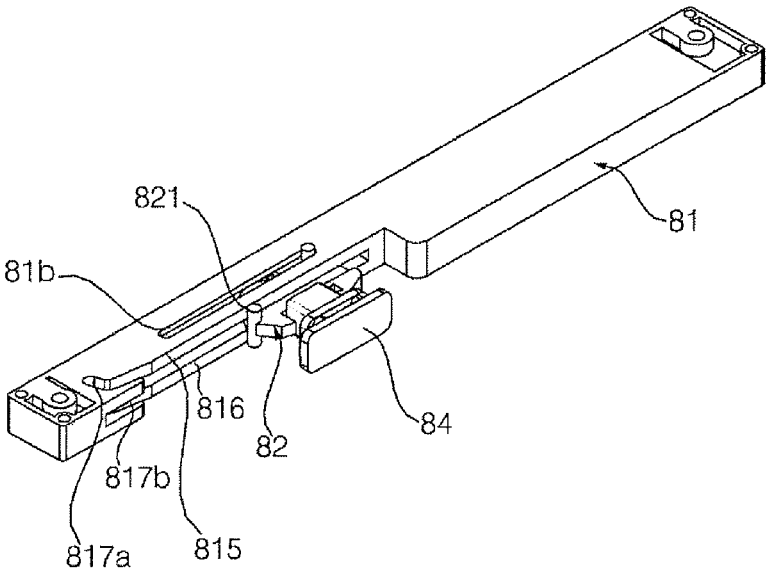
[Fig. 14c]
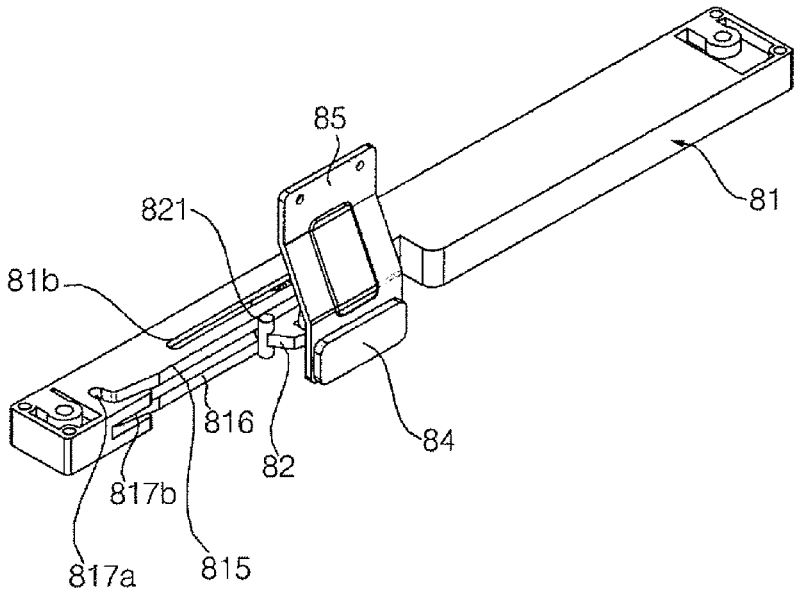

[Fig. 15]
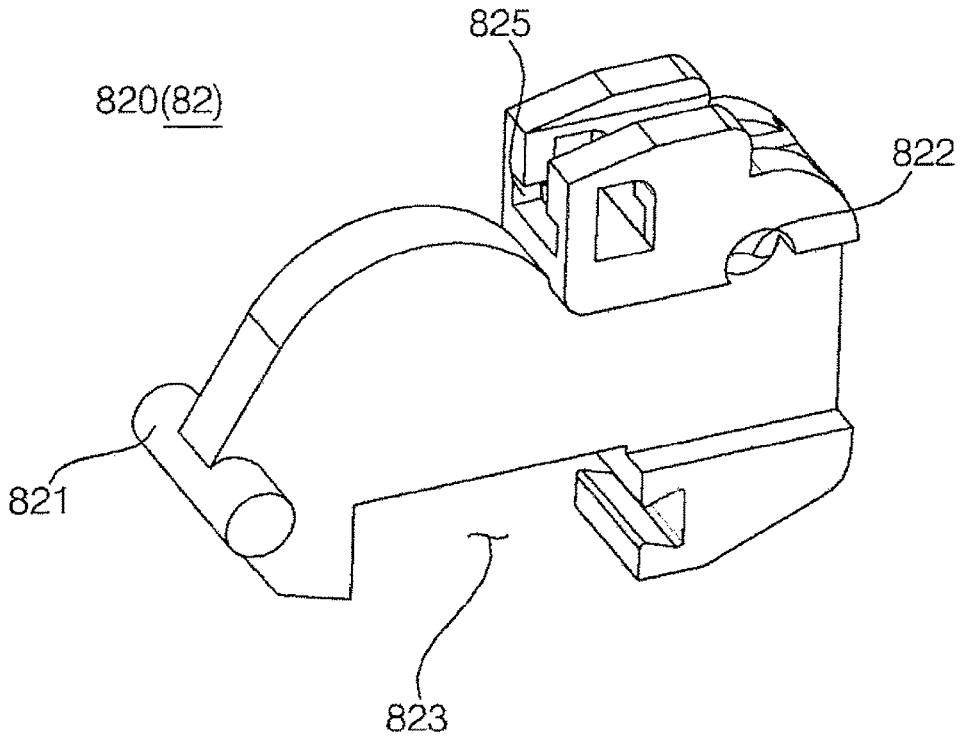
[Fig. 16]
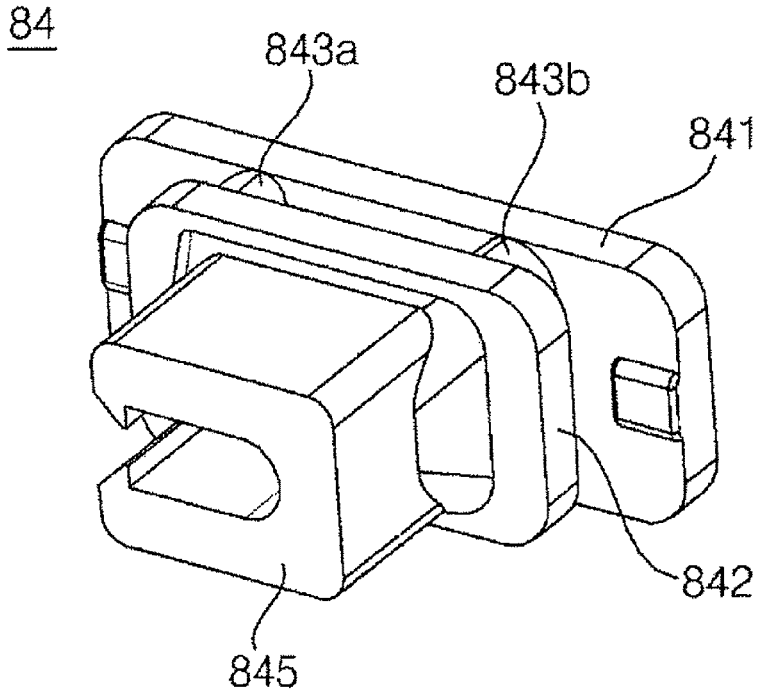

[Fig. 17]
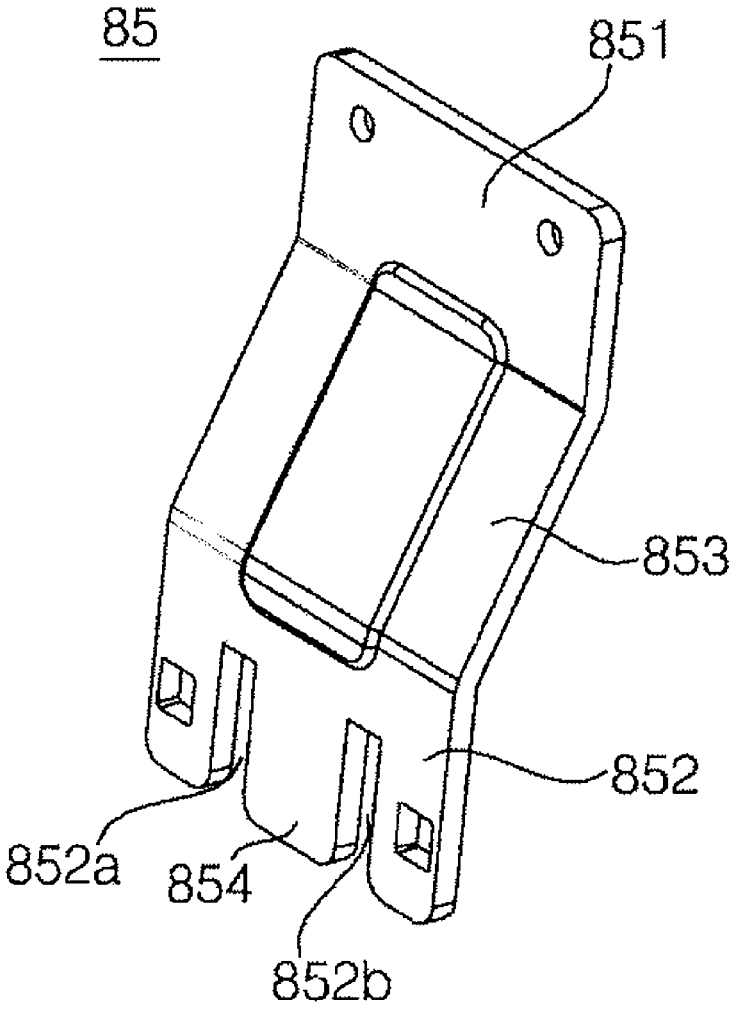

[Fig. 18]
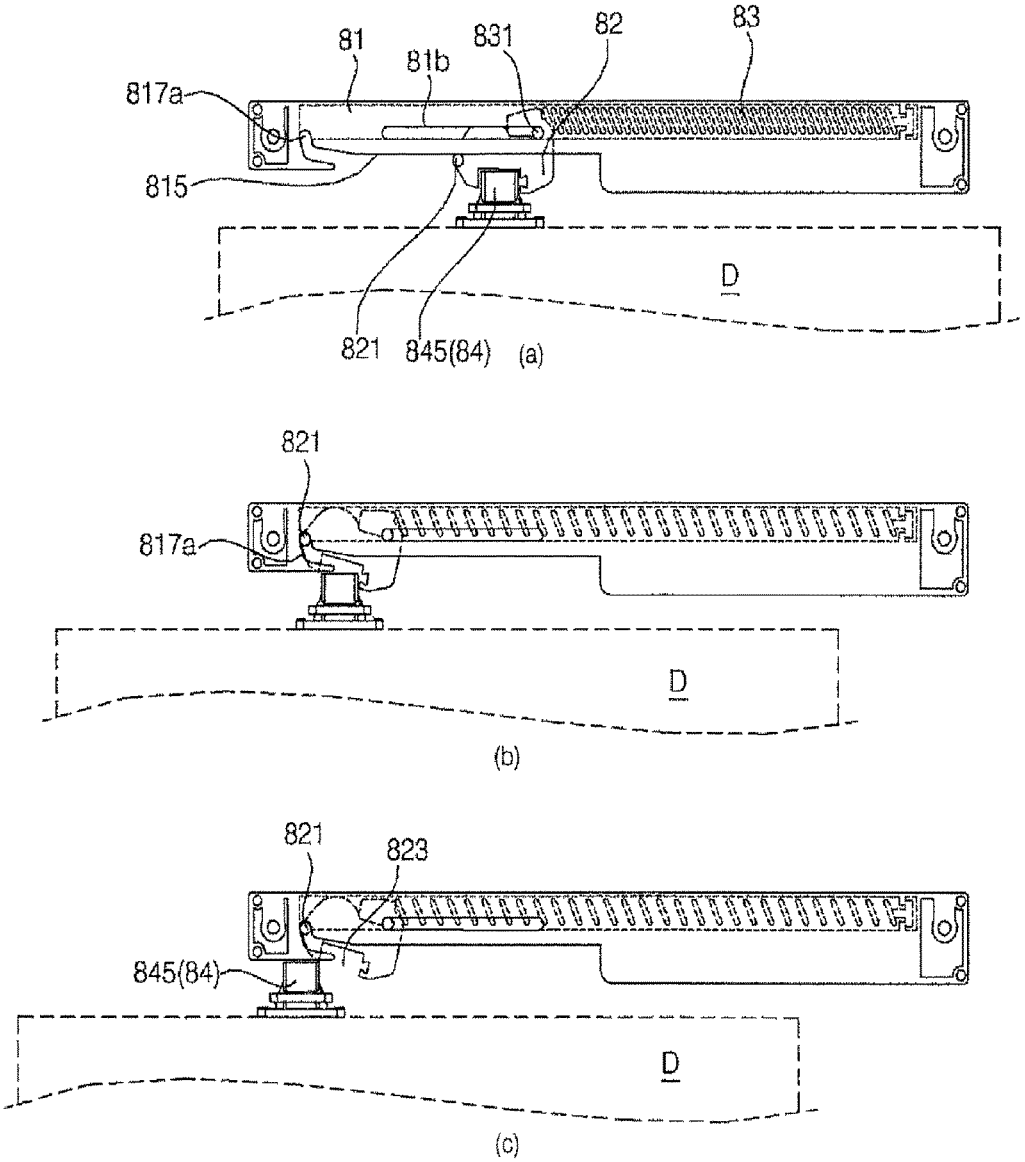

[Fig. 19]
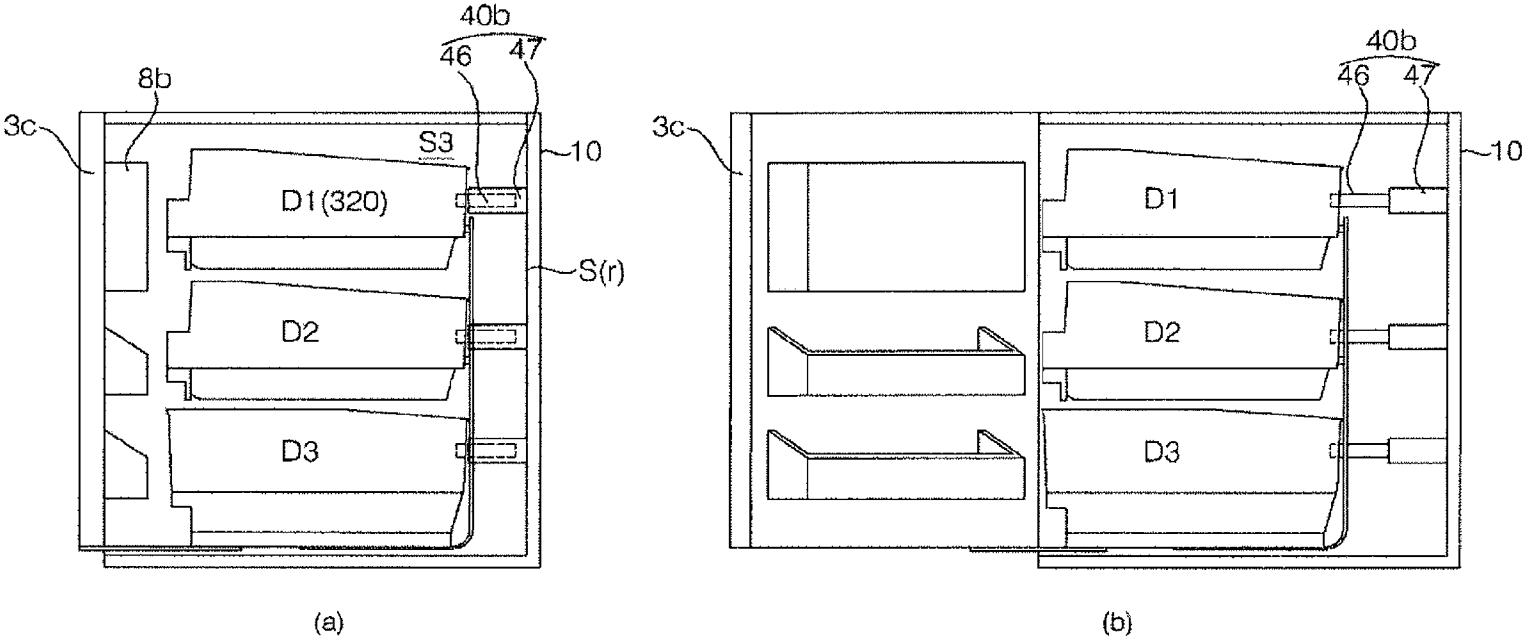

[Fig. 20]
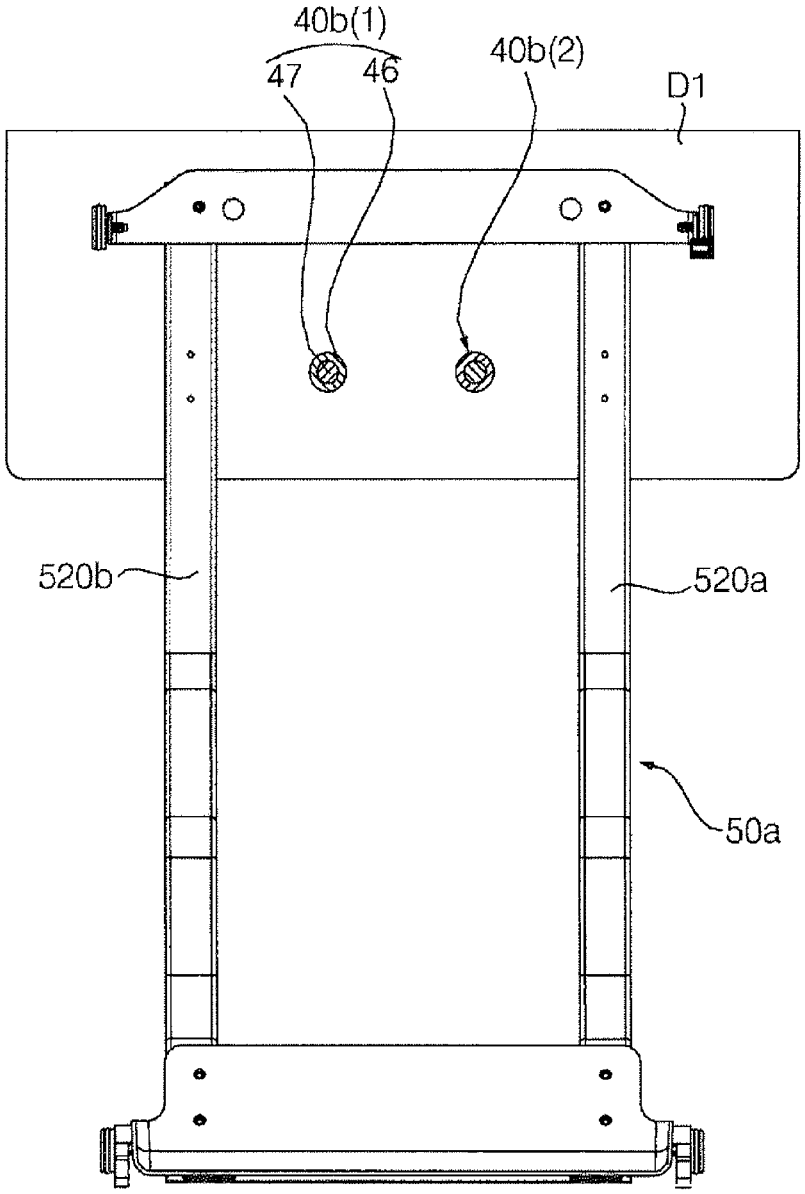

[Fig. 21]
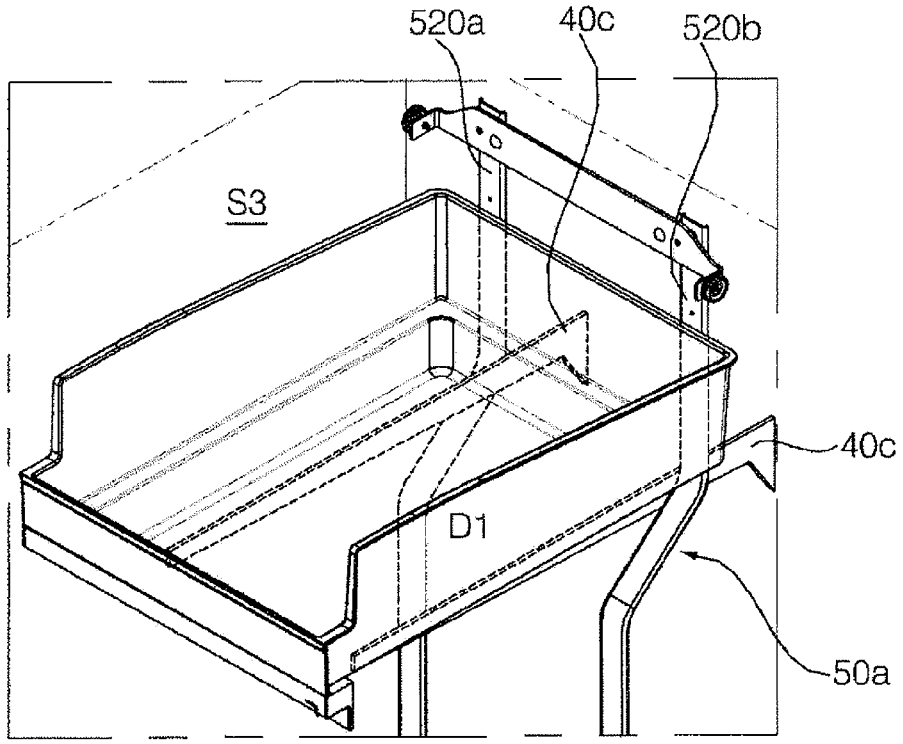

[Fig. 22]
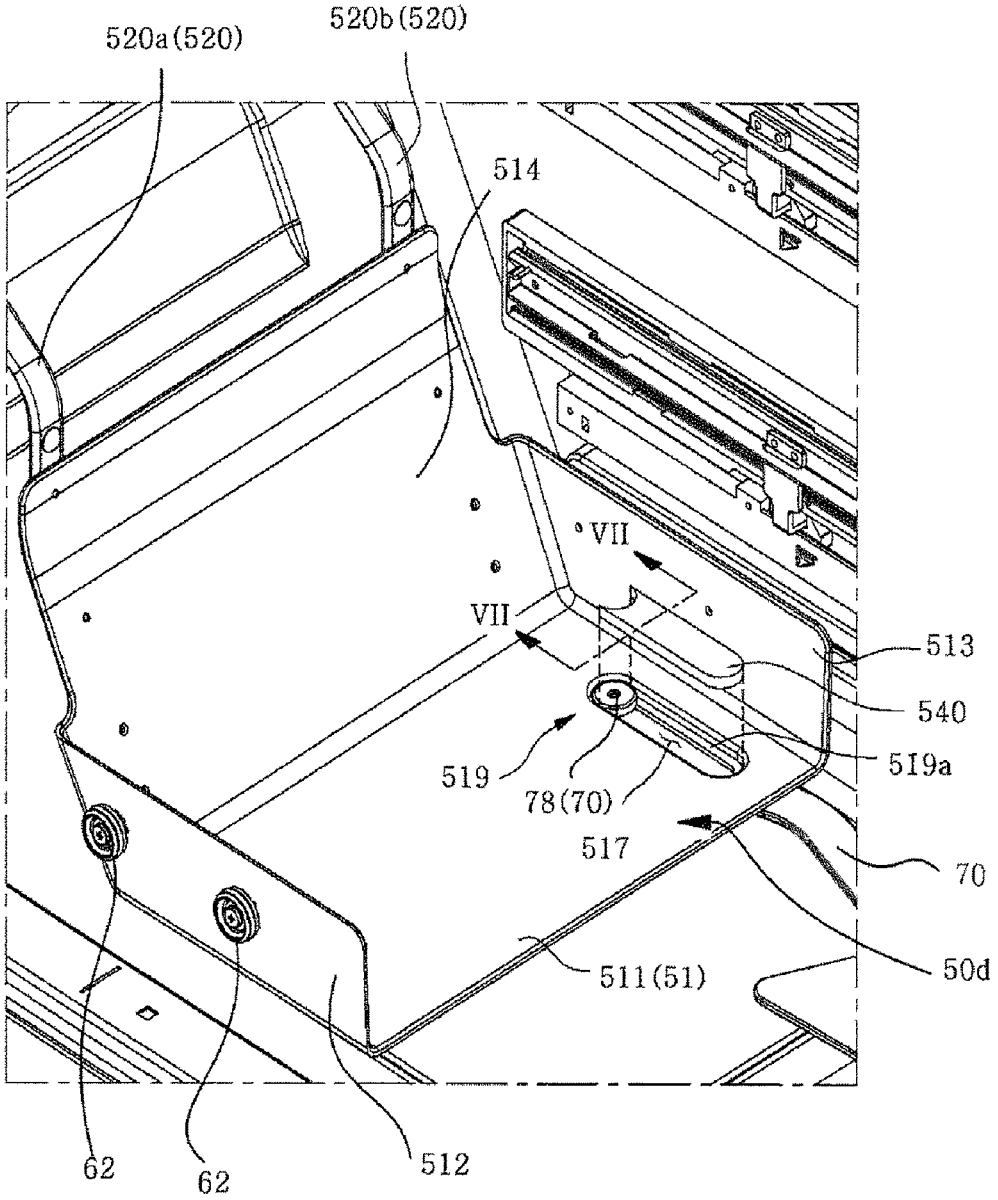

[Fig. 23]
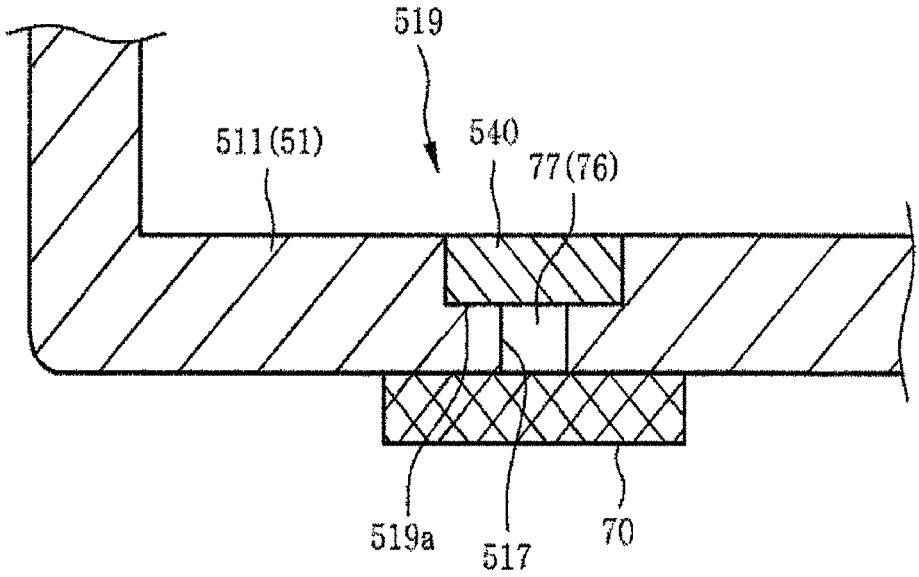
[Fig. 24]
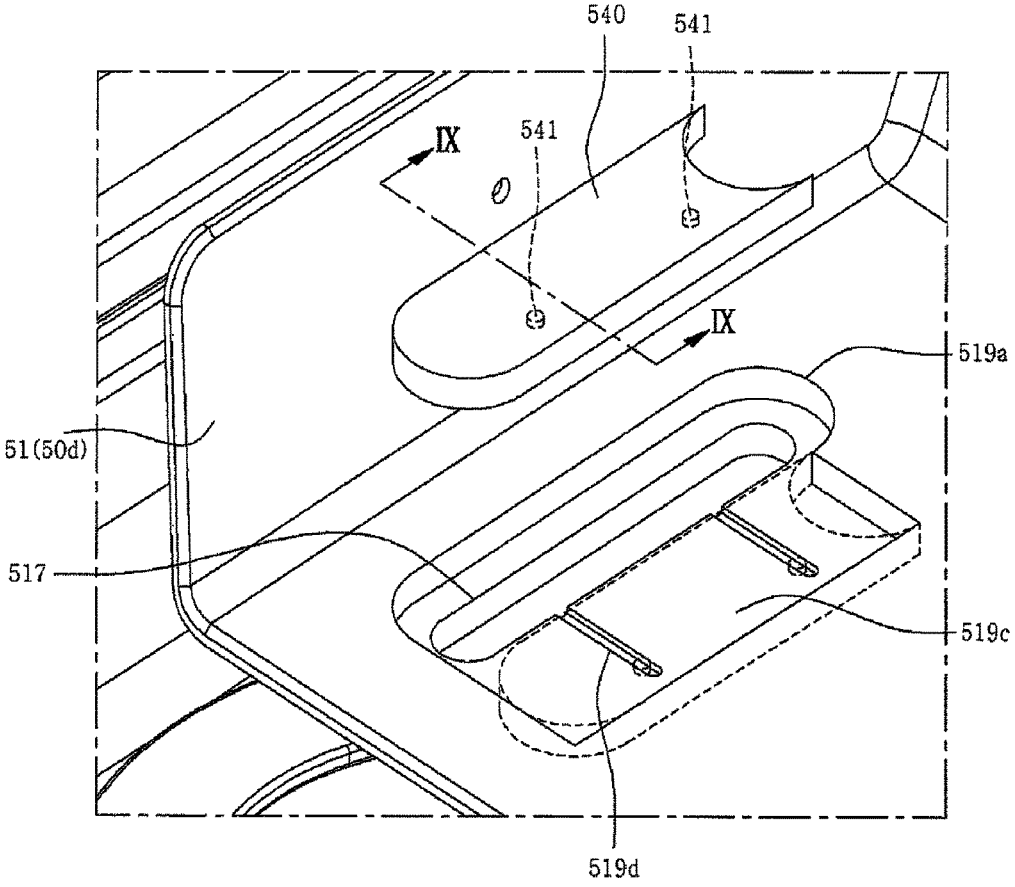

[Fig. 25]
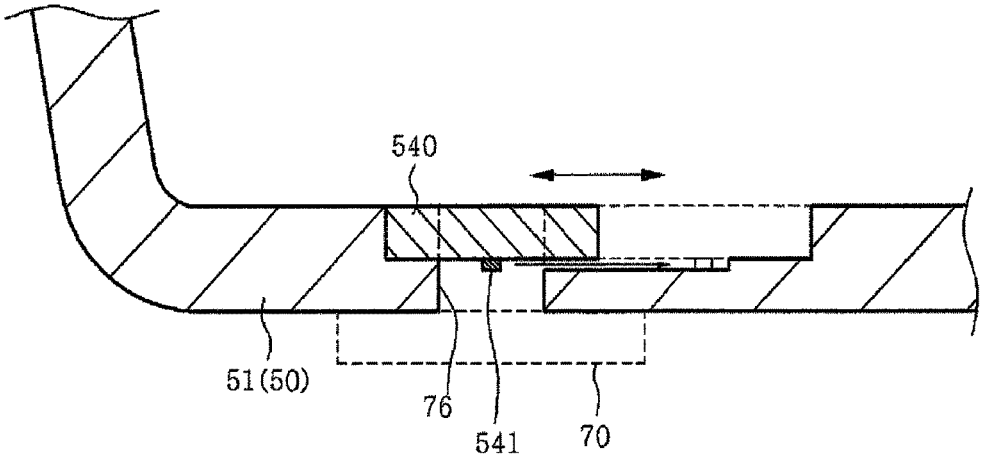
[Fig. 26]
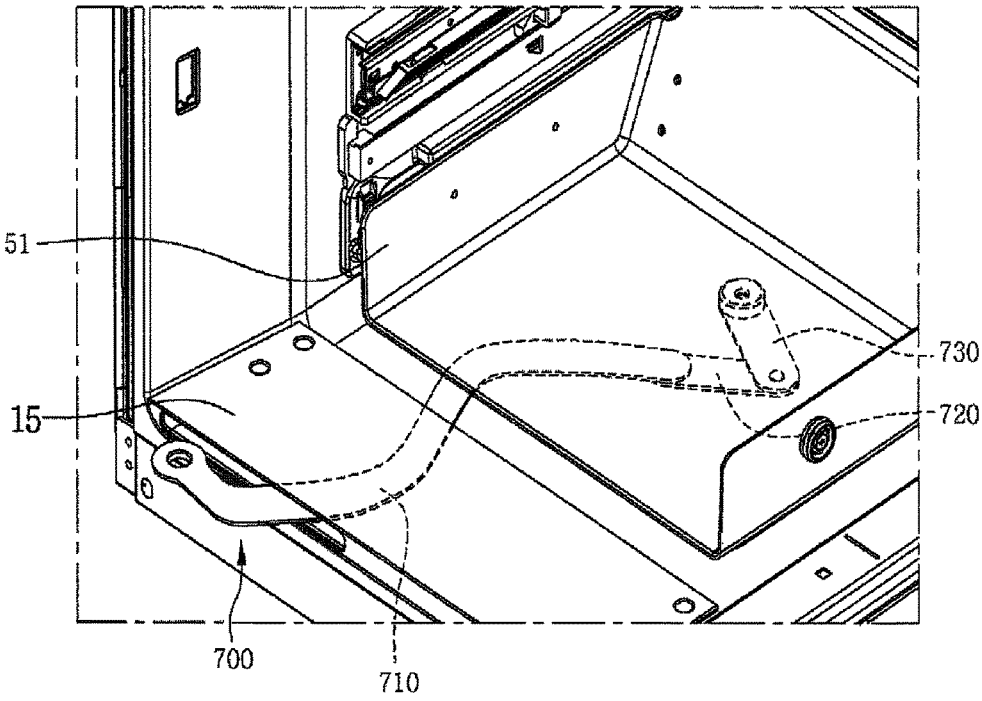

[Fig. 27]
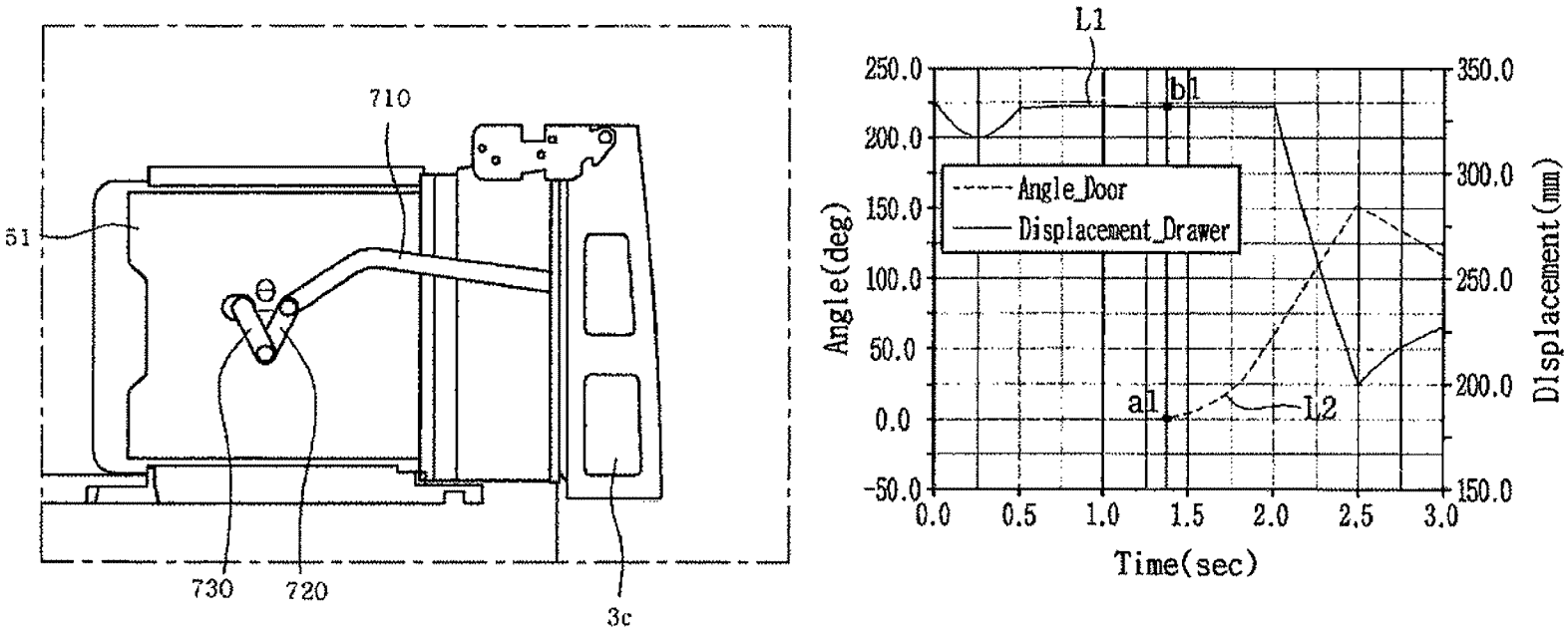

[Fig. 28]
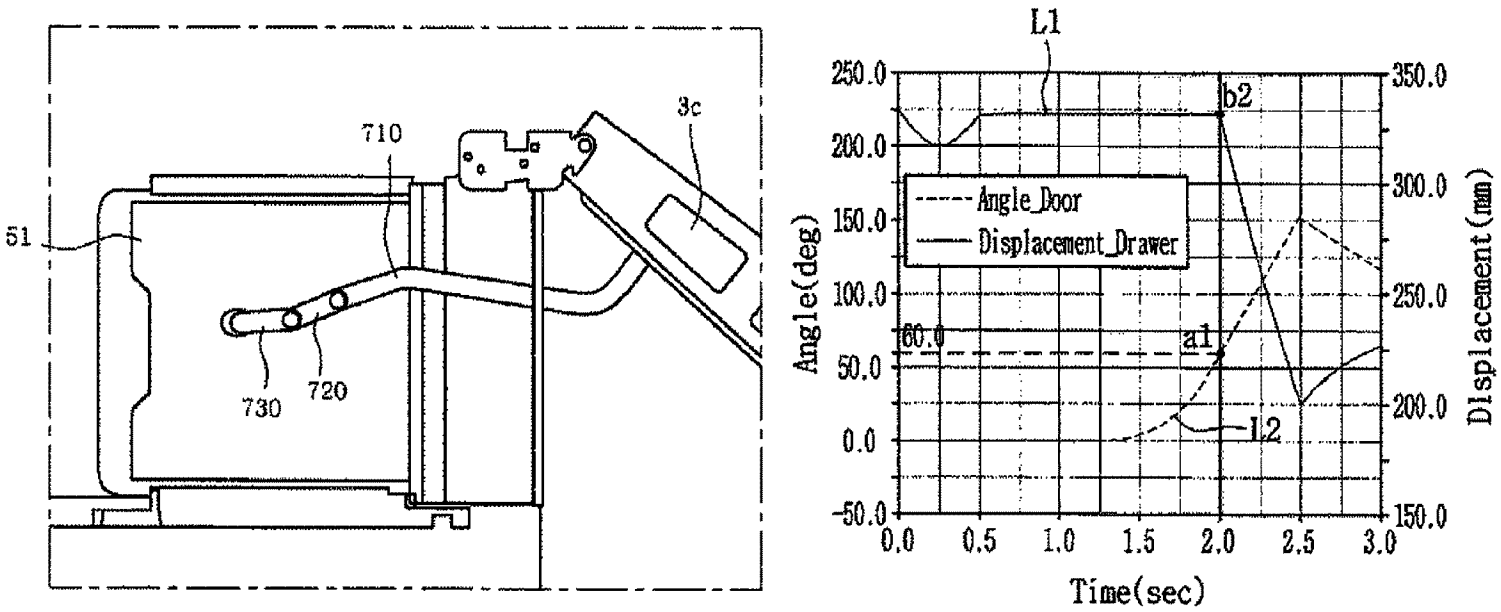

[Fig. 29]
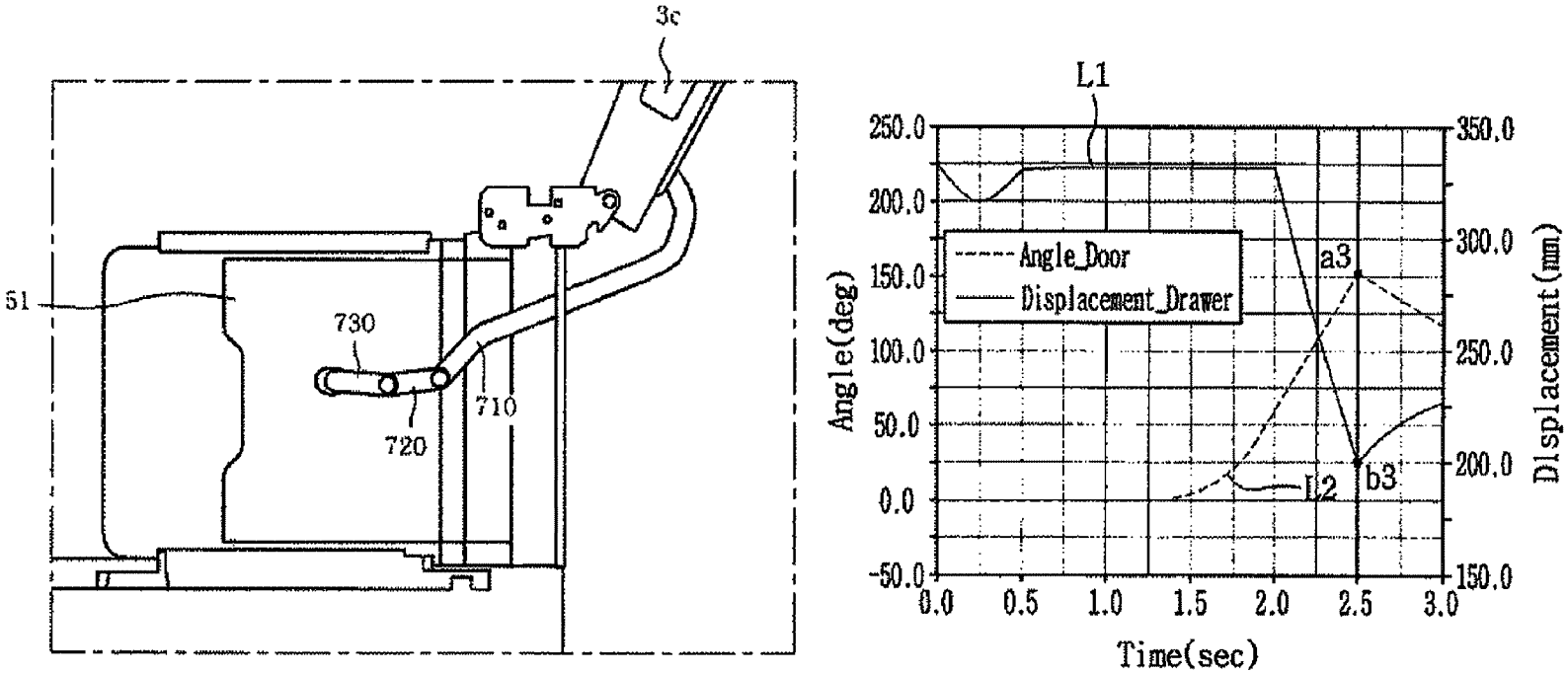

REFRIGERATOR

CROSS-REFERENCE TO RELATED APPLICATIONS

This application is a National Stage application under 35 U.S.C. § 371 of International Application No. PCT/KR2016/001446, filed Feb. 12, 2016, which claims the benefit of Korean Application No. 10-2016-0001267, filed on Jan. 5, 2016, Korean Application No. 10-2015-0022648, filed on Feb. 13, 2015, and Korean Application No. 10-2015-0022197, filed on Feb. 13, 2015. The disclosures of the prior applications are incorporated by reference in their entirety.

TECHNICAL FIELD

The present disclosure relates to a refrigerator.

BACKGROUND ART

Generally, refrigerators are home appliances configured to contain food and drink at lower temperatures inside storage spaces shielded by doors. A refrigerator is configured to contain stored foods and drinks in top shape by cooling the inside of a storage space by using cold air generated through heat exchange with a refrigerant circulating a refrigeration cycle. Recently, the refrigerator is increasing in size, and devices such as home bar, ice maker, shelf, or door box are being installed onto rear surface of the refrigerator door. In this case, when a refrigerator door is closed, shelves or drawers mounted in the storage compartment of the refrigerator body and components mounted on the rear surface of the refrigerator door may interfere with each other.

In order to overcome this interference limitation, the front end portions of the drawers (e.g., shelves or drawers) mounted in the storage compartment (e.g., refrigerating compartment or freezing compartment) are disposed at points away from the front surface of the refrigerator body by a certain distance.

Accordingly, there is inconvenience in that a user needs to dip into the storage compartment to withdraw food and drink stored in the drawer, and it is difficult for a user to check foods stored at the rear side of the storage compartment. These limitations are further intensified as the storage compartment deepens in accordance with the trend of enlargement of the refrigerator.

Various methods have been proposed to improve these limitations. For example, Korean Patent Application Publication No. 2010-0130357 (hereinafter, referred to as Patent 357) discloses a structure in which a shelf or a drawer installed in a refrigerating compartment or a freezing compartment is placed on a storage frame. Here, the front end portion of a multi-joint link is connected to the bottom surface of the refrigerator door, and the rear end portion thereof is connected to the storage frame. Accordingly, when the refrigerator door is rotated and opened, the storage frame moves forward, and the shelf and the drawer move to the front side of the refrigerator.

In this case, the loads of the shelf and the drawer are all delivered to the storage frame. In other words, loads of the shelf and the drawer and loads of foods stored therein are all concentrated on the storage frame. Accordingly, it is important to design the structure of the storage frame so as to sufficiently bear the loads, and thus the structure of the storage frame becomes complicated, and the volume there of increases. Accordingly, the weight of the storage frame itself becomes heavier, and the space occupied by the storage frame increases, thereby causing a reduction of the capacity of storage compartment.

Also in case of Patent 357, since the link moving the storage frame in linkage with the door is connected to the bottom surface of the storage frame, the point of application of a force applied through the link is located on the bottom surface of the door, but the center of gravity of the drawer is concentrated on a side higher than the bottom surface of the storage frame. Thus, the line of action of a force by the link and the line of action of an inertial force by the drawer do not exist on the same line, causing a bending moment or a shearing force to act on the storage frame and thus causing a deformation, which is intensified as the weight of stored foods in the drawer increases. Particularly, in case of Patent 357, since the load of the drawer is supported by the storage frame, the load of drawer becomes a cause that further promotes the deformation of the storage frame in addition to the inertia of the drawer.

Also, in case of Patent 357, for smooth withdrawal of the storage frame, the rail that supports the storage frame needs to be maintained so as to operate normally. In this case, there are many practical limitations in designing the rail that can sufficiently bear the load acting from the storage frame in a determined standard.

Also, in a structure in which all loads applied from the storage frame are concentrated on the rail, the storage frame may easily wobble during the movement. When this wobbling lasts and thus the rail or the storage frame is deformed, the movement operation of the storage frame cannot be stably performed.

Japanese Patent Application Publication No. JP2004-93039A (hereinafter, referred to as Patent 039) discloses a refrigerator in which a shelf disposed in a storage compartment is connected to a door by an arm and the shelf is withdrawn by the arm when the door is opened. Particularly, the arm is directly connected to the shelf. Accordingly, in order to together withdraw a plurality of shelves in linkage with the door, the arms are also provided in plurality, and the respective arms are connected to shelves.

Also, since the arm needs to be installed to correspond to the height of the shelf, the installation location of the arm is limited. Particularly, most part of the arm connected to the shelf located in the middle of the storage compartment is inevitably exposed to a user.

Also, in Patent 357 and Patent 039, the structure of the storage frame is exposed in the storage compartment as it is. Thus, the exterior is not good, and the storage space decreases by a space occupied by the storage frame. In addition, the circulation of chilly air in the storage compartment is interrupted by the storage frame.

Also, although a user does not desire a function of automatically withdrawing the drawer, he/she cannot select whether or not to use the automatic withdrawal function.

In addition, a typical refrigerator is provided with a gasket disposed on the rear surface of the door to maintain airtightness of the storage compartment. When the door is closed, the gasket adheres closely to the cabinet. In a typical refrigerator, the storage frame (or drawer) is withdrawn simultaneously with opening of the door. Accordingly, when a user opens the door that is closed, a force for separating the gasket from the cabinet and a force for withdrawing the storage frame are simultaneously needed, making it difficult to open the door.

DISCLOSURE OF INVENTION

Technical Problem

It is an object of the subject matter described in this application to provide a refrigerator which is provided with a withdrawal unit automatically withdraw (move a drawer forward) a drawer in linkage with a door, and a drawer guide taking full charge of supporting the load of the drawer, where the withdrawal unit does not receive the load of the drawer supported by the drawer guide and serves only to move the drawer. Particularly, although a plurality of drawers are disposed in a storage compartment, the loads of the plurality of drawers are independently supported by the drawer guide provided for each drawer. Also, the withdrawal unit withdraws the plurality of drawers together, and is configured to be an independent non-load bearing element when supporting the load of the drawer.

It is another object of the subject matter described in this application to provide a refrigerator which includes a rear frame disposed at the rear side of the drawer and allows the rear frame to push the drawer in a forward direction when the door is opened.

It is another object of the subject matter described in this application to provide a refrigerator in which the rear frame is formed into a frame structure including bars.

It is another object of the subject matter described in this application to provide a refrigerator in which the withdrawal unit includes a base part disposed under the drawer and applied with a tractive force (e.g., force pulling in a forward direction) and a rear frame upwardly extending from the base part and pushing the drawer in a forward direction at a rear side of the drawer when the base part moves in a forward direction, where the rear frame withstands a reaction force acting from the drawer and is not easily deflected or bent in a backward direction.

It is another object of the subject matter described in this application to provide a refrigerator in which the drawer can automatically return to the original location when the door is closed. The refrigerator may include a return unit for returning the drawer in a backward direction even though the withdrawal unit and the drawer are physically separated from each other.

Solution to Problem

According to an innovative aspect of the subject matter described in this application, a refrigerator may include a withdrawal unit that withdraws a drawer disposed in a storage compartment in a forward direction while moving forward when a door is opened. The withdrawal unit may be configured to include a base part interlocking with the door, and a rear frame upwardly extending from the base part and having at least a portion thereof disposed at the rear side of the drawer. The base part may be connected to the door by a link, or may be moved by power provided from a drive unit such as a motor or an actuator that is electrically driven in accordance with the opening/closing operations of the door. In this case, the rear frame may withdraw the drawer while moving integrally with the base part.

The drawer may be supported and moved by a drawer guide disposed in the storage compartment. Since the load of the drawer is supported by the drawer guide, the withdrawal unit may not serve to bear the load of the drawer, and may serve only to move the drawer. That is, since the unit (i.e., drawer guide) that supports the drawer and the unit (i.e., withdrawal unit) that withdraws the drawer are separate from each other, the withdrawal unit may substantially bear only its own load.

According to an innovative aspect of the subject matter described in this application, a refrigerator includes a cabinet that includes a storage compartment that has an opening at a front of the storage compartment; a door that is configured to open and close at least a portion of the storage compartment; a drawer that is located in the storage compartment; a drawer guide that is configured to support the drawer and that is configured to guide the drawer based on the drawer moving forward and backward; and a withdrawal unit that is configured to push the drawer forward based on the door opening, where the withdrawal unit includes a base part that is located under the drawer, that is configured to move forward based on the door opening, and that is configured to move backward based on the door closing; and a rear frame that extends from the base part to a rear side of the drawer and that is configured to push the drawer forward based on the base part moving forward.

The refrigerator may include one or more of the following optional features. The rear frame includes a pair of vertical bars that extend up from the base part, that are located at the rear side of the drawer, and that are spaced from each other in a horizontal direction. The refrigerator further includes a link that has a front end portion that is pivotably connected to the door, that has a rear end portion that is pivotably connected to the base part, and that is configured to move the base part based on opening and closing the door, where the base part includes a bottom portion that is pivotably connected to the rear end portion of the link; and a rear surface portion that extends up from a rear end of the bottom portion, and where the pair of vertical bars each have lower end portions that are coupled to the rear surface portion. The rear end portion of the link is connected to an undersurface of the bottom portion. Each of the pair of vertical bars includes a portion of a frame member that is in a beam shape and that is longer than it is wide.

The frame member includes a connection section that connects the pair of vertical bars and that is coupled to an undersurface of the bottom portion. The rear surface portion inclines upward from the bottom portion toward a rear side of the refrigerator. The vertical bar includes a first inclination section that defines an incline corresponding to the rear surface portion. The first inclination section and the rear surface portion are coupled together. The vertical bar further includes a first vertical section that extends vertically from the first inclination section to an upper side of the refrigerator. The refrigerator further includes one or more drawers that are located above the drawer, where the first vertical section extends vertically to at least a height corresponding to a bottom of a lowest drawer of the one or more drawers that are located above the drawer. The vertical bar further includes a second inclination section that inclines upward from the first vertical section toward a rear side of the refrigerator; and a second vertical section that extends vertically from the second inclination section to the upper side of the refrigerator, where the second vertical section extends vertically to a second drawer of the one or more drawers and the drawer that is above the lowest drawer. The withdrawal unit further includes a connection bar that connects the pair of vertical bars and that is located above the base part.

The withdrawal unit further includes one or more additional connection bars that are located above or below the connection bar. The withdrawal unit further includes an arm that protrudes forward from the connection bar; and a roller that is configured to rotate and that is located on the arm, where the refrigerator further includes an arm guide that is located in the storage compartment and that is configured to support the roller based on the withdrawal unit moving. The arm is located between a side surface of the storage compartment and the drawer. The arm guide includes a roller guide surface that is configured to contact the roller under the roller and that extends along a movement path of the roller. The arm guide defines a guide groove that opens toward the drawer, and the roller guide surface supports the roller in the guide groove. A lower end portion of each of the pair of vertical bars is coupled to the base part.

The refrigerator further includes a link that has a front end portion that is pivotably connected to the door, that has a rear end portion that is pivotably connected to the base part, and that is configured to move the base part based on opening and closing the door, where the base part includes a bottom portion that is pivotably connected to the rear end portion of the link; and a rear surface portion that extends up from a rear end of the bottom portion, and where the pair of vertical bars each have lower end portions that are coupled to the rear surface portion. The refrigerator further includes a pair of holders that are located on the rear surface portion, and that are configured to receive a respective lower end portion of the pair of vertical bars, and that each define a pocket that is configured to surround both lateral sides of a respective vertical bar. The refrigerator further includes a link that has a front end portion that is pivotably connected to the door, that has a rear end portion that is pivotably connected to the base part, and that is configured to move the base part based on opening and closing the door, where the base part includes a bottom portion that is pivotably connected to the rear end portion of the link; a pair of side surface portions that extend up from side ends of the bottom portion; and a rear surface portion that extends up from a rear end of the bottom portion and that is configured to connect the pair of side surface portions, where the withdrawal unit further includes a reinforcing band that is configured to surround the pair of side surface portions and the rear surface portion, that is bent at a first location where a first end of the rear surface portion connects with one of the side surface portions, and that is bent at a second location where a second end of the rear surface portion connects with another one of the side surface portions.

The reinforcing band includes a metallic material. The pair of vertical bars are coupled to the reinforcing band. The refrigerator further includes a link that has a front end portion that is pivotably connected to the door, that has a rear end portion that is pivotably connected to the base part, and that is configured to move the base part based on opening and closing the door. The front end portion defines a first pivot joint that is located at a connection between the front end portion and the door and that is located a particular distance from a rotation axis of the door, and the rear end portion defines a second pivot joint that is located at a connection between the rear end portion and the base part. The base part defines a slit that extends perpendicular to a rear side of the refrigerator, and the rear end portion is configured to move along the slit. Based on the base part moving forward, the rear end portion of the link is located at a front end of the slit. Based on the door being closed, the rear end portion of the link is spaced from the front end of the slit.

The refrigerator further includes a pair of withdrawal unit guides that are located at opposite sides of the base part and that are configured to guide movement of the base part in a forward direction and a backward direction, where the first pivot joint is located at a left side of the refrigerator and the second pivot joint is located at a right side of the refrigerator or the first pivot joint is located at the right side of the refrigerator and the second pivot joint is located at the left side of the refrigerator. The link includes a first bent section that extends from the front end portion and that is concave with respect to a rotation axis of the door based on the door being open, and a second bent section that is bent. The refrigerator further includes opposite to the first bent section and that is located between the first bent section and the rear end portion. The refrigerator further includes a withdrawal unit guide that is located at the base part and a side surface of the storage compartment and that is configured to guide movement of the base part in a forward direction and a backward direction. The withdrawal unit guide includes a rail that is located on the side surface of the storage compartment and that extends in the forward direction and the backward direction; and a roller that is located on the base part and that is configured to contact with and rotate on the rail based on the base part moving.

The refrigerator further includes a withdrawal unit guide that is located at the base part and a bottom of the storage compartment and that is configured to guide movement of the base part in a forward direction and a backward direction. The drawer guide is located between a side surface of the storage compartment and the drawer. The drawer guide includes a fixed rail that is located in the storage compartment and that extends in a forward direction and a backward direction; and at least one moving rail that is connected with the drawer and that is configured to move along the fixed rail. The refrigerator further includes a drawer connection member that connects the at least one moving rail and the drawer, where a hook is located on the moving rail, and where the drawer connection member defines a coupling hole that is configured to couple to the hook.

The refrigerator further includes a bracket that is located on the side surface of the storage compartment and that is connected to the fixed rail, where the fixed rail includes a first strip part that is parallel to the side surface of the storage compartment and that extends in the forward direction and the backward direction; a second strip part that extends horizontally from the first strip part to the drawer and that includes a notch that extends up from a portion of the second strip part that is spaced apart from the first strip part; and a pocket part that is located on one end of the second strip part and that is configured to receive a lower end portion of the moving rail, and the bracket defines a rail installation groove that is configured to receive the first strip part of the fixed rail. The rail installation groove includes a vertical surface that extends in the forward direction and the backward direction; an upper horizontal surface that horizontally protrudes from an upper end of the vertical surface and that extends in the forward direction and the backward direction; and the lower horizontal surface that horizontally protrudes from a lower end of the vertical surface and that extends in the forward direction and the backward direction, an upper support protrusion protrudes down from the upper horizontal surface, and a lower support protrusion protrudes up from the lower horizontal surface; and an upper end portion of the first strip part of the fixed rail is located between the vertical surface and the upper support protrusion, and the lower support protrusion is inserted into the notch of the fixed rail.

The refrigerator further includes a return unit that is configured to move the drawer backward based on the door closing, where the return unit includes a connection unit that is connected with the drawer; a locker that is connected to the connection unit and that is configured to move in a same direction as the drawer; a locker guide that is located in the storage compartment and that is configured to guide movement of the locker; and a spring that has one end connected to the locker guide and another end connected to the locker and that is configured to stretch based on the locker moving forward. The locker includes a movement guide protrusion and a turning protrusion that is parallel to the movement guide protrusion; the locker guide includes a straight guide slit that extends in a forward direction and a backward direction and that is configured to receive the movement guide protrusion, and a turning guide groove that is configured to cause the turning protrusion to reverse a direction of the movement guide protrusion based on the movement guide protrusion reaching a certain location within the straight guide slit; a coupling protrusion is located on one of the locker or the connection unit, and another one of the locker or the connection unit define a coupling groove, and the coupling protrusion is configured to insert into the coupling groove based on the drawer moving forward; the connection unit and the locker are configured to move forward together; and the coupling groove is configured to separate from the coupling protrusion based on the locker rotating in a forward direction about the movement guide protrusion based on the turning protrusion moving along the turning guide groove.

Interference between the turning protrusion and the turning guide groove causes the locker to maintain a same location. Based on the coupling protrusion and the coupling groove separating and based on the connection unit moving backward, the coupling protrusion inserts into the coupling groove causing the locker to rotate in a reverse direction. The drawer guide includes a fixed rail that is located in the storage compartment and extends in the forward direction and the backward direction; and at least one moving rail that is connected with the drawer and that is configured to move along the fixed rail, where the connection unit connects the moving rail with the locker. The connection unit includes a connection tab that has an upper end portion that is coupled to the moving rail and a lower end portion that defines at least one groove that extends vertically; and a locker connecting member that defines a coupling groove and that has an insertion plate that is inserted into the at least one groove of the connection tab and that is configured to detach from the groove of the connection tab.

The rear frame is separate from the drawer, and the drawer is configured to move by contact between the rear frame and the drawer based on opening the door or closing the door. The drawer guide includes a support bar that connects a rear surface of the storage compartment and the drawer and that varies in length based on the withdrawal unit moving the drawer. The support bar includes a fixed bar that is connected to the rear surface of the storage compartment; and a moving bar that is connected to the drawer and that is configured to extend from the fixed bar. Where the drawer guide includes a cantilever that has a rear end that is coupled to a rear surface of the storage compartment and that supports the drawer from a bottom of the drawer by extending horizontally from the rear end to the opening. A rear surface of the storage compartment defines a slot and the rear end of the cantilever is configured to connect to the slot and is configured to detach from the slot. The rear surface of the storage compartment defines one or more additional slots that are oriented vertically.

The refrigerator further includes a link having a front end portion pivotably connected to the door, having a rear end portion pivotably connected to the base part, and moving the base part in accordance with opening/closing operations of the door. Where the link includes a first link member comprising a front end portion pivotably connected to the door, a second link member comprising a front end portion pivotably connected to the rear end of the first link member and a third link member comprising a front end portion pivotably connected to the rear end of the second link member and comprising a rear end portion pivotably connected to the base part. When the door is closed, the second link member makes an acute angle with the third link member.

When the open angle of the door is equal to or larger than about 60 degrees, the withdrawal unit moves forward. When the door starts to move forward, the second link member makes an obtuse angle with the third link member.

The refrigerator further includes a gasket rimmed around the edge of the rear surface of the door and adhering to the front surface of the cabinet when the door is closed, where the withdrawal unit is maintained at a still state before the gasket is separated from the cabinet by opening the door.

The second link member and the third link member are shorter than the first link member.

The first link member and the third link member adhere closely to one of the top surface and the undersurface of the second link member.

The front end portion of the first link member is rounded.

The refrigerator further includes a link having a front end portion pivotably connected to the door, having a rear end portion pivotably connected to the base part, and moving the base part in accordance with opening/closing operations of the door, a coupling protrusion upwardly protruding from the rear end portion of the link, a slit extending in the base part in forward and backward directions by a certain length and allowing the coupling protrusion to be inserted therein and a cover member covering a portion of the slit to selectively block the coupling protrusion from moving forward and backward. The base part includes a cover seated step which is formed therein and the cover member is seated on, where the slit is formed inside the cover seated step, and when the cover member is seated on the cover seated step, the top surface of the cover member and the top surface of the base part form the same plane. The cover member is detachably seated on the cover seated step.

The cover member is slidably movable from the cover seated step. The refrigerator further includes a cover receiving recess formed in a bottom portion of the withdrawal unit, the bottom potion corresponding to a lateral edge of the cover seated step, and receiving the cover member, where the cover member slidably moves in a lateral direction of the withdrawal unit to be held in the cover receiving recess.

The refrigerator further includes a guide protrusion protruding from the undersurface of the cover member and a protrusion guide groove formed in the cover receiving recess in a lateral direction by a certain length and receiving the guide protrusion.

Advantageous Effects of Invention

A refrigerator described above has the following effects.

First, a drawer guide takes full charge of supporting the load of a drawer, and a withdrawal unit serves only to move the drawer. Accordingly, the load burdened to the withdrawal unit can be reduced. Particularly, since only the load of the withdrawal unit substantially acts on a withdrawal unit guide supporting the withdrawal unit, it is easy to design a bearing element (e.g., rail) supporting the withdrawal unit, and the bearing element can smoothly operate.

Second, since a rear frame constituting the withdrawal unit pushes the drawer in a forward direction from the rear side of the drawer, a force moving the drawer is not dispersed and can be concentrated in a forward direction, and thus the drawer can be stably maintained without wobbling during the withdrawal of the drawer.

Third, the rear frame can be formed into a frame structure including bars, and such structure facilitates the circulation of chilly air. In addition, the weight of the rear frame can be reduced, and the occupied volume in the storage compartment can be reduced, thereby increasing the food storage capacity.

Fourth, since the rear frame has a structure of pushing the drawer from the rear side, the rear frame can act a pushing force to the drawer only by contacting the drawer while the rear frame is moving in a forward direction. Accordingly, although the rear frame is formed of a separate member independently from the drawer (e.g., although the rear frame and the drawer are physically separated from each other), the rear frame can move the drawer without a separate connection or combination structure between the rear frame and the drawer.

Fifth, a return unit may be provided to automatically return the drawer to the original location by accumulating elastic energy during the withdrawal of the drawer and then using the accumulated elastic energy. Thus, when the door is closed, the drawer can be automatically returned.

Sixth, a user can freely select whether or not to use an automatic withdrawal function.

Seventh, since a link connecting the withdrawal unit and the door is configured to include a plurality of joints, the withdrawal of the drawer may start after the door opens by a preset angle or more, and the drawer may not be withdrawn until a gasket of the door is separated from the cabinet. Accordingly, a force that a user applies to the door can be used only for separating the gasket adhered closely to the cabinet from the cabinet at the initial stage of opening the door, and then can be used only for withdrawing the withdrawal unit after opening of the door, thereby allowing the door to be easily opened and allowing the withdrawal unit to be easily withdrawn.

BRIEF DESCRIPTION OF DRAWINGS

FIG. 1 is a perspective view of an example refrigerator.

FIG. 2 is a view of an example refrigerator with the doors opened.

FIG. 3 is a side view of the inside of an example storage compartment of a refrigerator.

FIG. 4 is an exploded perspective view of example main components of a refrigerator.

FIG. 5 is a magnified view illustrating portion A of FIG. 4.

FIG. 6 is a front view illustrating of an example drawer, an example drawer guide, and an example return unit.

FIG. 7 is a magnified view illustrating portion B of FIG. 6.

FIG. 8 is a bottom view illustrating an example withdrawal unit and an example link.

FIG. 9*a* is a view illustrating an example withdrawal unit viewed from the rear lower side.

FIG. 9*b* is a front view of an example withdrawal unit.

FIG. 9*c* is a right side view of an example withdrawal unit.

FIG. 10*a* is a view of an undersurface portion of an example base part when a door is closed.

FIG. 10*b* is a view of a door of FIG. 10*a* opened up to a withdrawal starting angle.

FIG. 10*c* is a view illustrating of a door of FIG. 10*a* fully opened.

FIG. 11 is a perspective view of an example withdrawal unit.

FIG. 12 is a perspective view of an example withdrawal unit.

FIG. 13 is a magnified perspective view of an example return unit.

FIGS. 14*a* to 14*c* are views of example processes for assembling a return unit.

FIG. 15 is a perspective view of an example locker.

FIG. 16 is a perspective view of an example locker connecting member.

FIG. 17 is a perspective view of an example a connection tab.

FIG. 18 is a view illustrating sequential operations of an example return unit according to the location of a drawer when a door is opened.

FIG. 19*a* is a side view of an inside of an example storage compartment of a refrigerator with a closed door.

FIG. 19*b* is a side view of an inside of an example storage compartment of a refrigerator with an opened door.

FIG. 20 is a rear view illustrating an assembly of an example drawer, an example drawer guide, and an example withdrawal.

FIG. 21 is a view illustrating an inside of an example storage compartment of a refrigerator.

FIG. 22 is a magnified perspective view illustrating an exemplary selective withdrawal mechanism of a drawer;

FIG. 23 is a longitudinally-sectional view taken along the line VII-VII of FIG. 22;

FIG. 24 is a magnified perspective view illustrating another exemplary selective withdrawal mechanism of a drawer;

FIG. 25 is a longitudinally-sectional view taken along the line IX-IX of FIG. 24;

FIG. 26 is a magnified perspective view illustrating a withdrawal unit according to another embodiment of the present invention; and FIGS. 27 to 29 are views and graphs illustrating a displacement of a withdrawal unit according to an open angle of a door.

BEST MODE FOR CARRYING OUT THE INVENTION

FIG. 1 is illustrates an example refrigerator 1*a*. FIG. 2 is illustrates an example refrigerator 1*a* with doors 3*a*, 3*b*, 3*c* and 3*d* opened. FIG. 3 illustrates an example storage compartment S3 of a refrigerator 1*a*. The expressions denoting directions such as "front/forward," "rear/backward," "left," "right," "up," and "down" mentioned below will be defined as indicated in FIG. 1.

Referring to FIGS. 1 and 2, the refrigerator 1*a* may include a cabinet 10 including compartments RC and FC (or, storage compartment S1, S2, S3 and S4) formed therein, and doors 3*a*, 3*b*, 3*c* and 3*d* for opening and closing the compartments RC and FC. The doors 3*a*, 3*b*, 3*c* and 3*d* may be pivotably connected to the cabinet 10.

The compartments RC and FC may have a front face opened so as to receive foods therethrough, and the opened front face of the compartments RC and FC may be opened and closed by the doors 3*a*, 3*b*, 3*c* and 3*d*. Chilly air may be supplied into the compartments RC and FC, and the compartments RC and FC may be sealed by the doors 3*a*, 3*b*, 3*c* and 3*d* such that chilly air does not leak out of the compartments RC and FC.

The compartments RC and FC may be provided in plurality. In some implementations with a bottom freezer type of refrigerator, the compartments RC and FC may be disposed at the upper part and the lower part of the cabinet 10, respectively. In some implementations, the compartment FC located at the lower side may be a freezing compartment, the inside of which is maintained at a temperature equal to or lower than about 0° C., and the compartment RC located at the upper side may be a refrigerating compartment, the inside of which is maintained at a temperature equal to or higher than about 0° C. The term "compartment" described herein may become a refrigerating compartment or a freezing compartment unless distinguished into the compartment or the freezing compartment according to the need.

Each compartment RC and FC may be closed or opened by a pair of doors. For example, a pair of refrigerating compartment doors 3*a* and 3*b* may be provided to open and close the refrigerating compartment RC, and a pair of freezing compartment doors 3*c* and 3*d* may be provided to open and close the freezing compartment FC.

The storage compartments S1, S2, S3 and S4 may constitute a portion or all of the compartments RC and FC, and may be defined as regions that are opened and closed by the doors 3*a*, 3*b*, 3*c* and 3*d*, respectively. The refrigerating compartment RC may include the storage compartment S1, the front face of which is opened and closed by the left refrigerating compartment door 3*a*, and the storage compartment S2, the front face of which is opened and closed by the right refrigerating compartment door 3*b*. Hereinafter, the former may be called a left refrigerating storage compartment S1 and the latter may be called a right refrigerating storage compartment S2 if necessary.

Similarly, the freezing compartment FC may include the storage compartment S3, the front face of which is opened and closed by the left freezing compartment door 3*c*, and the storage compartment S4, the front face of which is opened and closed by the right freezing compartment door 3*d*. Hereinafter, the former may be called a left freezing storage compartment S3 and the latter may be called a right freezing storage compartment S4 if necessary.

Thus, when two storage compartments are provided in a lateral direction inside one compartment, the two storage compartments may communicate with each other. For example, when viewed from the front side, the refrigerating compartment RC, there is no member that divides the refrigerating compartment RC into the left refrigerating storage compartment S1 and the right refrigerating storage compartment S2. Accordingly, chilly air may freely circulate between the left refrigerating storage compartment S1 and the right refrigerating storage compartment S2.

In some implementations, the freezing compartment FC, unlike the refrigerating compartment RC, may be provided with a vertical partition between the left freezing storage compartment S3 and the right freezing storage compartment S4, and thus may be divided into two storage compartments S3 and S4. In some implementations, the circulation of chilly air between both storage compartments S3 and S4 may not be completely interrupted by the vertical partition 20. For example, an air vent may be formed in the vertical partition 20 to allow both storage compartments S3 and S4 to communicate with each other.

Referring to FIG. 3, the storage compartments S1, S2, S3 and S4 may be defined by a front surface S(f) having an opening, a pair of side surfaces S(s) extending from the front surface S(f) to the rear side, respectively, and facing each other, an upper surface S(u) connecting the upper end portions of the pair of side surfaces S(s), a lower surface S(b) or bottom facing the upper surface S(u) and connecting the lower end portions of the pair of side surfaces S(s), and a rear surface S(r) facing the opening and connecting the pair of side surfaces S(s), the upper surface S(u), and the lower surface S(b).

According to this definition, when one space like the freezing compartment FC is divided into two sides by the vertical partition 20 and forms two storage compartments S3 and S4 disposed in a lateral direction, the lower surface S(b) and the rear surface S(r) of each storage compartment S3 and S4 may be defined by the inner surface of the cabinet 10, and the upper surface S(u) may be defined by the bottom surface of a horizontal partition 7 dividing the refrigerating compartment RC and the freezing compartment FC. Also, one of both side surfaces of the storage compartments S3 and S4 may be defined by the inner side surface 11 of the cabinet 10, and the other may be defined by one surface of the vertical partition 20 facing the inner side surface 11 of the cabinet 10.

In some implementations, when the refrigerating compartment RC is divided into two by a vertical partition and is configured to have a pair of storage compartments, one of both side surfaces of the storage compartments S1 and S2, the upper surface and the rear surface of the refrigerating compartment RC may be defined by the inner surfaces of the cabinet 10, and the lower surface of the refrigerating compartment RC may be defined by the upper surface of the horizontal partition 7. Also, the other of both side surfaces of the storage compartments S1 and S2 may be defined by one surface of the vertical partition facing one of the both side surfaces of the storage compartments S1 and S2.

Referring to FIG. 2, the doors 3*a*, 3*b*, 3*c* and 3*d* may be disposed to correspond to the storage compartments S1, S2, S3 and S4, respectively. A door storage part for storing foods may be formed on the rear surface portions of the doors 3*a*, 3*b*, 3*c* and 3*d*, e.g., portions facing the opened front surface of the storage compartments S1, S2, S3 and S4. The door storage part may include a storage room 8*a* for receiving foods such as dairy products, drinks, and vegetables frequently taken out, a tray 8*b* for storing ice, and a basket 8*c* for storing frozen foods that are packaged in small size. When the doors 3*a*, 3*b*, 3*c* and 3*d* are closed, at least a portion of the door storage parts 8*a*, 8*b* and 8*c* may be located inside the storage compartments S1, S2, S3 and S4.

Drawers D may be disposed in the compartments RC and FC or the storage compartments S1, S2, S3 and S4. The drawer D may be provided to receive or store foods, and may be disposed in plurality in a vertical direction. The drawer D may be a container (called a drawer or a bin) 320 having a space of a certain size to contain foods. Also, the drawer D may be a shelf 310 of a flat plate type.

FIG. 4 illustrates example main components of the refrigerator 1*a*. FIG. 5 a portion A of FIG. 4. FIG. 6 illustrates example drawers D1, D2, and D3, an example drawer guide 40*a*, and an example return unit 80. FIG. 7 illustrates a portion B of FIG. 6. FIG. 8 illustrates an example withdrawal unit 50*a* and an example link 70. FIGS. 9*c* to 9*c* illustrate an example withdrawal unit 50*a*.

Hereinafter, the left freezing storage compartment S3 will be described, but descriptions thereof can be applied to other storage compartments S1, S2 and S4.

A refrigerator 1*a* may include a cabinet 10, a door 3*c*, a drawer D, a drawer guide 40*a*, a withdrawal unit 50*a*, a withdrawal unit guide 60, and a link 70.

Referring to FIG. 4, the drawer guide 40*a* may be disposed in the storage compartment S3 to support the drawer D. The drawer guide 40*a* may guide the drawer D so as to be movable in forward and backward directions, and may be disposed at both sides of one drawer (e.g., D1), respectively. Thus, the load of each drawer D may be supported by at least a pair of drawer guides 40*a*. In some implementations, three drawer guides 40*a* may be disposed at one side surface S(s) of the storage compartment S3 in accordance with three drawers D1, D2, and D3. Although not shown in FIG. 4, three drawer guides 40*a* may be disposed at the other side surface of the storage compartment S3.

A pair of drawer guides 40*a* provided for each drawer D may include a first drawer guide 40*a*(L) disposed at the inner side surface defining one side surface S(s) of the storage compartment S3, and a second drawer guide 40*a*(R) disposed at the other side surface (e.g., one surface of the vertical partition 20) of the storage compartment S3 (see FIG. 6).

The drawer D may be supported in a state of static mechanical equilibrium by the drawer guide 40*a*. That is, all load of the drawer D may be supported by the drawer guide 40*a*, and the drawer D may be maintained at a still state on the drawer guide 40*a* unless a separate external force acts on the drawer D. In this structure, all load of the drawer D may be substantially supported by the drawer guide 40*a*, and the rear frame 52 may be a non-load bearing element that does not bear the load of the drawer D.

The drawer guide 40*a* may be configured into various forms including a rail or a roller. For example, referring to FIGS. 6 and 7, the drawer guide 40*a* may include a fixed rail 41 that is fixed to the side surface S(s) of the storage compartment S3 and extending in forward and backward directions, and moving rails 42 and 43 that are configured to move along the fixed rail 41 together with the drawer D. The moving rail 42 and 43 may not be necessarily provided in singularity, and in some implementations, two moving rails 42 and 43 may be provided. In some implementations, the first moving rail 42 may engage with the second moving rail 43 while being coupled to the drawer D1, and the second moving rail 43 may engage with the fixed rail 41.

The first moving rail 42 may move along the second moving rail 43 while the drawer D1 is moving forward by a certain distance from the original location (location where the door 3*c* is closed), and the second moving rail 43 may move along the fixed rail 41 when the first moving rail 42 further moves forward beyond the certain distance. In some implementations, the configuration of the drawer guide may be different. For example, the drawer guide may include a fixed rail fixed to the side surface S(s) of the storage compartment S, and a roller that is rotatably provided for the drawer D and rolls along the fixed rail during the movement of the drawer D.

Referring to FIG. 7, the fixed rail 41 may have a shape in which a metallic plate is bent many times. The fixed rail 41 may include a first strip part 411 parallel to the side surface S(s) of the storage compartment S3 and longitudinally extending in forward and backward directions, a second strip part 412 horizontally extending from the lower end of the first strip part 411 to the drawer D1, and a pocket part 413 formed on one end of the second strip part 412 and allowing the lower end portion 431 of the second moving rail 43 to be inserted thereinto.

The pocket part 413 may form a "U" shaped pocket in which the upper side thereof is opened, and the lower end portion 431 of the second moving rail 43 may be inserted through the inlet of the pocket. The first moving rail 42 may be formed to have a cross-section corresponding to the pocket part 413, and may have an inverted "U" shape in which the inlet of the pocket is located at the lower side thereof. The upper end portion 432 of the second moving rail 43 may be inserted into the pocket through the inlet.

A hook 422 protruding upward may be formed on the first moving rail 42. Also, a drawer connection member 321 may be disposed to connect the drawer D1 and the first moving rail 42 such that the drawer D1 is supported by the drawer guide 40*a*. In some implementations, the drawer connection member 321 may be formed integrally with the drawer D1. In other implementations, the drawer connection member 321 may also be formed as a part separate from the drawer D1, and may be coupled to the drawer D1.

The drawer connection member 321 may include a horizontal rib 321*a* coupled to the hook 422 of the first moving rail 42. The horizontal rib 321*a* may horizontally protrude from the outer side surface of the drawer D1 in a lateral direction, and may longitudinally extend in forward and backward directions.

The hook 422 may include a first part 422*a* upwardly protruding from the upper surface 421 of the first moving rail 42 and a second part 422*b* extending from the upper end of the first part 422*a* in a forward direction. A coupling hole having an appropriate form may be formed in the horizontal rib 321*a*, and the hook 422 may pass the coupling hole from lower side to upper side. In some implementations, the drawer D1 may move together with the first moving rail 42 by the above-mentioned coupling between the horizontal rib 321*a* and the hook 422. For example, the drawer D1 and the first moving rail 42 may also be coupled to each other by various other methods as long as both can integrally move.

In some implementations, the coupling between the drawer D1 and the first moving rail 42 may be a structure which can be easily separated by a user without a separate tool. That is, the coupling between the drawer D1 and the first moving rail 42 may not be a structure like coupling using screw or bolt in which the coupling state is maintained unless separated by a tool, but may be a structure in which the coupling state can be released only with hand movement of a user. In some implementations, a user can insert the hook 422 of the first moving rail 42 into the coupling hole formed in the horizontal rib 321*a* or may separate the hook 422 from the coupling hole anytime, by appropriately moving the drawer D1. Thus, the drawer D1 separated from the first moving rail 42 may also be taken out of the storage compartment S3.

In some implementations, the drawer connection member 321 may further include a vertical rib 321*b* downwardly extending from one end of the horizontal rib 321*a*. The vertical rib 321*b* may make contact with a first side surface portion 423 of the first moving rail 42, and in some implementations, may further include a screw or a bolt (hereinafter, referred to as "coupling member") for coupling the vertical rib 321*b* to the first side surface portion 423. Hereinafter, the first side surface portion 423 of the first moving rail 42 may be one of two side surface portions 423 and 424 downwardly extending from both sides of a flat top surface portion 421 of the first moving rail 42, and may be closer to the first strip part 411 than the other side surface portion 424.

The second strip part 412 may include a notch 412*a* having an inverted "V" shape (e.g., caved in an upward direction), and a lower support protrusion 143*a* of a bracket 14 described later may be inserted into the notch 412*a*. The notch 412*a* may be formed on a portion where the second strip part 412 meets the pocket part 413.

The bracket 14 may be disposed on the side surface S(s) of the storage compartment S3 to install the drawer guide 40*a*. The bracket 14 may be configured to protrude from the side surface S(s) of the storage compartment S3 to the drawer D1, and may longitudinally extend in forward and backward directions.

A rail installation groove 14*a* may be longitudinally formed on the bracket 14 in forward and backward directions, and the fixed rail 41 may be installed in the rail installation groove 14*a*. The rail installation groove 14*a* may be defined by a vertical surface 141 substantially parallel to the side surface S(s) of the storage compartment S3 and longitudinally extending in forward and backward directions, and by an upper horizontal surface 142 and a lower horizontal surface 143 which horizontally protrude from the upper end and the lower end of the vertical surface 141, respectively, and longitudinally extend in forward and backward directions.

An elastic support tab 144 formed by cutting the vertical surface 141 may be provided in the rail installation groove 14*a*. The elastic support tab 144 may elastically pivot with respect to the vertical surface, and may be pressurized in a lateral direction by the first strip part 411 of the fixed rail 41.

When the fixed rail 41 is installed in the rail installation groove 14*a*, the elastic support tab 144 may be maintained in a pressurized state, e.g., a deformed state by the fixed rail 41. This deformation may have elasticity, and may restore the elastic support tab 144 to the original form when an external force is removed (e.g., the fixed rail 41 is separated).

The bracket 14 may further include an upper support protrusion 142*a* downwardly protruding from the upper horizontal surface 142 of the rail installation groove 14*a* and/or a lower support protrusion 143*a* upwardly protruding from the lower horizontal surface 143.

When the first strip part 411 of the fixed rail 41 is inserted into the rail installation groove 14*a*, the upper end portion of the first strip part 411 may be located between the vertical surface 141 and the upper support protrusion 142*a*. Particularly, a gap between the vertical surface 141 and the upper support protrusion 142*a* may be formed to correspond to the thickness of the first strip part 411, and thus, the lateral movement of the upper end portion of the first strip part 411 may be stopped by the upper support protrusion 142*a*, thereby preventing the upper end portion of the first strip part 411 from being separated from the gap.

The second strip part 412 may be seated on the lower horizontal surface 143. The lower horizontal surface 143 may be formed to have a width larger than the upper horizontal surface 142, and the lower support protrusion 143*a* may be formed at a location closer to the drawer D1 than the upper support protrusion 142*a*, by a distance g corresponding to a width difference between the lower horizontal surface 143 and the upper horizontal surface 142.

The lower support protrusion 143*a* may be inserted into the notch 412*a* of the fixed rail 41. The lateral movement of the lower support protrusion 143*a* may be prevented by the notch 412*a*. The lower end portion of the fixed rail 41 may be strongly coupled to the bracket 14 by a binding force between the lower support protrusion 143*a* and the notch 412*a*.

Since the first strip part 411 is pressurized in a lateral direction (e.g., direction facing the drawer D1) by the elastic support tab 144 when the fixed rail 41 is installed on the bracket 14, the upper end portion of the first strip part 411 may be adhered closely to the upper support protrusion 142*a*. In some implementations, since the lower support protrusion 143*a* is inserted into the notch 412*a*, the fixed rail 41 can be stably supported without wobbling.

The bracket 14 may further include a return unit installation plate 145 on which a return unit 80 described later is installed. The return unit installation plate 145 may have a longitudinally horizontal surface in forward and backward directions, and the return unit 80 may be installed on the horizontal surface. The return unit installation plate 145 may be disposed under the rail installation groove 14*a*. The return unit 80 may be coupled to the return unit installation plate 145 by a coupling member.

In the above description, the rail installation groove 14*a* and the return unit installation plate 145 are described as being formed on the bracket 14 and the bracket 14 is described as being coupled to the side surface S(s) of the storage compartment S3. For example, the bracket 14 may also be formed integrally with the vertical partition 20 or the inner side surface 11 of the cabinet 10 forming the side surface S(s) of the storage compartment S3.

Referring to FIG. 3, the withdrawal unit 50*a* may move in linkage with the opening/closing operations of the door 3*c*. The withdrawal unit 50*a* may move forward while the door 3*c* is being opened, and may move backward while the door 3*c* is being closed. The drawers D1, D2, and D3 may move in accordance with the operation of the withdrawal unit 50*a*, and particularly, the withdrawal unit 50*a* may move the drawers D1, D2, and D3 forward while the door 3*c* is being opened. In FIG. 3, when the door 3*c* is closed, the locations of the withdrawal unit 50*a* and the drawers D1, D2, and D3 are indicated as dotted lines. In this state, when the door 3*c* is opened, the drawers D1, D2, and D3 may be pushed forward while the withdrawal unit 50*a* moves forward, and in this case, the locations of the withdrawal unit 50*a* and the drawer D are shown as solid lines.

When the door 3*c* is opened and the opening of the front surface S(f) of the storage compartment S3 is in an opened state, the drawers D1, D2, and D3 may be located at a front side from the initial storage location (locations of the drawers D1, D2, and D3 when the door 3*c* is closed, hereinafter, referred to as "original location") by a certain distance. Accordingly, since the hand of a user can easily reach the drawers D1, D2, and D3 as much, it can become easier for a user to take foods out of the drawers D1, D2, and D3 or put foods in the drawers D1, D2, and D3. This convenience may be more advantageous for a large refrigerator having a deep storage compartment S3.

Referring to FIGS. 4, 8, and 9*a* to 9*c*, the withdrawal unit 50*a* may include a base part 51 disposed under the drawer D3, and a rear frame 52 upwardly extending from the base part 51 and disposed at a rear side of the drawers D1, D2, and D3. The rear frame 52 may pass between the drawers D1, D2, and D3 and the rear surface S(r) of the storage compartment S3, and may extend toward the upper surface S(u) of the storage compartment S3 to reach a height corresponding to at least one of drawers D1, D2, and D3. Hereinafter, all of the three drawers D1, D2, and D3 disposed in the storage compartment S3 are described as being pushed and moved by the rear frame 52, but in some implementations, the drawer D3 disposed at the lowermost side of the drawers D1, D2, and D3 may be supported by the base part 51. In some implementations, the drawer guide 40*a* supporting the drawer D3 may be omitted.

The refrigerator 1*a* may include a withdrawal unit guide 60 that guides and moves the withdrawal unit 50*a* in forward and backward directions. The withdrawal unit guide 60 may be disposed between the side surface S(s) of the storage compartment S3 and the base part 51, and may be disposed at both sides of the base part 51, respectively. The withdrawal unit guide 60 may include a rail 61 disposed at one of the side surfaces S(s) of the storage compartment S3 and the base part 51, and a roller 62 disposed at the other of the side surfaces S(s) of the storage compartment S3 and the base part 51 and rotating by the contact with the rail 61 when the base part 51 moves. In some implementations, the withdrawal unit 50*a* may be configured to include the rail 61 fixed to the side surface S(s) of the storage compartment S3 and longitudinally extending in forward and backward directions and the roller 62 rotatably disposed on the side surface portions 512 and 513 (see FIG. 9*b*) and rolling and moving along the rail 61 during the movement of the withdrawal unit 50*a*. For example, instead of the roller 62, a moving rail engaging with the rail 61 may also be provided for the base part 51.

In addition, the roller 62 may be fixed to the side surface S(s) of the storage compartment S3, and the rail 61 may be disposed on the side surface portions 512 and 513 of the base part 51, allowing the rail 61 to move while being supported by the roller 62.

Furthermore, the withdrawal unit guide 60 may be disposed between the bottom surface S(b) of the storage compartment S3 and a bottom portion 511 (see FIG. 9*b*) of the base part 51. For example, a fixed rail may be disposed on the bottom surface S(b) of the storage compartment S3, and a moving rail may be disposed on the bottom portion 511 of the base part 51. The moving rail may be configured to engage with the fixed rail, and may move along the fixed rail while moving together with the base part 51.

Referring to FIG. 9*b*, the base part 51 may be configured to include the bottom portion 511 that is horizontal, and the upper surface of the bottom portion 511 may direct upward, and the lower surface corresponding to the opposite side of the upper surface may face the bottom surface S(b) of the storage compartment S3. In some implementations, when the plurality of drawers D1, D2, and D3 are disposed in a vertical direction, the base part 51 may be disposed under the drawer D3 located at the lowermost side. The link 70 may connect the door 3*c* and the base part 51. One end of the link 70 may be pivotably connected to the door 3*c*, and other end of the link 70 may be pivotably connected to the base part 51. The link 70 will be described in more detail later.

Referring to FIGS. 9*a* to 9*c*, the base part 51 may have a front surface and an upper surface opened. Specifically, the base part 51 may include a bottom portion 511 that is horizontal, a pair of side surface portions 512 and 513 upwardly extending from both side ends of the bottom portion 511, respectively, and a rear surface portion 514 upwardly extending from the rear end of the bottom portion 511 and connecting the pair of the side surface portions 512 and 513 to each other.

The rear frame 52 may upwardly extend from the base part 51, and may include a pair of vertical bars 520*a* and 520*b* spaced from each other in a width direction of the storage compartment S3. However, not limited thereto, the rear frame 52 may be formed as a single vertical plane structure.

The vertical bars 520*a* and 520*b* may upwardly extend from the rear surface portion 514. Hereinafter, when there is a need to distinguish between the pair of vertical bars 520*a* and 520*b*, the respective vertical bars will be expressed as a first vertical bar 520*a* and a second vertical bar 520*b*.

The first vertical bar 520*a* and the second vertical bar 520*b* may not be necessarily formed of separate members, and may be integrally formed of one frame member 520 having a band or beam shape in which the length is longer than the width. That is, in the frame member 520, sections 521 to 524 forming the first vertical bar 520*a* and sections forming the second vertical bar 520*b* may be parallel to each other, and may have a substantially same shape. Both sections may be connected to each other by a connection section 520*c*.

Since the first vertical bar 520*a* and the second vertical bar 520*b* are spaced from each other, chilly air can pass between the first vertical bar 520*a* and the second vertical bar 520*b*. Accordingly, chilly air can smoothly circulate even in a deep space of the storage compartment S3. Particularly, when a discharge port is formed on the rear surface S(r) of the storage compartment S3 to receive chilly air, chilly air discharged from the discharge port may be evenly dispersed in the storage compartment S3.

The connection section 520*c* may be disposed at a lower side of the base part 51. The connection section 520*c* may support the bottom portion 511, and may be coupled to the bottom portion 511 by a coupling member. The connection section 520*c* may include a section 545*a* extending from the lower end of the first vertical bar 520*a* to the front side, a section 545*b* extending from the lower end of the second vertical bar 520*b* to the front side, and a section 546 extending to the width direction of the storage compartment S3 between the both sections 545*a* and 545*b*. The section 546 may be perpendicular to the section 545*a* and the section 545*b*.

The frame member 520 may be formed of a synthetic resin by injection molding, or may be formed of a metal by plastic working. The front surface of the bar 520 and the outer side surface of the base part (e.g., the rear surface of the rear surface portion 514 or the undersurface of the bottom portion 511) may be coupled to each other by a coupling member 56.

The lower end portions of the vertical bars 520*a* and 520*b* may be disposed on the rear surface of the rear surface portion 514 of the base part 51. The lower end portion and the rear surface portion 514 may be coupled by the coupling member 56 at two or more points spaced along the length direction of the vertical bars 520*a* and 520*b*.

One pair of vertical bars 520*a* and 520*b* may be symmetrically disposed with respect to a center line M (see FIG. 9*b*), e.g., a line connecting points located on an equal distance from both side surface portions 512 and 513 of the base part 51.

Referring to FIG. 9*c*, the rear surface portion 514 of the base part 51 may upwardly incline to the rear side from the bottom portion 511 of the base part 51. The lower end portions of the vertical bars 520*a* and 520*b* may be located on the rear surface of the rear surface portion 514 of the base part 51. The vertical bars 520*a* and 520*b* may include a first inclination section 521 upwardly extending while inclining in accordance with the inclination of the rear surface portion 514 from the lower end portion, and a first vertical section 522 vertically extending from the first inclination section 521 to a height (e.g., a height contactable at least with the drawer D3) at least corresponding to the drawer D3 located at the lowermost drawer D3 of the plurality of drawers D1, D2, and D3. While the withdrawal unit 50*a* is moving, the rear surface of the drawer D3 may make contact with the first vertical section 522. The drawer D3 may be configured to occupy the rear region farther than the base part 51, and accordingly, the first inclination section 521 may incline toward the rear side from the base part 51. Also, the first vertical section 522 may upwardly extend from the first inclination section 521 that inclines as above. Accordingly, the first vertical section 522 can make contact with the drawer D3 even though the rear part of the drawer D3 is located at a rear side farther than the base part 51.

Also, the vertical bars 520*a* and 520*b* may further include a second inclination section 523 upwardly inclining toward the rear side from the first vertical section 522, and a second vertical section 524 extending from the second inclination section 523 to a height (e.g., a height contactable at least with the drawer D2) at least corresponding to the drawer D2 disposed over the drawer D3. In some implementations, since three drawers D1, D2, and D3 are disposed, the second vertical section 524 may extend to a height contactable with the drawer D1. As shown in FIGS. 3 and 4, the drawers D2 and D3 may be configured to occupy the rear side farther than the drawer D1, and may make contact with the second vertical section 524.

The rear surface portion 514 of the base part 51 may extend to a height higher than the side surface portions 512 and 513, and may make contact with the vertical bars 520*a* and 520*b* even in a region higher than the side surface portions 512 and 513. That is, an area making contact with the vertical bars 520*a* and 520*b* may become larger, and thus the vertical bars 520*a* and 520*b* may be more stably supported as much as the area becomes larger, by forming the rear surface portion 514 to a height higher than the side surface portions 512 and 513.

Particularly, the vertical bars 520*a* and 520*b* may be coupled to the rear surface portion 514 of the base part 51, and the first inclination section 521 of the vertical bars 520*a* and 520*b* may be coupled to the rear surface portion 514 by the coupling member 56. Thus, in the structure where the vertical bars 520*a* and 520*b* are coupled to the rear surface portion 514, since the rear surface portion 514 strongly holds the lower end portions of the vertical bars 520*a* and 520*b*, the vertical bars 520*a* and 520*b* may not be easily deflected or bent to the rear side even though a reaction force (e.g., a repulsive force due to the inertia of the drawers D1, D2, and D3) acting from the drawers D1, D2, and D3 acts on the vertical bars 520*a* and 520*b* in a process where the withdrawal unit 50*a* pushes the drawers D1, D2, and D3 forward.

Also, both vertical bars 520*a* and 520*b* are connected by the connection section 520*c*, and the connection section 520*c* may have a "U" shaped frame structure including sections 545*a*, 545*b* and 546, adhering closely to or coupled to the undersurface of the bottom portion 511 of the base part 51. Accordingly, the vertical bars 520*a* and 520*b* may be prevented from being deflected in a rear direction by the reaction force applied from the drawers D1, D2, and D3.

Also, since the first vertical bar 520*a* and the second vertical bar 520*b* are integrally connected by the connection section 520*c* without being separated from each other, although different forces are applied to both vertical bars 520*a* and 520*a*, respectively, these forces may be dispersed through the connection section 520*c*. Accordingly, substantially even forces may act on the vertical bars 520*a* and 520*b*, and thus the rear frame 52 may be prevented from being distorted.

The withdrawal unit 50*a* may further include a connection bar 53 that connects the first vertical bar 520*a* and the second vertical bar 520*b* over the base part 51. The connection bar 53 may structurally stabilize the first and second vertical bars 520*a* and 520*b*, and particularly, may prevent the vertical bars 520*a* and 520*b* from being spread with respect to each other. Also in this structure, even when forces acting on the vertical bars 520*a* and 520*b* from the drawers D1, D2, and D3 are different in a process where the withdrawal unit 50*a* pushes the drawers D1, D2, and D3, one vertical bar (e.g., 520*a*) can be prevented from being further deflected in a rear direction than the other vertical bar (e.g., 520*b*).

The connection bar 53 may connect the upper portions of the first vertical bar 520*a* and the second vertical bar 520*b* to each other. The connection bar 53 may be coupled to the second vertical sections 524 of the vertical bars 520*a* and 520*b*, and may be coupled to a location closer to the upper end than the lower end (e.g., a connection port with the second inclination section 523) of the second vertical section 524.

The connection bar 53 may be disposed in plurality at upper and lower sides (see two connection bars 53*a* and 53*b* of FIG. 11). Furthermore, the connection bars 53 may be disposed in accordance with the locations of the plurality of drawers D1, D2, and D3, and may make contact with the rear surface portion of the drawer D when the withdrawal unit 50*a* moves forward. For example, the first connection bar 53*a* and the second connection bar 53*b* may make contact with the first drawer D1 and the third drawer D3 (See FIG. 11), respectively, and in some implementations, another connection bar making contact with the second drawer D2 may be further provided.

Referring to FIGS. 9*a* to 9*c*, the withdrawal unit 50*a* may include arms 532 and 533 extending forward with respect to the vertical bars 520*a* and 520*b* and guided along an arm guide 91. The arms 532 and 533 may extend from the vertical bars 520*a* and 520*b*, but may be formed integrally with the connection bar 53.

The connection bar 53 may include a connection part 531 longitudinally extending in a width direction of the storage compartment S3 and connecting between the pair of vertical bars 520*a* and 520*b*. The connection part 531 may be coupled to the pair of vertical bars 520*a* and 520*b*, and both ends of the connection part 531 may protrude from the vertical bars 520*a* and 520*b* to the side surface S(s) of the storage compartment S3, respectively. The arms 532 and 533 may extend forward from the both ends of the connection part 531, and may be disposed between the drawer D1 and the side surface S(s) of the storage compartment S1. The both arms 532 and 533 may include a roller 92, respectively, and the roller 92 may roll along the arm guide 91 while the withdrawal unit 50*a* is moving.

The connection part 531 may include an elastic protrusion 536. The elastic protrusion 536 may be formed of a material (e.g., rubber) having a certain elasticity. The elastic protrusion 536 may be disposed at the front surface of the connection part making contact with the drawer D1, and may make contact with the drawer D1 while the withdrawal unit 50*a* is moving forward. As the door 3*c* is opened and thus the withdrawal unit 50*a* moves forward, the elastic protrusion 536 may make contact with the drawer D1, alleviating the impact and also reducing noise due to the impact.

Referring to FIGS. 4 and 5, the arm guide 91 may be disposed on the side surface S(s) of the storage compartment S3. The arm guide 91 may be disposed over the drawer guide 40*a* supporting the drawer D1 located at the uppermost side.

The arm guide 91 may include a roller guide surface 91*b* making contact with the roller 92 under the roller 92 and longitudinally extending along the movement path of the roller 92, e.g., in forward and backward directions of the storage compartment S3. The roller guide surface 91*b* may be formed into a horizontal plane.

As shown in FIG. 5, the cross-sectional of the arm guide may form a "U" shaped guide groove 91*a* which is opened toward the drawer D, and the roller 92 may be supported by the roller guide surface 91*b* in the guide groove 91*a*. The guide groove 91*a* may further include an upper side surface 91*c* disposed over the roller guide surface 91*b* and parallel to the roller guide surface 91*b*. The roller guide surface 91*b* and the upper side surface 91*c* may be spaced from each other by a little more than the diameter of the roller 92 such that the roller 92 does not make contact with the upper side surface 91*c* while rolling along the roller guide surface 91*b*.

While the withdrawal unit 50*a* is moving, a reaction force acting on the rear frame 52 from the drawers D1, D2, and D3 may act as a factor which allows the vertical bars 520*a* and 520*b* to pivot on the connection part with the base part 51 in a rear direction (e.g., deflect the vertical bars 520*a* and 520*b* in a rear direction). In some implementations, although the roller 92 tends to be displaced downward due to the deflection tendency of the vertical bars 520*a* and 520*b*, the roller guide surface 91*b* may restrain the displacement of the roller 92, consequently preventing the vertical bars 520*a* and 520*b* from being deflected in a rear direction.

In order to move the withdrawal unit 50*a* in linkage with the opening/closing operations of the door 3*c*, the door 3*c* may be connected to the base part 51 by the link 70. In some implementations, the base part 51 may also be moved by power provided from a drive unit such as a motor or an actuator which is electrically driven. For example, when a motor is provided as the drive unit, the base part 51 may be moved by a power conversion unit that converts the torque of the motor into a rectilinear movement, and examples of the power conversion unit may include rack & pinion and crank. In some implementations, the drive unit may operate in accordance with the opening/closing operations of the door 3*c*. In other words, when the door 3*c* is opened, the drive unit may operate such that the power conversion unit moves the withdrawal unit 50*a* forward. Furthermore, when the door 3*c* is closed, the drive unit may operate such that the power conversion unit moves the withdrawal unit 50*a* backward.

In some implementations, the withdrawal unit 50*a* may be a member separate from the drawers D1, D2, and D3. That is, the drawer D is not coupled or bound to the rear frame 52. Accordingly, when the door 3*c* is opened, the drawers D1, D2, and D3 may move forward by the contact with the rear frame 52, but the contact between the rear frame 52 and the drawers D1, D2, and D3 may be temporary for withdrawal of the drawers D1, D2, and D3. Particularly, when the drawers D1, D2, and D3 are supported in a balanced state (i.e. state of static mechanical equilibrium) by the drawer guide 40*a*, despite the temporary contact between the rear frame 52 and the drawers D1, D2, and D3, the rear frame 52 may serve only to push and move the drawers D1, D2, and D3, and may not bear the load of the drawers D1, D2, and D3. This point is the same for an implementation in which the rear frame 52 is coupled to the drawers D1, D2, and D3 at ordinary time.

In other words, in a structure in which the drawers D1, D2, and D3 and the withdrawal unit 50*a* are separated from or uncoupled to each other, the movement of the drawers D1, D2, and D3 may be performed by a separable contact between the withdrawal unit 50*a* and the drawers D1, D2, and D3. That is, when the rear frame 52 makes contact with the drawers D1, D2, and D3 in a process where the withdrawal unit 50*a* moves forward in linkage with the door 3*c*, the drawers D1, D2, and D3 may be pushed and moved by the rear frame 52, but the contact between the drawers D1, D2, and D3 and the rear frame 52 may be separable according to the need. For example, when the rotation of the door 3*c* is stopped and the door 3*c* is closed while the drawers D1, D2, and D3 is being pushed and moved forward by the rear frame 52, the contact between the drawers D1, D2, and D3 and the rear frame 52 may be released at least temporarily.

In some implementations, the withdrawal unit (particularly, rear frame 52) may also maintain the coupling with the drawers D1, D2, and D3 at ordinary time. In some implementations, the load of the drawers D1, D2, and D3 may not be applied to the withdrawal unit 50*a* as long as the drawers D1, D2, and D3 are supported in a balanced state by the drawer guide 40*a*. In some implementations, there may be an advantage in that the withdrawal unit 50*a* can move the drawers D1, D2, and D3 in a rear direction when the door 3*c* is closed.

FIGS. 10*a* to 10*c* illustrate an undersurface portion of an example base part 51. Referring to FIGS. 10*a* to 10*c*, the link 70 may include a front end portion 71 pivotably connected to the door 3*c* and a rear end portion 72 pivotably connected to the base part 51. That is, the front end portion 71 may be pivotably coupled to the door 3*c*, and may form a first pivot joint J1. The rear end portion 72 may be pivotably coupled to the base part 51, and may form a second pivot joint J2.

The first pivot joint J1 may be spaced from the center of rotation, e.g., the rotation axis C of the door 3*c* with respect to the cabinet 10 by a certain distance r. Accordingly, when the door 3*c* pivots, the first pivot joint J1 may move along the circumference having a radius r with the rotation axis C of the door 3*c* as the center. As the location of the pivot joint J1 changes on the circumference, the second pivot joint J2 may be displaced, and thus, the base part 51 may move.

The first pivot joint J1 and the second pivot joint J2 may be located at opposite sides to each other based on a reference line L (see FIG. 10*a*) equally spaced from the withdrawal unit guides 60 disposed at both sides of the base part 51. In some implementations, since both withdrawal unit guides 60 are symmetrically disposed with respect to the base part 51, the reference line L may be the substantially same as the center line of the base part 51, e.g., a line M (see FIG. 9*b*) equally spaced from both side surface portions 512 and 513 of the base part 51.

The second pivot joint J2 may be fixed in location with respect to the base part 51, but in some implementations, may be configured to vary in location with respect to the base part 51 in accordance with a certain section of the whole section where the door 3*c* pivots. For example, a slit 517 longitudinally extending in forward and backward directions may be formed in the base part 51, and the second pivot joint J2 may be configured to move along the slit 517. For this, a coupling hole to which a coupling member is coupled may be formed in the rear end portion 72 of the link 70, and the coupling member may be coupled to the coupling hole through the slit 517. That is, the second pivot joint J2 may be a movable pivot joint that can move along slit 517 and pivot with respect to the base part 51 in accordance with the pivot operation of the door 3*c*. The slit 517 may have a certain length such that the second pivot joint J2 can move with respect to the base part 51, and the coupling member may move along the slit 517.

The rear end portion 72 of the link 70 may be located on the undersurface of the base part 51, and a washer 78 (see FIG. 4) may be disposed on the top surface of the base part 51. The coupling member may be coupled to the washer 78 through the slit 517 and the coupling hole.

The rear end portion 72 of the link 70 may be located at the initial location (see FIG. 10*a*) when the door 3*c* is closed. At the initial location, the rear end portion 72 of the link 70 may be spaced from the front end of the slit 517 by a certain distance, and may make contact with the rear end of the slit 517.

When the closed door 3*c* starts to open, the rear end portion 72 of the link 70 may move along the slit 517 and the base part 51 may be maintained in a still state until the open angle of the door 3*c* reaches a preset withdrawal starting angle θ. That is, the drawers D1, D2, and D3 may not move until the door 3*c* reaches the withdrawal starting angle θ (see FIG. 10*b*).

The withdrawal starting angle θ may be an open angle corresponding to a point where the rear end portion 72 of the link 70 or the second pivot joint J2 moves from the initial location (location when the door 3*c* is closed) to the front end of the slit 517. As the open angle of the door 3*c* gradually increases beyond the withdrawal starting angle, the second pivot joint J2 may move together with the base part 51, and the drawers D1, D2, and D3 may move forward (e.g., be withdrawn). While the second pivot joint J2 is moving from the initial location to the front end of the slit 517, the door 3*c* may pivot, but the drawers D1, D2, and D3 or the base part 51 may not move. Accordingly, a section where the door 3*c* pivots until the door 3*c* reaches the withdrawal starting angle θ from the closed state may be defined as a withdrawal delay section.

The withdrawal delay section may be needed to prevent the drawers D1, D2, and D3 from colliding with the rear surface portion of the door 3*c* or a component (e.g., door storage parts 8*a*, 8*b* and 8*c*) installed on the rear surface portion of the door 3*c*. That is, when there is no withdrawal delay section, the drawers D1, D2, and D3 may move immediately when the door 3*c* starts to open. In some implementations, since the drawers D1, D2, and D3 may move forward before the rear surface portion of the door 3*c* or projections such as the door storage parts 8*a*, 8*b* and 8*c* installed on the rear surface portion deviate from the movement path of the drawers D1, D2, and D3, the drawers D1, D2, and D3 may collide with the rear surface portion of the door 3*c* or the projections installed thereon.

In addition, the refrigerator 1*a* may comprise a gasket (not shown) disposed on the rear surface of the door 3*a*, 3*b*, 3*c*, 3*d* to maintain airtightness of the storage compartment RC, FC. When a user opens the door 3*c* that is closed, a force applied from the user is used only to separate the gasket from the cabinet 10 because the movement of the withdrawal unit 50*a* is not initiated until the door 3*c* reaches the withdrawal starting angle θ from the closed state.

The withdrawal starting angle θ may be equal to or less than about 90 degrees, and in some implementations, may range from about 70 degrees to about 80 degrees. In some implementations, when a distance that the base part 51 travels until the door 3*c* is completely opened from the withdrawal starting angle is defined as a withdrawal distance, the withdrawal distance may be set to about 10 cm.

After the door 3*c* pivots to the withdrawal starting angle θ, the rear end portion 72 of the link 70 may be located at the front end of the slit 517, and then the base part 51 may move together with the drawers D1, D2, and D3.

When the drawers D1, D2, and D3 move by the withdrawal distance, the drawers D1, D2, and D3 may not cross the front surface S(f) of the storage compartment S3. In some implementations, the movable range of the drawers D1, D2, and D3 that is allowed by the drawer guide 40*a* may not be limited such that the drawers D1, D2, and D3 do not cross the front surface S(f) of the storage compartment S3. That is, the drawers D1, D2, and D3 may be located so as not to cross the front surface S(f) when the door 3*c* is completely opened, but this means that the final location to which the drawers D1, D2, and D3 are automatically withdrawn by the withdrawal unit 50*a*. Accordingly, a user may further withdraw the drawers D1, D2, and D3 manually, e.g., by his/her own efforts. For this, the drawer guide 40*a* may be configured to guide the movement of the drawers D1, D2, and D3 beyond the automatic withdrawal distance by the withdrawal unit 50*a*.

The link 70 may include a first bent section 73 extending from the front end portion 71 and convexly bent toward a direction distant from the rotation axis c of the door 3, and a second bent section 74 convexly bent toward the opposite direction to the first bent section 73 between the first bent section 73 and the rear end portion 72 of the link 70.

Since the front end portion 71 of the link 70 is spaced away from the rotation axis C of the door 3*c*, a portion of the door 3*c*, particularly, a portion (e.g., corner of the door 3*c*) from the rotation axis C to the front end portion 71 may be interfered with the link 70 when the door 3*c* pivots. This limitation needs to be overcome when the front end portion 71 of the link 70 is connected to the door 3*c* at a portion upwardly spaced from the undersurface of the door 3*c* by a certain distance or when the link 70 has a vertical flection even though the link 70 is coupled to the undersurface of the door 3*c*. In order to prevent this limitation, the link 70 may be configured to include the first bent section 73 convexly formed in a direction distant from the rotation axis C in a certain section extending from the front end portion 71 of the link 70.

When the first bent section 73 is formed throughout the whole section of the link 70, it may be easy to avoid the interference between the door 3*c* and the link 70, but it may be difficult to configure the link 70 to be covered by the door 3*c* or the base part 51 during the opening/closing process of the door 3*c* as much as the first bent section is convex. Also, it may be also difficult to allow the second pivot joint J2 to be spaced away from the rotation axis C of the door 3*c*. Accordingly, the second bent section 74 that is convex in the opposite direction to the first bent section 73 may be provided between the first bent section 73 and the rear end portion 72 of the link 70.

FIG. 11 illustrates an example withdrawal unit 50*b*. Referring to FIG. 11, the withdrawal unit 50*b* may include a first vertical bar 520*a* and a second vertical bar 520*b* which are formed of separate members. The lower end portions of the first vertical bar 520*a* and the second vertical bar 520*b* may be coupled to a rear surface portion 514 of a base part 51.

A pair of holders 518 may be formed on the rear surface portion 514 of the base part 51. The lower end portions of the first vertical bar 520*a* and the second vertical bar 520*b* may be inserted into the pair of holders 518. The holder 518 may include a pair of rib 518*a* and 518*b* symmetrical to each other and having an "L" shape which surrounds both sides of the vertical bars 520*a* and the 520*b*, forming a pocket structure in which the lower end portions of the vertical bars 520*a* and 520*b* are inserted between the both ribs 518*a* and 518*b*.

When the lower end portions of the vertical bars 520*a* and the 520*b* are inserted between the pair of ribs 518*a* and 518*b*, a coupling member 56 may pass through the lower end portion, and may be coupled to the rear surface portion 514 of the base part 51. The coupling member 56 may be coupled at two or more points spaced from each other in a vertical direction.

Since the vertical bars 520*a* and 520*b* are coupled to the rear surface portion 514 of the base part 51 while being inserted into the holder 518 and the both ribs 518*a* and 518*b* of the holder 518 surround and hold the both sides and the real surface of the vertical bars 520*a* and 520*b*, the vertical bar 520*a* and 520*b* can be prevented from being deflected in a rear direction, and wobbling in a lateral direction can also be reduced.

Both ends of the connection bars 53*a* and 53*b* may be coupled to the first vertical bar 520*a* and the second vertical bar 520*b*, respectively. In some implementations, the connection bar 53*a* and 53*b* may be coupled to the rear surface of the vertical bars 520*a* and 520*b*, and may also be coupled to the front surface of the vertical bars 520*a* and 520*b*. The connection bars 53*a* and 53*b* may be provided in plurality in a vertical direction, and the connection bars 53*a* and 53*b* may be coupled to the vertical sections 524 and 522 (see FIG. 9*c*) of the vertical bars 520*a* and 520*b*, respectively.

FIG. 12 illustrates an example withdrawal unit 50*c*. The withdrawal unit 50*c* may include a reinforcing band 516 longitudinally extending along the upper end portion of a base part 51. The reinforcing band 516 may be bent at portions corresponding to corners where both side surface portions 512 and 513 of the base part 51 meet the rear surface portion 514 of the base part 51, and may surround the both side surface portions 512 and 513 and the rear surface portion 514 of the base part 51.

The reinforcing band 516 may include a rear surface section 516*a* coupled to the rear surface portion 514 of the base part 51, and a first side surface section 516*b* and a second side surface section 516*c* which extend from both sides of the rear surface section 516*a* in a forward direction and are coupled to the side surface portions 512 and 513 of the base part 51, respectively.

The reinforcing band 516 may be formed of a metallic material. For example, a metallic plate may be cut into a long band form, and then may be bent at the portions corresponding to the corners to form the reinforcing band 516.

The reinforcing band 516 may be configured to surround the outer side of the base part 51. The lower end portions of both vertical bars 520*a* and 520*b* may be coupled to the rear surface section 516*a* of the reinforcing band 516. When the vertical bars 520*a* and 520*b* are formed of a metallic material, the rear surface section 516 and the vertical bars 520*a* and 520*b* may be coupled to each other by a welding method. Examples of welding may include spot welding, projection welding, and laser welding. Furthermore, the vertical bars 520*a* and 520*b* may be coupled to the rear surface section 516*a* by a coupling member.

In some implementations, since the withdrawal units 50*a*, 50*b* and 50*c* is interlocked with the door 3*c* by the link 70, the withdrawal units 50*a*, 50*b* and 50*c* may automatically move backward while the door 3*c* is being closed, but this movement may be independently performed with respect to the drawers D1, D2, and D3. Accordingly, a unit for push the drawers D1, D2, and D3 backward may be needed while the door 3*c* is being closed.

The above-mentioned function may be achieved by the door storage parts 8*a*, 8*b* and 8*c* without the aid of a separate return unit 80. That is, while the door 3*c* is being closed, the drawers D1, D2, and D3 may be pushed and moved backward by the door storage parts 8*a*, 8*b* and 8*c*. The door storage parts 8*a*, 8*b* and 8*c* may be disposed in plurality in a vertical direction, and the door storage parts 8*a*, 8*b* and 8*c* may be disposed at heights corresponding to the drawers D1, D2, and D3, respectively.

In some implementations, since the structure in which the return operation of the drawers D1, D2, and D3 is performed by the door storage parts 8*a*, 8*b* and 8*c* is based on a contact or a collision between the door storage parts 8*a*, 8*b* and 8*c* and the drawers D1, D2, and D3, the components may be damaged due to collision between the components when a user strongly closes the door 3*c*, and there may be disadvantages in terms of use convenience and emotion. Accordingly, a unit may be needed to automatically return the drawers D1, D2, and D3 while the door 3*c* is being closed. Hereinafter, a return unit 80 will be described as an example of such unit.

FIG. 13 illustrates an example return unit 80. FIGS. 14*a* to 14*c* illustrate an example process of assembling an example return unit 80. FIG. 15 illustrates an example locker 82. FIG. 16 illustrates an example locker connecting member 84. FIG. 17 illustrates of an example connection tab 85. FIG. 18 illustrates sequential operations of an example return unit 80.

The return unit 80 may be fixedly disposed in the storage compartment S3, and may include a locker guide 81 guiding the movement of the locker 82 described later, a spring 83 fixedly disposed in the locker guide 81 and compressed and stretched in accordance with the location of the locker 82, and locker connecting member 84 and connection tab 85 interlocking with the drawer D and moving the locket 82.

The return unit 80 may move the drawer D backward such that the drawer D automatically returns to the original location (location of the drawer D when the door 3*c* is in closed state), and may be provided for the drawers D1, D2, and D3.

In some implementations, as shown in FIG. 6, one pair of return units 80 may be provided for one drawer D, and the return unit 80 may be disposed at the vertical partition 20 and the inner side surface 11 of the cabinet 10. In some implementations, the return unit 80 may not be necessarily provided in pair for one drawer D, and may be provided only on one of both side surfaces of the storage compartment S.

The return unit 80 may be fixed to the bracket 14 (see FIGS. 6 and 7). More specifically, when the locker guide 81 is placed on the return unit installation plate 145 of the bracket 14, the locker guide 81 and the return unit installation plate 145 may be coupled to each other by a coupling member.

At least a portion of the locker 82 may be inserted into the locker guide 81, and a locker movement path 81*a* longitudinally extending along the movement direction of the locker 82 may be formed in the locker guide 81. The locker guide 81 may be spaced away from each other, and may include one pair of housing plates 811 and 812 longitudinally extending along the movement direction of the locker 82. The locker movement path 81*a* may be defined by a space formed between the pair of housing plates 812 and 811. When the return unit 80 is installed as shown in FIGS. 6 and 7, both sides of the locker movement path 81*a* may be opened, and a portion of the locker 82 may be inserted into the locker movement path 81*a* through the side opposite to the drawer D among both opened sides.

Thus, when the locker 82 is inserted into the locker movement path 81*a*, the undersurface of the first housing plate 811 of the pair of housing plates 811 and 812, located at an upper side, may face the top surface of the locker 82, and the top surface of the second housing plate 812, located at a lower side, may face the undersurface of the locker 82. The undersurface of the locker 82 may be supported by the top surface of the second housing plate 812, and the top surface of the locker 82 may make contact with the undersurface of the first housing plate 811.

Referring to FIG. 15, the locker 82 may include a locker body 820 moving along the locker movement path 81*a*, and a movement guide protrusion 831 (see FIG. 14*a*) vertically protruding from the locker body 820. The movement guide protrusion 831 may protrude from at least one of the upper surface and the lower surface of the locker body 820.

A straight guide slit 81*b* which the movement guide protrusion is inserted into may be formed in at least one of the first housing plate 811 and the second housing plate 812. The straight guide slit 81*b* may extend in a straight-line form in forward and backward directions.

The locker body 820 and the movement guide protrusion 831 may be formed in one part. In some implementations, since it is not easy to the movement guide protrusion 831 into the straight guide slit 81*b* due to an interference of the first housing plate 811 and/or the second housing plate 812, a portion of the straight guide slit 81*b* needs to be cut to form an inlet which the movement guide protrusion 831 is inserted into. Accordingly, In some implementations, the movement guide protrusion 831 may be formed of a member separate from the locker body 820, and a protrusion coupling hole 822 which the movement guide protrusion 831 is inserted into and coupled to may be formed in the locker body 820. In some implementations, as shown in FIG. 14*a*, when the locker body 820 is inserted into the locker movement path 81*a*, the protrusion coupling hole 822 of the locker body 820 may be aligned with the straight guide slit 81*b*, and then the movement guide protrusion 831 may be inserted into the protrusion coupling hole through the straight guide slit 81*b*, thereby assembling the locker body 820 and the movement guide protrusion 831.

The movement guide protrusion 831 may have both end portions protruding from the top surface and the undersurface of the locker 82, and the both end portions may be inserted into the straight guide slit 81*b* formed in the first housing plate 811 and the second housing plate 812. The straight guide slit 81*b* of the first housing plate 811 and the straight guide slit 81*b* of the second housing plate 812 may be formed at location corresponding to each other, and thus, when viewed from the upper side or the lower side, both straight guide slits 81*b* may overlap each other.

Also, the locker 82 may include a turning protrusion 821 disposed at a location spaced from the movement guide protrusion 831 by a certain distance. The turning protrusion 821 may be formed integrally with the locker body 820. The turning protrusion 821 may be provided movably along the lateral side 815 of the first housing plate 811 and/or the lateral side 816 of the second housing plate 812. In some implementations, the turning protrusion 821 may have both end portions protruding to the upper side and the lower side of the locker body 820, respectively, and the protruding end portions may be provided movably along the lateral side 815 of the first housing plate 811 and the lateral side 826 of the second housing plate 812.

Turning guide grooves 817*a* and 817*b* may be formed in the locker guide 81 to guide the turning operation of the turning protrusion 821. The turning guide grooves 817*a* and 817*b* may be formed in the first housing plate 811 and the second housing plate 812, and may extend from the lateral sides 815 and 816 of the housing plates 811 and 812, respectively.

When the movement guide protrusion 831 moves in the straight guide slit 81*b* and reaches a certain location, the turning operation of the turning protrusion 821 around the movement guide protrusion 831 may be induced by the guidance of the turning guide grooves 817*a* and 817*b*.

The turning guide grooves 817*a* and 817*b* may guide the turning protrusion 821 such that the turning protrusion 821 can rotate around the movement guide protrusion 831 in a direction distant from the drawer D. A portion of the first housing plate 811 (or a portion of the lateral sides 815 and 816 of the second housing plate 812) may be bent in a direction distant from the drawer D, and this bent portion may constitute at least a portion of the turning guide grooves 817*a* and 817*b*. That is, the turning protrusion 821 may move forward along the lateral sides 815 and 816, and may be inserted into the turning guide grooves 817*a* and 817*b*.

In some implementations, when the movement guide protrusion 831 is located at the front end of the straight guide slit 81*b*, e.g., when the movement guide protrusion 831 cannot further move forward and is blocked by the straight guide slit 81*b*, the turning operation of the turning protrusion 821 may start. In some implementations, the turning guide grooves 817*a* and 817*b* may be formed into a circular arc substantially having the movement guide protrusion 831 as the center and having a distance between the movement guide protrusion 831 and the turning protrusion 821 as the radius.

In some implementations, the shape of the turning guide grooves 817*a* and 817*b* may not be necessarily a circular arc. For example, even when the turning protrusion 821 is inserted into the turning guide grooves 817*a* and 817*b*, the movement guide protrusion 831 may continuously move along the straight guide slit 81*b*. In some implementations, the turning guide grooves 817*a* and 817*b* may form a curve in which the radius of curvature gradually increases from the inlet which the turning protrusion 821 is inserted into.

The protrusion coupling hole 822 may be formed to penetrate the top surface and the undersurface of the locker body 820. In some implementations, the movement guide protrusion 831 may be formed to have a length larger than the thickness of the locker body 820. Thus, when the movement guide protrusion 831 is inserted into the protrusion coupling hole 822, the upper end portion of the movement guide protrusion 831 may protrude from the top surface of the locker body 820 and the lower end portion thereof may protrude from the undersurface of the locket body 820. These protruding portions may be inserted into the straight guide slit 81*b* formed in the first housing plate 811 and the straight guide slit 81*b* formed in the second housing plate 812.

The spring 83 may be disposed in the locker movement path 81*a*. One end of the spring 83 may be fixed to the locker guide 81, and the other end thereof may be coupled to the locker 82. A fixing groove 825 may be formed in the locker body 820, and may have an appropriate shape for coupling with the other end of the spring 83.

As the locker 82 moves forward along the locker movement path 81*a*, the spring 83 may be stretched. Thereafter, when the turning protrusion 821 moves along the turning guide grooves 817*a* and 817*b* beyond a certain section, the turning protrusion 821 may be confined and fixed in location thereof by the interference or frictional contact with the turning guide grooves 817*a* and 817*b*, and the spring 83 may be maintained in a maximally stretched state. When the confinement of the turning protrusion 821 is released, elastic or restoring energy accumulated in the spring 83 that is stretched may return the locker 82 to the original location.

The connection units that includes locker connecting member 84 and connection tab 85 may move the locker 82 in accordance with the movement operation of the drawer D. In some implementations, the connection unit 84 and 85 may be configured to connect the locker 82 and the first connection unit 42 moving integrally with the drawing, and may also be configured to connect the drawer D and the locker 82.

The locker body 820 may be connected to the first moving rail 42 by the locker connecting member 84 and connection tab 85. The locker body 820 may have a coupling groove 823 formed on the side surface thereof which faces the drawer D. The locker connecting member 84 may include a coupling protrusion 845 that is inserted into the coupling groove 823. The coupling protrusion 845 and the coupling groove 823 may be detachably coupled to each other.

The locker connecting member 84 and connection tab 85 may be formed of one member, but in some implementations, may also be configured to include the connection tab 85 fixed to the first moving rail 42, and the locker connecting member 84 formed of a member separate from the connection tab 85 and connecting the connection tab 85 and the locker 82.

An upper end portion 851 of the connection tab 85 may be coupled to the first moving rail 42. As described above, since the first moving rail 42 moves integrally with the drawer D, the connection tab may move together with the drawer D. In some implementations, the connection tab 85 may also be directly coupled to the drawer D.

A lower end portion 852 of the connection tab 85 may be coupled to the locker connecting member 84, and may be detachably coupled to the locker connecting member 84. A pair of slits 852*a* and 852*b* cut in a vertical direction may be formed in the lower end portion 852 of the connection tab 85, and the locker connecting member 84 may include a pair of insertion plates 843*a* and 843*b* that are inserted into the pair of slits 852*a* and 852*b*, respectively.

The locker connecting member 84 may include a first plate body part 841 and a second plate body part 842 which are parallel to each other. The pair of insertion plates 843*a* and 843*b* may be disposed between the first plate body part 841 and the second plate body part 842. The coupling protrusion 845 may protrude from the second plate body part 842.

The connection tab 85 may include a tab part 854 between the pair of slits 852*a* and 852*b*, and the tab part 854 may be inserted into a pace formed between the pair of insertion plates 843*a* and 843*b*. The tab part 854 may be press-fitted into the space between the pair of insertion plates 843*a* and 843*b*, and thus the connection tab 85 and the locker connecting member 84 may move integrally with each other.

The upper end portion 851 and the lower end portion 852 of the connection tab 85 may be formed into a vertical plate shape, and an intermediate portion 853 of the connection tab 85 may be formed into an oblique plate shape which becomes closer to the drawer D from the lower end portion 852 to the upper end portion 851.

Referring to FIG. 18, the return unit 80 may operate as follows.

When the door 3*c* is closed (see FIG. 18(*a*)), the coupling protrusion 845 of the locker connecting member 84 may be inserted into the coupling groove 823 of the locker 82. While the door 3*c* is being opened, the drawer D may be pushed and moved forward by the withdrawal units 50*a*, 50*b* and 50*c*, and the locker 82 may move together with the drawer D. In some implementations, the movement guide protrusion 831 of the locker 82 may move along the straight guide slit 81*b*.

When the locker 82 continuously moves and the turning protrusion 821 moves along the turning guide groove 817*a*, the locker 82 may rotate on the movement guide protrusion 831 in a forward direction (clockwise direction based on FIG. 18). Accordingly, the coupling protrusion 845 of the locker connecting member 84 may be separated from the coupling groove 823 of the locker 82. In some implementations, the turning protrusion 821 may be located at the end of the turning guide grooves 817*a* and 817*b*, and the spring 83 may be maximally stretched (see FIG. 18(*b*)).

The location of the turning protrusion 821 can be maintained even in a state where the locker 82 and the locker connecting member 84 are separated from each other, by configuring the turning guide grooves 817*a* and 817*b* into an appropriate shape. For example, the turning protrusion 821 can overcome the restoring force of the spring 83 and maintain its location even when the locker 82 and the locker connecting member 84 are separated from each other, by appropriately designing the curvature of the lateral sides 815 and 816 of the housing plates 811 and 812, the angle of the turning guide grooves 817*a* and 817*b* with respect to the movement direction of the drawer D, and the frictional force between the turning guide grooves 817*a* and 817*b* and the turning protrusion 821. In FIG. 18(*c*), the location of the turning protrusion 821 is shown as the substantially same as the location in FIG. 18B even though the locker 82 and the locker connecting member 84 are separated from each other.

Even when the coupling protrusion 845 of the locker connecting member 84 is separated from the coupling groove 823 of the locker 82, the drawer D may further move forward by the withdrawal units 50*a*, 50*b* and 50*c* until the door 3*c* is completely opened (see FIG. 18(*c*)). When a user closes the door 3*c* again, the door 3*c* or components (e.g., door storage parts 8*a*, 8*b* and 8*c*) located on the rear surface portion of the door 3*c* may make contact with the drawer D. Thus, the drawer D may be pushed and moved backward, and the locker 82 may be rotated in a backward direction. In some implementations, the turning protrusion 821 may be again guided along the turning guide grooves 817*a* and 817*b*, and then may be deviated from the turning guide grooves 817*a* and 817*b*.

The coupling protrusion 845 of the locker connecting member 84 may be again inserted into the coupling groove 823 of the locker 82, and thus the locker 82 and the drawer D may be again connected by the locker connecting member 84 and connection tab 85. Also, the locker 82 may be moved backward by the restoring force of the spring 83, and thus the drawer D may also move backward and return to the initial location (e.g., location of the drawer D when the door 3*c* is closed).

FIGS. 19(*a*) and 19(*b*) illustrate an example storage compartment S3 of a refrigerator 1*b*. FIG. 20 illustrates an assembly of example drawers D1, D2, and D3, an example drawer guide 40*b*, and an example withdrawal unit 50*a*.

The drawer guide 40*b* may include a support bar 40*b* which is variable in length in forward and backward directions. The support bar 40*b* may be disposed in the storage compartment S3, and may connect the rear surface S(r) of the storage compartment S3 and the drawers D1, D2, and D3. Also, the support bar 40*b* may support the drawers D1, D2, and D3 such that the drawers D1, D2, and D3 are located at certain heights in the storage compartment S3.

The support bar 40*b* may vary in length in accordance with a distance between the rear surface S(r) of the storage compartment S3 and the drawers D1, D2, and D3. Since the drawers D1, D2, and D3 are pushed and moved forward by the withdrawal unit 50*a* when the door 3*c* is opened, the distance between the rear surface S(r) of the storage compartment S3 and the drawers D1, D2, and D3 may become distant, and thus the length of the support bar 40*b* may increase. In some implementations, while the door 3*c* is being closed, the drawers D1, D2, and D3 may be moved backward automatically by a pushing force of the door 3*c* or the door storage part 8*a* or by the operation of the return unit 80, and the drawers D1, D2, and D3 may move backward, and thus the length of the support bar 40*b* may decrease.

The support bar 40*b* may include a fixing bar 47 longitudinally extending in forward and backward directions and fixed to the rear surface S(r) of the storage compartment S3, and a moving bar 46 fixed to the drawers D1, D2, and D3 and extendably coupled to the fixed bar 47 in a length direction. When the door 3*c* is opened, the moving bar 46 may move forward together with the drawers D1, D2, and D3, and thus the whole length of the support bar 40*b* may increase by the movement distance of the moving bar 46.

The moving bar 46 may have one end (or front end) thereof coupled to the rear surface of the drawers D1, D2, and D3. The moving bar 46 may extend in a substantially horizontal direction, and accordingly, the fixed bar may also extend horizontally. Also, the moving bar 46 may have the other end (or rear end) thereof fixed to the rear surface S(r) of the storage compartment S3 at the substantially same height as the moving bar 46. In this structure, since the support bar 46 is covered by the drawers D1, D2, and D3, the support bar 46 and the installation structure of the support bar 46 can be hidden when a user looks into the storage compartment S3.

When a plurality of drawers D1, D2, and D3 are provided, the support bar 40*b* may be provided in plurality in accordance with the drawers D1, D2, and D3, and one pair of support bars 40*b* may be provided for one drawer D.

In some implementations, three drawers D1, D2, and D3 may be disposed in a vertical direction, and each of the drawers D1, D2, and D3 may be supported by one pair of support bars 40*b* that are spaced in a width direction of the storage compartment S3. In some implementations, the drawer D3 located at the lowermost side of the plurality of drawers D1, D2, and D3 may be supported by the base part 51 of the withdrawal unit 50*a*, and in some implementations, the support bar 40*b* for supporting the drawer D3 may be omitted.

Referring to FIG. 20, when one pair of support bars 40*b* provided in accordance with one drawer D (D1 for example) are assumed to be a first support bar 40*b*(1) and a second support bar 40*b*(2), the first support bar 40*b*(1) and the second support bar 40*b*(2) may be disposed between the first vertical bar 520*a* and the second vertical bar 520*b* of the rear frame 52.

The space between the pair of vertical bars 520*a* and 520*b* may be utilized as a space for the installation of the support bar 40. In some implementations, a structure in which one drawer D1 is supported by one pair of support bars 40*b*(1) and 40*b*(2) has been proposed. In some implementations, the drawer D1 is supported by one support bar 40*b*. The support bar 40*b* may be configured to have sufficient stiffness, and thus the drawer D1 can be supported only by one support bar 40*b*.

In some implementations, the rear frame 52 may be disposed between the first support bar 40*b*(1) and the second support bar 40*b*(2). That is, a sufficient gap may be prepared between the first support bar 40*b*(1) and the second support bar 40*b*(2) such that the drawers D1, D2, and D3 can be stably supported without wobbling from side to side, and the rear frame 52 may be installed in the gap, thereby allowing the internal space of the storage compartment S3 to be efficiently used.

The withdrawal unit 50*a* is shown in FIGS. 19 and 20, or the withdrawal unit 50*b* or the withdrawal unit 50*c* may also be applied.

FIG. 21 illustrates a storage compartment S3 of a refrigerator. Referring to FIG. 21, the drawer guide 40*a* may include a cantilever 40*c* supported by the rear surface S(r) of the storage compartment S3 and longitudinally extending in forward and backward directions to support the drawers D1, D2, and D3 (hereinafter, D1 for example) from the lower side thereof.

The rear end of the cantilever 40*c* may be coupled to the rear surface S(r) of the storage compartment S3. Particularly, the cantilever 40*c* may be detachably coupled to the rear surface S(r) of the storage compartment S3. For this, a slot that is detachably coupled to the rear end of the cantilever 40*c* may be formed in the rear surface S(r) of the storage compartment S3. Particularly, the slot may be vertically disposed in plurality in accordance with the locations of the drawers D1, D2, and D3 that are installable, and a user may install the cantilever 40*c* on the slot at a desired location.

The drawer D1 may be disposed so as to be movable in forward and backward directions along the cantilever 40*c*, and a groove in which the upper end of the cantilever 40*c* is inserted may be longitudinally formed in the undersurface of the drawer D1.

When the door 3*c* is opened, the drawer D1 may be pushed and moved forward by the withdrawal unit 50*a* while being supported by the cantilever 40*c*. In some implementations, the drawers D1, D2, and D3 may be moved backward automatically by a pushing force of the door 3*c* or the door storage part 8*a* or by the operation of the return unit 80 while being supported by the cantilever 40*c*.

When a plurality of drawers D1, D2, and D3 are provided, the cantilever 40*c* may be provided in plurality in accordance with the drawers D1, D2, and D3, and one pair of cantilevers 40*c* may be provided for one drawer D.

In some implementations, three drawers D1, D2, and D3 may be disposed in a vertical direction, and each of the drawers D1, D2, and D3 may be supported by one pair of cantilevers 40*c* that are spaced in a width direction of the storage compartment S3. In some implementations, the drawer D3 located at the lowermost side of the plurality of drawers D1, D2, and D3 may be supported by the base part 51 of the withdrawal unit 50*a*, and in some implementations, the cantilever 40*c* for supporting the drawer D3 may be omitted.

As shown in FIG. 21, One pair of cantilevers 40*c* may be disposed between the first vertical bar 520*a* and the second vertical bar 520*b* of the rear frame 52. In some implementations, the rear frame 52 may also be disposed between one pair of cantilevers 40*c*.

The withdrawal unit 50*a* is shown in FIG. 21, or the withdrawal unit 50*b* or the withdrawal unit 50*c* may also be applied.

FIG. 22 is a magnified perspective view illustrating an exemplary selective withdrawal mechanism of a drawer. FIG. 23 is a longitudinally-sectional view taken along the line VII-VII of FIG. 22.

Referring to FIGS. 22 and 23, a withdrawal unit 50*d* may include a link connection part 519 and a cover member 540. The link connection part 519 may have a long hole shape that is longitudinally formed in forward and backward directions on a bottom portion 511 of a base part 51. The cover member 540 may be seated on the link connection part 519.

Specifically, the link connection part 519 may include a cover seated step 519*a* that is stepped from the bottom portion 511 of the base part 51 to allow the cover member 540 to be seated thereon, and a slit 517 that is longitudinally formed in an oval shape inside the cover seated step 519*a*. Also, a coupling protrusion 76 fitted into the slit 517 may protrude from the rear end portion 72, i.e., base part connecting end 72 of the link 70. The coupling protrusion 76 may include a connection axis 77 upwardly protruding from the rear end portion 72 of the link 70 and passing the slit 517, and a protrusion head 78 disposed inside the link connection part 519 to be coupled to the connection axis 77. The protrusion head 78 may be a sort of bearing member which is rotatable around the connection axis, and may include a washer.

Also, a front hinge (not shown) may protrude from the front end portion 71 of the link 70, and may be inserted into the undersurface of the door 3*c*. The cover member 540 may cover a portion of the slit 517 to block the coupling protrusion 57 from moving forward and backward.

The cover seated step 519*a* may be formed to be stepped to a depth corresponding to the thickness of the cover member 540, allowing the top surface of the cover member 540 to form the same plane as the bottom portion 511 of the base part 51.

Also, the front and rear end portions of the cover seated step 519*a* and the slit 517 may be rounded so as to have a curvature corresponding to the outer circumference of the protrusion head 78. When the door 3*c* is closed, the coupling protrusion 76 may adhere closely to the rear ends of the slit 517 and the cover seated step 519*a*, and when the withdrawal unit 50*d* is maximally withdrawn, the coupling protrusion 57 may adhere closely to the front ends of the slit 517 and the cover seated step 519*a*.

Meanwhile, the front end portion of the cover member 540 may be convexly rounded in the same curvature as the curvature of the cover seated step 519*a*, and the rear end portion thereof may be concavely rounded in the same curvature as the curvature of the protrusion head 78. Accordingly, when the coupling protrusion 76 is located at the rear end of the cover seated step 519*a* and the cover member 540 is coupled to the cover seated step 519*a*, the protrusion head 78 of the coupling protrusion 76 may be surrounded by the rear end of the cover member 540 and the rear end of the cover seated step 519*a*, and thus may be blocked from moving forward and backward.

First, when a user intends to use a function of automatically withdrawing the drawer, the door 3*c* may be opened, and the withdrawal unit 50*d* may be withdrawn to the maximum. This case may be based on the premise that the coupling protrusion 57 is maintained at a state of being inserted into the slit 517.

Also, the open angle of the door 3*c* may be controlled to move the rear end portion 72 of the link 70 such that the coupling protrusion 57 is located at the rear end of the slit 517. In this state, the cover member 540 may be seated on the cover seated step 519*a*. Then, the coupling protrusion 76 may not move forward and backward. In this case, when the door 3*c* pivots in a closed direction, the withdrawal unit 50*d* may together move backward.

On the contrary, in order to disable the automatic withdrawal function of the drawer, a user may open the door 3*c* to allow the withdrawal unit 50*d* to be withdrawn forward when the cover member 540 is seated on the cover seated step 519*a*. In this state, a user may separate the cover member 540 from the cover seated step 519*a*. Then, the coupling protrusion 76 may become freely movable in forward and backward directions inside the slit 517.

When the door 3*c* pivots backward while the coupling protrusion 76 is adhering closely to the rear end of the slit 517, the withdrawal unit 50*d* may together move backward. When the door 3*c* is completed closed, the withdrawal unit 50*d* may become placed inside the refrigerator to the maximum. In this state, when the door 3*c* pivots forward to be opened, the withdrawal unit 50*d* may be maintained at a still state, and only the coupling protrusion 76 may move forward along the slit 517. Also, even though the door 3*c* is maximally opened, the coupling protrusion 76 may be maintained so as not to move farther than the front end portion of the slit 517.

FIG. 24 is a magnified perspective view illustrating another exemplary selective withdrawal mechanism of a drawer. FIG. 25 is a longitudinally-sectional view taken along the line IX-IX of FIG. 24.

Referring to FIGS. 24 and 25, a selective withdrawal mechanism of a drawer according to this embodiment may have a difference in that the cover member 540 is connected to the base part 511 of the withdrawal unit 50*d* so as to slidably movable. Also, the cover member 540 may be configured into a slidably movable and attachable/detachable structure.

Specifically, the configuration or shape of the cover member 540, the cover seated step 519*a* and the slit 517 may be similar to the previous embodiment.

Unlike the previous embodiment, at least one guide protrusion 541 may be protrusively formed on the undersurface of the cover member 540, and a cover receiving recess 519*c* may be formed at a lateral side of the cover seated step 519*a*. Also, a protrusion guide groove 519*d* may be formed in the cover receiving recess 519*c* by a certain length in a lateral direction to receive the guide protrusion 541.

The lateral width of the cover receiving recess 519*c* may be at least equal to or larger than the width of the cover member 540, and the longitudinal length of the cover receiving recess 519 may be formed to correspond to the longitudinal length of the cover member 540. The cover receiving recess 519 may be flatly stepped by a depth corresponding to the thickness of the cover member 540.

In the above-mentioned configuration, when the cover member 540 is coupled to the cover seated step 519*a*, the top surface of the cover member 540 may form the same plane as the bottom surface of the base part 51, and the guide protrusion 541 may be located at the inlet end of the protrusion guide groove 519*d*. Here, the left end of the protrusion guide groove 519*d* may be the inlet end, and may communicate with the slit 517.

In a state where the cover member 540 is mounted on the cover seated step 519*a*, the coupling protrusion 76 may not move along the slit 517. In other words, the automatic withdrawal function of the drawer is in enabled state.

However, in order to disable the automatic withdrawal function of the drawer, the cover member 540 may be pushed to the right side such that the cover seated step 519*a* is opened. Specifically, when the cover member 540 slides to the right side, the guide protrusion 541 may move to the right side along the protrusion guide groove 519*d*. When the guide protrusion 541 reaches the right end portion of the protrusion guide groove 519*d*, the right side surface of the cover member 540 may adhere closely to the right side surface of the cover receiving recess 519*c*. In this state, when the door 3*c* pivots to be opened, the coupling protrusion 76 may move forward along the slit 517, and the withdrawal unit 50*d* may be maintained at a still state.

FIG. 26 is a magnified perspective view illustrating a withdrawal unit according to another embodiment of the present invention. Referring to FIG. 26, there is a difference between the present embodiment and the previous embodiment in that a link 700 connecting the withdrawal unit 50*d* and the door 3*c* is configured with a plurality of joints (i.e., multi-joint).

At the initial opening stage of the door 3*c*, i.e., a time point until a gasket rimmed on the rear surface of the door 3*c* and adhered closely to the front surface of the cabinet 10 is separated from the front surface of the cabinet 10, a force for overcoming a magnetic force between magnets mounted in the gasket and the cabinet 10 may be needed. Accordingly, a relatively great force needs to be applied to the door 3*c*. Thereafter, once the gasket is separated from the cabinet 10, the door 3 can be pivoted by a relatively small force. Here, if a force necessary for moving the withdrawal unit 50*d* forward when the door 3*c* adheres to the cabinet 10 is not required but a force necessary for moving the withdrawal unit 50*d* forward after the door 3*c* is separated from the front surface of the cabinet 10 is required, a user can open the door 3*c* with a relatively smaller force.

In this regard, when the link 700 is configured with a multi-joint structure, the withdrawal unit 50*d* may be allowed to move from a slight delay time after the door 3*c* starts pivoting.

The link 700 may be provided so as to be movable in forward and backward directions along the bottom surface of the storage compartment S3, and a shielding cover 15 may be mounted at the front side of the bottom surface of the storage compartment S3. Also, the exposure of the link 700 to the outside may be minimized by allowing the link 700 to move in forward and backward directions under the shielding cover 15.

The multi-joint link 700 may include a first link member 710 having a front end portion connected to the undersurface of the door 3*c*, a second link member 720 pivotably connected to the rear end portion of the first link member 710, and a third link member 730 connected to the rear end portion of the second link member 720. Also, a coupling protrusion may protrude from the upper surface of the rear end portion of the third link member 730, and may be inserted into a hole formed in the undersurface of the base part 51.

Also, the rear end portion of the first link member 710 and the front end portion of the third link member 730 may be both coupled to the upper surface of the second link member 720, minimizing the thickness of the link connection part. If the rear end portion of the first link member 710 is disposed on the second link member 720 and the front end portion of the third link member 730 is disposed under the second link member 720, forming a stepped shape, the thickness of the link connection part may increase, and thus a gap between the link 700 and the bottom portion 511 of the base part 51 may be enlarged.

The first link member 710 may be longer than the other link members 720 and 730, and the second and third link members 720 and 730 may have the substantially same length. Here, the withdrawal starting point of the base part 51 constituting the withdrawal unit 50*d* may be differently set in accordance with the number of link members, and the geometric shapes and lengths of the links.

FIGS. 27 to 29 are views and graphs illustrating a displacement of a withdrawal unit according to an open angle of a door.

Referring to the graph in FIG. 27, L1 denotes the displacement of the drawer, and L2 denotes the open angle of the door.

As shown in the left drawing, when the door 3*c* is closed (a1, b1), the withdrawal unit 50*d*, specifically, the base part 51 may be maintained at a still state. Also, when the door 3*c* is closed, the second link member 720 and the third link member 730 may form an acute angle less than 90 degrees.

Referring to FIG. 28, when a user starts to open the door 3*c* and the open angle gradually increases and finally reaches about 60 degrees (a2, b2), the base part 51 may start to move forward. The point b2 may be defined as a critical point where the base part 51 is converted from still state to moving state.

When the base part 51 starts to move forward, the second link member 720 and the third link member 730 may be spread so as to become nearly a straight line. In other words, the second link member 720 and the third link member 730 may relatively pivot, and thus an angle between the second link member 720 and the third link member 730 may be changed from an acute angle less than 90 degrees to about 180 degrees.

Referring to FIG. 29, when the door 3*c* pivots to the maximum, the base part 51 may move forward to the maximum.

Specifically, the front end portion of the link 700 may move forward to the maximum before the door 3*c* opens to the maximum, and in this state, the front end portion of the link 700 may rather move backward even though the door 3*c* further pivots and reaches the maximum open angle.

Also, the base part 51 may already move forward to the maximum before the door 3*c* reaches the maximum open angle, and may also move forward to the maximum at points (a3, b3) where the door 3*c* reaches the maximum open angle.

Alternatively, the base part 51 may not be withdrawn to the maximum even when the door 3*c* opens to the maximum, and may also be withdrawn to the maximum after a lapse of certain time from when the door 3*c* opens to the maximum. This may be because the base part 51 further move forward by the inertia of the withdrawal unit 50*d* when the link 700 pulls the base part 51 for a preset time and stops.

The invention claimed is:

1. A refrigerator comprising:

a cabinet that includes a storage compartment that has an opening at a front of the storage compartment;

a door that is configured to open and close at least a portion of the storage compartment;

a drawer that is located in the storage compartment;

a drawer guide that is configured to support the drawer, that is configured to guide the drawer based on the drawer moving forward and backward, that is located between a side surface of the storage compartment and the drawer, and that comprises:

a fixed rail that is located in the storage compartment and that extends in a forward direction and a backward direction; and at least one moving rail that is connected with the drawer and that is configured to move along the fixed rail;

a bracket that is located on the side surface of the storage compartment and that is connected to the fixed rail; and a withdrawal unit that is configured to push the drawer forward based on the door opening and that comprises:

a base part that is located under the drawer, that is configured to move forward based on the door opening, and that is configured to move backward based on the door closing; and a rear frame that upwardly extends from the base part to be disposed to a rear side of the drawer and that is configured to push the drawer forward from the rear side of the drawer based on the base part moving forward; and wherein the fixed rail comprises:

a first strip part that is parallel to the side surface of the storage compartment and that extends in the forward direction and the backward direction;

a second strip part that extends horizontally from the first strip part to the drawer and that comprises a notch that extends up from a portion of the second strip part that is spaced apart from the first strip part; and a pocket part that is located on one end of the second strip part and that is configured to receive a lower end portion of the moving rail, and wherein the bracket defines a rail installation groove that is configured to receive the first strip part of the fixed rail.

2. The refrigerator of claim 1, wherein the rear frame comprises:

a pair of vertical bars that extend up from the base part, that are located at the rear side of the drawer, and that are spaced from each other in a horizontal direction.

3. The refrigerator of claim 2, further comprising a link that has a front end portion that is pivotably connected to the door, that has a rear end portion that is pivotably connected to the base part, and that is configured to move the base part based on opening and closing the door, wherein the base part comprises:

a bottom portion that is pivotably connected to the rear end portion of the link; and a rear surface portion that extends up from a rear end of the bottom portion, and wherein the pair of vertical bars each have lower end portions that are coupled to the rear surface portion.

4. The refrigerator of claim 3, wherein the rear end portion of the link is connected to an undersurface of the bottom portion.

5. The refrigerator of claim 3, wherein:

each of the pair of vertical bars includes a portion of a frame member that is in a beam shape and that is longer than it is wide, and the frame member comprises a connection section that connects the pair of vertical bars and that is coupled to an undersurface of the bottom portion.

6. The refrigerator of claim 2, wherein the withdrawal unit further comprises a connection bar that connects the pair of vertical bars and that is located above the base part.

7. The refrigerator of claim 6, wherein the withdrawal unit further comprises one or more additional connection bars that are located above or below the connection bar.

8. The refrigerator of claim 2, wherein a lower end portion of each of the pair of vertical bars is coupled to the base part.

9. The refrigerator of claim 8, further comprising a link that has a front end portion that is pivotably connected to the door, that has a rear end portion that is pivotably connected to the base part, and that is configured to move the base part based on opening and closing the door, wherein the base part comprises:

a bottom portion that is pivotably connected to the rear end portion of the link; and a rear surface portion that extends up from a rear end of the bottom portion, and wherein the pair of vertical bars each have lower end portions that are coupled to the rear surface portion.

10. The refrigerator of claim 9, further comprising a pair of holders that are located on the rear surface portion, and that are configured to receive a respective lower end portion of the pair of vertical bars, and that each define a pocket that is configured to surround both lateral sides of a respective vertical bar.

11. The refrigerator of claim 2, further comprising a link that has a front end portion that is pivotably connected to the door, that has a rear end portion that is pivotably connected to the base part, and that is configured to move the base part based on opening and closing the door, wherein the base part comprises:

a bottom portion that is pivotably connected to the rear end portion of the link;

a pair of side surface portions that extend up from side ends of the bottom portion; and a rear surface portion that extends up from a rear end of the bottom portion and that is configured to connect the pair of side surface portions, wherein the withdrawal unit further comprises a reinforcing band that is configured to surround the pair of side surface portions and the rear surface portion, that is bent at a first location where a first end of the rear surface portion connects with one of the side surface portions, and that is bent at a second location where a second end of the rear surface portion connects with another one of the side surface portions.

12. The refrigerator of claim 11, wherein the reinforcing band comprises a metallic material.

13. The refrigerator of claim 11, wherein the pair of vertical bars are coupled to the reinforcing band.

14. The refrigerator of claim 1, further comprising a link that has a front end portion that is pivotably connected to the door, that has a rear end portion that is pivotably connected to the base part, and that is configured to move the base part based on opening and closing the door.

15. The refrigerator of claim 14, wherein:

the front end portion defines a first pivot joint that is located at a connection between the front end portion and the door and that is located a particular distance from a rotation axis of the door, and the rear end portion defines a second pivot joint that is located at a connection between the rear end portion and the base part.

16. The refrigerator of claim 15, further comprising a pair of withdrawal unit guides that are located at opposite sides of the base part and that are configured to guide movement of the base part in a forward direction and a backward direction, wherein the first pivot joint is located at a left side of the refrigerator and the second pivot joint is located at a right side of the refrigerator or the first pivot joint is located at the right side of the refrigerator and the second pivot joint is located at the left side of the refrigerator.

17. The refrigerator of claim 14, wherein the link comprises:

a first bent section that extends from the front end portion and that is concave with respect to a rotation axis of the door based on the door being open, and a second bent section that is bent opposite to the first bent section and that is located between the first bent section and the rear end portion.

18. The refrigerator of claim 1, further comprising a withdrawal unit guide that is located at the base part and a side surface of the storage compartment and that is configured to guide movement of the base part in a forward direction and a backward direction.

19. The refrigerator of claim 18, wherein the withdrawal unit guide comprises:

a rail that is located on the side surface of the storage compartment and that extends in the forward direction and the backward direction; and a roller that is located on the base part and that is configured to contact with and rotate on the rail based on the base part moving.

20. The refrigerator of claim 1, further comprising a withdrawal unit guide that is located at the base part and a bottom of the storage compartment and that is configured to guide movement of the base part in a forward direction and a backward direction.

21. The refrigerator of claim 1, wherein the rail installation groove comprises:

a vertical surface that extends in the forward direction and the backward direction;

an upper horizontal surface that horizontally protrudes from an upper end of the vertical surface and that extends in the forward direction and the backward direction; and the lower horizontal surface that horizontally protrudes from a lower end of the vertical surface and that extends in the forward direction and the backward direction, an upper support protrusion protrudes down from the upper horizontal surface, and a lower support protrusion protrudes up from the lower horizontal surface; and an upper end portion of the first strip part of the fixed rail is located between the vertical surface and the upper support protrusion, and the lower support protrusion is inserted into the notch of the fixed rail.

22. The refrigerator of claim 1, wherein:

the rear frame is separate from the drawer, and the drawer is configured to move by contact between the rear frame and the drawer based on opening the door or closing the door.

23. The refrigerator of claim 1, further comprising a link having a front end portion pivotably connected to the door, having a rear end portion pivotably connected to the base part, and moving the base part in accordance with opening and closing operations of the door, wherein the link comprises:

a first link member comprising a front end portion pivotably connected to the door;

a second link member comprising a front end portion pivotably connected to the rear end of the first link member; and a third link member comprising a front end portion pivotably connected to the rear end of the second link member and comprising a rear end portion pivotably connected to the base part.

24. The refrigerator of claim 23, wherein when the door is closed, the second link member makes an acute angle with the third link member.

25. The refrigerator of claim 23, wherein when the open angle of the door is equal to or larger than about 60 degrees, the withdrawal unit moves forward.

26. The refrigerator of claim 25, wherein when the door starts to move forward, the second link member makes an obtuse angle with the third link member.

27. The refrigerator of claim 23, further comprising a gasket rimmed around the edge of the rear surface of the door and adhering to the front surface of the cabinet when the door is closed, wherein the withdrawal unit is maintained at a still state before the gasket is separated from the cabinet by opening the door.

28. The refrigerator of claim 23, wherein the second link member and the third link member are shorter than the first link member.

29. The refrigerator of claim 23, wherein the first link member and the third link member adhere closely to one of the top surface and the undersurface of the second link member.

30. The refrigerator of claim 23, wherein the front end portion of the first link member is rounded.

31. A refrigerator comprising:

a cabinet that includes a storage compartment that has an opening at a front of the storage compartment;

a door that is configured to open and close at least a portion of the storage compartment;

a drawer that is located in the storage compartment;

a drawer guide that is configured to support the drawer and that is configured to guide the drawer based on the drawer moving forward and backward; and a withdrawal unit that is configured to push the drawer forward based on the door opening, wherein the withdrawal unit comprises:

a base part that is located under the drawer, that is configured to move forward based on the door opening, and that is configured to move backward based on the door closing; and a rear frame that upwardly extends from the base part to be disposed to a rear side of the drawer and that is configured to push the drawer forward from the rear side of the drawer based on the base part moving forward, wherein the rear frame comprises:

a pair of vertical bars that extend up from the base part, that are located at the rear side of the drawer, and that are spaced from each other in a horizontal direction, wherein the refrigerator further comprises a link that has a front end portion that is pivotably connected to the door, that has a rear end portion that is pivotably connected to the base part, and that is configured to move the base part based on opening and closing the door, wherein the base part comprises:

a bottom portion that is pivotably connected to the rear end portion of the link; and a rear surface portion that extends up from a rear end of the bottom portion, wherein the pair of vertical bars each have lower end portions that are coupled to the rear surface portion, and wherein:

the rear surface portion inclines upward from the bottom portion toward a rear side of the refrigerator;

the vertical bar comprises a first inclination section that defines an incline corresponding to the rear surface portion; and the first inclination section and the rear surface portion are coupled together.

32. The refrigerator of claim 31, wherein the vertical bar further comprises a first vertical section that extends vertically from the first inclination section to an upper side of the refrigerator.

33. The refrigerator of claim 32, further comprising:
one or more drawers that are located above the drawer,
wherein the first vertical section extends vertically to at least a height corresponding to a bottom of a lowest drawer of the one or more drawers that are located above the drawer.

34. The refrigerator of claim 33, wherein the vertical bar further comprises:
a second inclination section that inclines upward from the first vertical section toward a rear side of the refrigerator; and
a second vertical section that extends vertically from the second inclination section to the upper side of the refrigerator,
wherein the second vertical section extends vertically to a second drawer of the one or more drawers and the drawer that is above the lowest drawer.

35. A refrigerator comprising:
a cabinet that includes a storage compartment that has an opening at a front of the storage compartment;
a door that is configured to open and close at least a portion of the storage compartment;
a drawer that is located in the storage compartment;
a drawer guide that is configured to support the drawer and that is configured to guide the drawer based on the drawer moving forward and backward; and
a withdrawal unit that is configured to push the drawer forward based on the door opening,
wherein the withdrawal unit comprises:
a base part that is located under the drawer, that is configured to move forward based on the door opening, and that is configured to move backward based on the door closing; and
a rear frame that upwardly extends from the base part to be disposed to a rear side of the drawer and that is configured to push the drawer forward from the rear side of the drawer based on the base part moving forward,
wherein the rear frame comprises:
a pair of vertical bars that extend up from the base part, that are located at the rear side of the drawer, and that are spaced from each other in a horizontal direction,
wherein the withdrawal unit further comprises a connection bar that connects the pair of vertical bars and that is located above the base part, and
wherein the withdrawal unit further comprises:
an arm that protrudes forward from the connection bar; and
a roller that is configured to rotate and that is located on the arm,
wherein the refrigerator further comprises an arm guide that is located in the storage compartment and that is configured to support the roller based on the withdrawal unit moving.

36. The refrigerator of claim 35, wherein the arm is located between a side surface of the storage compartment and the drawer.

37. The refrigerator of claim 35, wherein the arm guide comprises a roller guide surface that is configured to contact the roller under the roller and that extends along a movement path of the roller.

38. The refrigerator of claim 37, wherein the arm guide defines a guide groove that opens toward the drawer, and the roller guide surface supports the roller in the guide groove.

39. A refrigerator comprising:
a cabinet that includes a storage compartment that has an opening at a front of the storage compartment;
a door that is configured to open and close at least a portion of the storage compartment;
a drawer that is located in the storage compartment;
a drawer guide that is configured to support the drawer and that is configured to guide the drawer based on the drawer moving forward and backward;
a withdrawal unit that is configured to push the drawer forward based on the door opening; and
a link that has a front end portion that is pivotably connected to the door, that has a rear end portion that is pivotably connected to the base part, and that is configured to move the base part based on opening and closing the door,
wherein the withdrawal unit comprises:
a base part that is located under the drawer, that is configured to move forward based on the door opening, and that is configured to move backward based on the door closing; and
a rear frame that upwardly extends from the base part to be disposed to a rear side of the drawer and that is configured to push the drawer forward from the rear side of the drawer based on the base part moving forward,
wherein:
the front end portion defines a first pivot joint that is located at a connection between the front end portion and the door and that is located a particular distance from a rotation axis of the door, and
the rear end portion defines a second pivot joint that is located at a connection between the rear end portion and the base part, and
wherein the base part defines a slit that extends perpendicular to a rear side of the refrigerator, and the rear end portion is configured to move along the slit.

40. The refrigerator of claim 39, wherein, based on the base part moving forward, the rear end portion of the link is located at a front end of the slit.

41. The refrigerator of claim 40, wherein, based on the door being closed, the rear end portion of the link is spaced from the front end of the slit.

42. A refrigerator comprising:
a cabinet that includes a storage compartment that has an opening at a front of the storage compartment;
a door that is configured to open and close at least a portion of the storage compartment;
a drawer that is located in the storage compartment;
a drawer guide that is configured to support the drawer and that is configured to guide the drawer based on the drawer moving forward and backward; and
a withdrawal unit that is configured to push the drawer forward based on the door opening,
wherein the withdrawal unit comprises:
a base part that is located under the drawer, that is configured to move forward based on the door opening, and that is configured to move backward based on the door closing; and
a rear frame that upwardly extends from the base part to be disposed to a rear side of the drawer and that is configured to push the drawer forward from the rear side of the drawer based on the base part moving forward,
wherein the drawer guide is located between a side surface of the storage compartment and the drawer,
wherein the drawer guide comprises:
a fixed rail that is located in the storage compartment and that extends in a forward direction and a backward direction; and at least one moving rail that is connected with the drawer and that is configured to move along the fixed rail, wherein the refrigerator further comprises a drawer connection member that connects the at least one moving rail and the drawer, wherein a hook is located on the moving rail, and wherein the drawer connection member defines a coupling hole that is configured to couple to the hook.

43. A refrigerator comprising:

a cabinet that includes a storage compartment that has an opening at a front of the storage compartment;

a door that is configured to open and close at least a portion of the storage compartment;

a drawer that is located in the storage compartment;

a drawer guide that is configured to support the drawer and that is configured to guide the drawer based on the drawer moving forward and backward; and a withdrawal unit that is configured to push the drawer forward based on the door opening, wherein the withdrawal unit comprises:

a base part that is located under the drawer, that is configured to move forward based on the door opening, and that is configured to move backward based on the door closing; and a rear frame that upwardly extends from the base part to be disposed to a rear side of the drawer and that is configured to push the drawer forward from the rear side of the drawer based on the base part moving forward, wherein the refrigerator further comprises a return unit that is configured to move the drawer backward based on the door closing, and wherein the return unit comprises:

a connection unit that is connected with the drawer;

a locker that is connected to the connection unit and that is configured to move in a same direction as the drawer;

a locker guide that is located in the storage compartment and that is configured to guide movement of the locker; and a spring that has one end connected to the locker guide and another end connected to the locker and that is configured to stretch based on the locker moving forward.

44. The refrigerator of claim 43, wherein:

the locker comprises a movement guide protrusion and a turning protrusion that is parallel to the movement guide protrusion;

the locker guide comprises:

a straight guide slit that extends in a forward direction and a backward direction and that is configured to receive the movement guide protrusion, and a turning guide groove that is configured to cause the turning protrusion to reverse a direction of the movement guide protrusion based on the movement guide protrusion reaching a certain location within the straight guide slit;

a coupling protrusion is located on one of the locker or the connection unit, and another one of the locker or the connection unit define a coupling groove, and the coupling protrusion is configured to insert into the coupling groove based on the drawer moving forward;

the connection unit and the locker are configured to move forward together; and the coupling groove is configured to separate from the coupling protrusion based on the locker rotating in a forward direction about the movement guide protrusion based on the turning protrusion moving along the turning guide groove.

45. The refrigerator of claim 44, wherein interference between the turning protrusion and the turning guide groove causes the locker to maintain a same location.

46. The refrigerator of claim 45, wherein, based on the coupling protrusion and the coupling groove separating and based on the connection unit moving backward, the coupling protrusion inserts into the coupling groove causing the locker to rotate in a reverse direction.

47. The refrigerator of claim 43, wherein the drawer guide comprises:

a fixed rail that is located in the storage compartment and extends in the forward direction and the backward direction; and at least one moving rail that is connected with the drawer and that is configured to move along the fixed rail, wherein the connection unit connects the moving rail with the locker.

48. The refrigerator of claim 47, wherein the connection unit comprises:

a connection tab that has an upper end portion that is coupled to the moving rail and a lower end portion that defines at least one groove that extends vertically; and a locker connecting member that defines a coupling groove and that has an insertion plate that is inserted into the at least one groove of the connection tab and that is configured to detach from the groove of the connection tab.

49. A refrigerator comprising:

a cabinet that includes a storage compartment that has an opening at a front of the storage compartment;

a door that is configured to open and close at least a portion of the storage compartment;

a drawer that is located in the storage compartment;

a drawer guide that is configured to support the drawer and that is configured to guide the drawer based on the drawer moving forward and backward; and a withdrawal unit that is configured to push the drawer forward based on the door opening, wherein the withdrawal unit comprises:

a base part that is located under the drawer, that is configured to move forward based on the door opening, and that is configured to move backward based on the door closing; and a rear frame that upwardly extends from the base part to be disposed to a rear side of the drawer and that is configured to push the drawer forward from the rear side of the drawer based on the base part moving forward, and wherein the drawer guide comprises a support bar that connects a rear surface of the storage compartment and the drawer and that varies in length based on the withdrawal unit moving the drawer.

50. The refrigerator of claim 49, wherein the support bar comprises:

a fixed bar that is connected to the rear surface of the storage compartment; and a moving bar that is connected to the drawer and that is configured to extend from the fixed bar.

51. A refrigerator comprising:

a cabinet that includes a storage compartment that has an opening at a front of the storage compartment;

a door that is configured to open and close at least a portion of the storage compartment;

a drawer that is located in the storage compartment;

a drawer guide that is configured to support the drawer and that is configured to guide the drawer based on the drawer moving forward and backward; and a withdrawal unit that is configured to push the drawer forward based on the door opening, wherein the withdrawal unit comprises:

a base part that is located under the drawer, that is configured to move forward based on the door opening, and that is configured to move backward based on the door closing; and a rear frame that upwardly extends from the base part to be disposed to a rear side of the drawer and that is configured to push the drawer forward from the rear side of the drawer based on the base part moving forward, and wherein the drawer guide comprises a cantilever that has a rear end that is coupled to a rear surface of the storage compartment and that supports the drawer from a bottom of the drawer by extending horizontally from the rear end to the opening.

52. The refrigerator of claim 51, wherein a rear surface of the storage compartment defines a slot and the rear end of the cantilever is configured to connect to the slot and is configured to detach from the slot.

53. The refrigerator of claim 52, wherein the rear surface of the storage compartment defines one or more additional slots that are oriented vertically.

54. A refrigerator comprising:

a cabinet that includes a storage compartment that has an opening at a front of the storage compartment;

a door that is configured to open and close at least a portion of the storage compartment;

a drawer that is located in the storage compartment;

a drawer guide that is configured to support the drawer and that is configured to guide the drawer based on the drawer moving forward and backward; and a withdrawal unit that is configured to push the drawer forward based on the door opening, wherein the withdrawal unit comprises:

a base part that is located under the drawer, that is configured to move forward based on the door opening, and that is configured to move backward based on the door closing; and a rear frame that upwardly extends from the base part to be disposed to a rear side of the drawer and that is configured to push the drawer forward from the rear side of the drawer based on the base part moving forward, and wherein the refrigerator further comprises:

a link having a front end portion pivotably connected to the door, having a rear end portion pivotably connected to the base part, and moving the base part in accordance with opening and closing operations of the door;

a coupling protrusion upwardly protruding from the rear end portion of the link;

a slit extending in the base part in forward and backward directions by a certain length and allowing the coupling protrusion to be inserted therein; and a cover member covering a portion of the slit to selectively block the coupling protrusion from moving forward and backward.

55. The refrigerator of claim 54, wherein:

the base part comprises a cover seated step which is formed therein and the cover member is seated on;

the slit is formed inside the cover seated step; and when the cover member is seated on the cover seated step, the top surface of the cover member and the top surface of the base part form the same plane.

56. The refrigerator of claim 55, wherein the cover member is detachably seated on the cover seated step.

57. The refrigerator of claim 55, wherein the cover member is slidably movable from the cover seated step.

58. The refrigerator of claim 57, further comprising a cover receiving recess formed in a bottom portion of the withdrawal unit, the bottom potion corresponding to a lateral edge of the cover seated step, and receiving the cover member, wherein the cover member slidably moves in a lateral direction of the withdrawal unit to be held in the cover receiving recess.

59. The refrigerator of claim 58, further comprising:

a guide protrusion protruding from an undersurface of the cover member; and a protrusion guide groove formed in the cover receiving recess in a lateral direction by a certain length and receiving the guide protrusion.

* * * * *